United States Patent [19]

Maskasky

[11] 4,435,501

[45] Mar. 6, 1984

[54] CONTROLLED SITE EPITAXIAL SENSITIZATION

[75] Inventor: Joe E. Maskasky, Rochester, N.Y.

[73] Assignee: Eastman Kodak Company, Rochester, N.Y.

[21] Appl. No.: 431,855

[22] Filed: Sep. 30, 1982

Related U.S. Application Data

[63] Continuation-in-part of Ser. No. 320,920, Nov. 12, 1981, abandoned.

[51] Int. Cl.[3] ..... G03C 1/02

[52] U.S. Cl. ..... 430/434; 430/567; 430/569; 430/570; 430/581; 430/591

[58] Field of Search ..... 430/567, 569, 570, 581, 430/591, 434

[56] References Cited

U.S. PATENT DOCUMENTS

| | | | |
|---|---|---|---|
| 2,221,805 | 11/1940 | Leermaker | 430/575 |
| 2,222,264 | 11/1940 | Nietz | 430/603 |
| 2,642,361 | 6/1953 | Damschroder | 430/603 |
| 3,140,179 | 7/1964 | Russell | 430/434 |
| 3,152,907 | 10/1964 | Godowsky | 430/545 |
| 3,320,069 | 5/1967 | Illingsworth | 430/603 |
| 3,505,068 | 4/1970 | Beckett et al. | 430/138 |
| 3,656,962 | 4/1972 | Levy | 430/569 |
| 3,804,629 | 4/1974 | Hammerstein et al. | 430/569 |
| 3,852,066 | 12/1974 | Levy | 430/569 |
| 3,852,067 | 12/1974 | Levy | 430/84 |
| 3,894,871 | 7/1975 | Land | 430/228 |
| 4,063,951 | 12/1977 | Bogg | 430/567 |
| 4,067,739 | 1/1978 | Lewis | 430/567 |
| 4,094,684 | 6/1978 | Maskasky | 430/605 |
| 4,142,900 | 3/1979 | Maskasky | 430/567 |
| 4,150,994 | 4/1979 | Maternaghan | 430/567 |
| 4,184,877 | 1/1980 | Maternaghan | 430/567 |
| 4,184,878 | 1/1980 | Maternaghan | 430/567 |
| 4,386,156 | 9/1983 | Mignot | 430/569 |
| 4,399,215 | 9/1983 | Wey | 430/569 |
| 4,411,986 | 10/1983 | Abbott et al. | 430/495 |

FOREIGN PATENT DOCUMENTS

| | | |
|---|---|---|
| 19917 | 5/1980 | European Pat. Off. . |
| 505012 | 8/1930 | Fed. Rep. of Germany . |
| 2905655 | 2/1979 | Fed. Rep. of Germany . |
| 2921077 | 5/1979 | Fed. Rep. of Germany . |
| 55-142329 | 11/1980 | Japan . |
| 1027146 | 4/1966 | United Kingdom . |
| 1570581 | 7/1980 | United Kingdom . |
| 2038792A | 7/1980 | United Kingdom . |
| 2053499A | 2/1981 | United Kingdom . |

OTHER PUBLICATIONS

Evans et al., "Further Contribution to the Theory of Photographic Sensitivity", The Journal of Photographic Science, vol. 3, 1955, pp. 73–87.

Klein et al., "The Conversion of Silver Halides", Photo. Korr., 102(4), pp. 59–63, (1966).

Peelaers et al., "Decoration of the Surface of Silverbromide Microcrystals by Treatment with Dithiosulfatodurate (I) Ions", Photo Korr 105(5), 77–82, 1969.

Zelikman and Levi, *Making and Coating Photographic Emulsions,* Focal Press 1964, p. 223.

deCugnac and Chateau, "Evolution of the Morphology of Silver Bromide Crystals During Physical Ripening", *Science et Industries Photographiques,* vol. 33, No. 2, (1962), pp. 121–125.

Duffin, *Photographic Emulsion Chemistry,* Focal Press, 1966, pp. 66–72.

Trivelli and Smith, "The Effect of Silver Iodide Upon the Structure of Bromo-Iodide Precipitation Series", *The Photographic Journal,* vol. LXXX, Jul. 1940, pp. 285–288.

Gutoff, "Nucleation and Growth Rates During the Precipitation of Silver Halide Photographic Emulsions", *Photographic Sciences and Engineering,* vol. 14, No. 4, Jul.–Aug. 1970, pp. 248–257.

Steigman, "Green- and Brown-Developing Emulsions", *Photographische Industrie,* vol. 34, pp. 764, 766 and 872, published Jul. 8, and Aug. 5, 1938.

Berry and Skillman, "Surface Structures and Epitaxial Growths on AgBr Microcrystals", *Journal of Applied Physics,* vol. 35, No. 7, Jul. 1964, pp. 2165–2969.

Suzuki and Ueda, "The Active Sites for Chemical Sensitization of Monodisperse AgBr Emulsions", 1973, SPSE Tokyo.

Shiozawa, "Electron Microscopic Study on Conversion of Silver Halides, I Effect of PEO on Conversion of AgBr to AgI", Bulletin of the Society of Photog. Sci. & Tech. of Japan, No. 22, 6–13, (1972).

*Primary Examiner*—Mary F. Downey
*Attorney, Agent, or Firm*—Carl O. Thomas

[57] ABSTRACT

High aspect ratio tabular grain silver halide emulsions, photographic elements incorporating these emulsions, and processes for the use of the photographic elements are disclosed. In the tabular grain emulsions the silver halide grains having a thickness of less than 0.5 micron (preferably less than 0.3 micron) and a diameter of at least 0.6 micron have a high aspect ratio and account for at least 50 percent of the total projected area of the silver halide grains present. Silver salt is epitaxially located on and substantially confined to selected surface sites of the tabular silver halide grains.

111 Claims, 27 Drawing Figures

1 μm

2 μm

2 μm

2 μm

2 μm

2 μm

2 μm

1 μm 0.25 um 0.5 um

1 μm

1 μm

2 μm

1μm

1μm

1 μm

2 μm

1 μm

CONTROLLED SITE EPITAXIAL SENSITIZATION

FIELD OF THE INVENTION

The invention relates to silver halide photography and specifically to radiation-sensitive emulsions and photographic elements containing silver halide as well as to processes for the use of the photographic elements.

a. Tabular silver halide grains

Silver halide photography employs radiation-sensitive emulsions comprised of a dispersing medium, typically gelatin, containing embedded microcrystals—known as grains—of radiation-sensitive silver halide. A variety of regular and irregular grain shapes have been observed in silver halide photographic emulsions. Regular grains are often cubic or octahedral. Grain edges can exhibit rounding due to ripening effects, and in the presence of strong ripening agents, such as ammonia, the grains may even be spherical or near spherical thick platelets, as described, for example by Land U.S. Pat. No. 3,894,871 and Zelikman and Levi *Making and Coating Photographic Emulsions,* Focal Press, 1964, pp. 221–223. Rods and tabular grains in varied portions have been frequently observed mixed in among other grain shapes, particularly where the pAg (the negative logarithm of silver ion concentration) of the emulsions has been varied during precipitation, as occurs, for example in single-jet precipitations.

Tabular silver bromide grains have been extensively studied, often in macro-sizes having no photographic utility. Tabular grains are herein defined as those having two substantially parallel {111} crystal faces, each of which is substantially larger than any other single crystal face of the grain. The aspect ratio—that is, the ratio of diameter to thickness—of tabular grains is substantially greater than 1:1. High aspect ratio tabular grain silver bromide emulsions were reported by deCugnac and Chateau, "Evolution of the Morphology of Silver Bromide Crystals During Physical Ripening", *Science et Industries Photographiques,* Vol. 33, No. 2 (1962), pp. 121–125.

From 1937 until the 1950's the Eastman Kodak Company sold a Duplitized® radiographic film product under the name No-Screen X-Ray Code 5133. The product contained as coatings on opposite major faces of a film support sulfur sensitized silver bromide emulsions. Since the emulsions were intended to be exposed by X-radiation, they were not spectrally sensitized. The tabular grains had an average aspect ratio in the range of from about 5 to 7:1. The tabular grains accounted for greater than 50% of the projected area while nontabular grains accounted for greater than 25% of the projected area. The emulsion having the highest average aspect ratio, chosen from several remakes, had an average tabular grain diameter of 2.5 microns, an average tabular grain thickness of 0.36 micron, and an average aspect ratio of 7:1. In other remakes the emulsions contained thicker, smaller diameter tabular grains which were of lower average aspect ratio.

Although tabular grain silver bromoiodide emulsions are known in the art, none exhibit a high average aspect ratio. A discussion of tabular silver bromoiodide grains appears in Duffin, *Photographic Emulsion Chemistry,* Focal Press, 1966, pp. 66–72, and Trivelli and Smith, "The Effect of Silver Iodide Upon the Structure of Bromo-Iodide Precipitation Series", *The Photographic Journal,* Vol. LXXX, July 1940, pp. 285–288. Trivelli and Smith observed a pronounced reduction in both grain size and aspect ratio with the introduction of iodide. Gutoff, "Nucleation and Growth Rates During the Precipitation of Silver Halide Photographic Emulsions", *Photographic Science and Engineering,* Vol. 14, No. 4, July-August 1970, pp. 248–257, reports preparing silver bromide and silver bromoiodide emulsions of the type prepared by single-jet precipitations using a continuous precipitation apparatus.

Bogg, Lewis, and Maternaghan have recently published procedures for preparing emulsions in which a major proportion of the silver halide is present in the form of tabular grains. Bogg U.S. Pat. No. 4,063,951 teaches forming silver halide crystals of tabular habit bounded by {100} cubic faces and having an aspect ratio (based on edge length) of from 1.5 to 7:1. The tabular grains exhibit square and rectangular major surfaces characteristic of {100} crystal faces. Lewis U.S. Pat. No. 4,067,739 discloses the preparation of silver halide emulsions wherein most of the crystals are of the twinned octahedral type by forming seed crystals, causing the new crystals to increase in size by Ostwald ripening, and completing grain growth without renucleation or Ostwald ripening while controlling pBr (the negative logarithm of bromide ion concentration). Maternaghan U.S. Pat. Nos. 4,150,994, 4,184,877, and 4,184,878, U.K. Pat. No. 1,570,581, and German OLS publications Nos. 2,905,655 and 2,921,077 teach the formation of silver halide grains of flat twinned octahedral configuration by employing seed crystals which are at least 90 mole percent iodide. (Except as otherwise indicated, all references to halide percentages are based on silver present in the corresponding emulsion, grain, or grain region being discussed; e.g., a grain consisting of silver bromoiodide containing 90 mole percent iodide contains 10 mole percent bromide.) Lewis and Maternaghan report increased covering power. Maternaghan states that the emulsions are useful in camera films, both black-and-white and color. Bogg specifically reports an upper limit on aspect ratios to 7:1, but, from the very low aspect ratios obtained by the examples, the 7:1 aspect ratio appears unrealistically high. It appears from repeating examples and viewing the photomicrographs published that the aspect ratios realized by Lewis and Maternaghan were also less than 7:1.

Japanese patent application publication No. 142,329, published Nov. 6, 1980, appears to be essentially cumulative with Maternaghan, but is not restricted to the use of silver iodide seed grains. Further, this publication specifically refers to the formation of tabular silver cholorobromide grains containing less than 50 mole percent chloride. No specific example of such an emulsion is provided, but from an examination of the information provided, it appears that this publication obtained a relatively low proportion of tabular silver halide grains and that the tabular grains obtained are of no higher aspect ratios than those of Maternaghan.

Wey U.S. Pat. No. 4,399,215, based on U.S. Ser. No. 429,403, filed concurrently herewith and commonly assigned, titled IMPROVED DOUBLE-JET PRECIPITATION PROCESSES AND PRODUCTS THEREOF, which is a continuation-in-part of U.S. Ser. No. 320,908, filed Nov. 12, 1981, now abandoned, discloses a process of preparing tabular silver chloride grains which are substantially internally free of both silver bromide and silver iodide. The emulsions have an average aspect ratio of greater than 8:1.

Maskasky U.S. Pat. No. 4,400,463, based on U.S. Ser. No. 431,455, filed concurrently herewith and commonly assigned, titled SILVER CHLORIDE EMULSIONS OR MODIFIED CRYSTAL HABIT AND PROCESSES FOR THEIR PREPARATION, which is a continuation-in-part of U.S. Ser. No. 320,898, filed Nov. 12, 1981, now abandoned, discloses a process of preparing tabular grains having opposed major crystal faces lying in {111} crystal planes and, in one preferred form, at least one peripheral edge lying perpendicular to a <211> crystallographic vector in the plane of one of the major surfaces. Thus, the crystal edges obtained are in this instance crystallographically offset 30° as compared to those of Wey. Maskasky requires that the novel tabular grains be predominantly (that is, at least 50 mole percent) chloride.

Wilgus and Haefner U.S. Ser. No. 429,420, filed concurrently herewith and commonly assigned, titled HIGH ASPECT RATIO SILVER BROMOIODIDE EMULSIONS AND PROCESSES FOR THEIR PREPARATION, which is a continuation-in-part of U.S. Ser. No. 320,905, filed Nov. 12, 1981, now abandoned, discloses high aspect ratio silver bromoiodide emulsions and a process for their preparation.

Daubendiek and Strong U.S. Ser. No. 429,587, filed concurrently herewith and commonly assigned, titled AN IMPROVED PROCESS FOR THE PREPARATION OF HIGH ASPECT RATIO SILVER BROMOIODIDE EMULSIONS, which is a continuation-in-part of U.S. Ser. No. 320,906, filed Nov. 12, 1981 now abandonded, discloses an improvement on the processes of Maternaghan whereby high aspect ratio tabular grain silver bromoiodide emulsions can be prepared.

Abbott and Jones U.S. Ser. No. 430,222, filed concurrently herewith and commonly assigned, titled RADIOGRAPHIC ELEMENTS EXHIBITING REDUCED CROSSOVER, which is a continuation-in-part of U.S. Ser. No. 320,907, filed Nov. 12, 1981, now abandoned, discloses the use of high aspect ratio tabular grain silver halide emulsions in radiographic elements coated on both major surfaces of a radiation transmitting support to control crossover.

Solberg, Piggin, and Wilgus U.S. Ser. No. 431,913, filed concurrently herewith and commonly assigned, titled RADIATION-SENSITIVE SILVER BROMOIODIDE EMULSIONS, PHOTOGRAPHIC ELEMENTS, AND PROCESSES FOR THEIR USE, which is a continuation-in-part of U.S. Ser. No. 320,909, filed Nov. 12, 1981, now abandoned, discloses high aspect ratio tabular grain silver bromoiodide emulsions wherein a higher concentration of iodide is present in an annular region than in a central region of the tabular grains.

Dickerson U.S. Ser. No. 430,574, filed concurrently herewith and commonly assigned, titled FOREHARDENED PHOTOGRAPHIC ELEMENTS AND PROCESSES FOR THEIR USE, which is a continuation-in-part of U.S. Ser. No. 320,910, filed Nov. 12, 1981, now abandoned, discloses producing silver images of high covering power by employing photographic elements containing forehardened high aspect ratio tabular grain silver halide emulsions.

Mignot U.S. Pat. No. 4,386,156, based on U.S. Ser. No. 320,912 filed Nov. 12, 1981, and commonly assigned, titled SILVER BROMIDE EMULSIONS OR NARROW GRAIN SIZE DISTRIBUTION AND PROCESSES FOR THEIR PREPARATION, discloses high aspect ratio tabular grain silver bromide emulsions wherein the tabular grains are square or rectangular in projected area.

Jones and Hill U.S. Ser. No. 430,092, filed concurrently herewith and commonly assigned, titled PHOTOGRAPHIC IMAGE TRANSFER FILM UNIT, which is a continuation-in-part of U.S. Ser. No. 320,911, filed Nov. 12, 1981, now abandoned, discloses image transfer film units containing tabular grain silver halide emulsions.

Wey and Wilgus U.S. Ser. No. 429,420, filed concurrently herewith and commonly assigned, titled NOVEL SILVER CHLOROBROMIDE EMULSIONS AND PROCESSES FOR THEIR PREPARATION which is a continuation-in-part of U.S. Ser. No. 320,899, filed Nov. 12, 1981, now abandoned, discloses tabular grain silver chlorobromide emulsions in which the molar ratio of chloride to bromide ranges up to 2:3.

b. Composite silver halide grains

The concept of combining halides to achieve the advantages of separate silver halides within a single silver halide grain structure has been recognized in the art and may have been used even earlier in the art without recognition.

Steigmann German Pat. No. 505,012, issued Aug. 12, 1930, teaches forming silver halide emulsions which upon development have a green tone. This is achieved by precipitating silver halide under conditions wherein potassium iodide and sodium chloride are introduced in succession. Examination of emulsions made by this process indicates that very small silver iodide grains, substantially less than 0.1 micron in mean diameter, are formed. Separate silver chloride grains are formed, and electron micrographs now suggest that silver chloride is also epitaxially deposited on the silver iodide grains. Increasing the silver iodide grain size results in a conversion of the desired green tone to a brown tone. An essentially cumulative teaching by Steigmann appears in *Photographische Industrie,* "Green- and Brown-Developing Emulsions", Vol. 34, pp. 764, 766, and 872, published July 8 and Aug. 5, 1938.

Klein et al U.K. Pat. No. 1,027,146 discloses a technique for forming composite silver halide grains. Klein et al forms silver halide core or nuclei grains and then proceeds to cover then with one or more contiguous layers of silver halide. The composite silver halide grains contain silver chloride, silver bromide, silver iodide, or mixtures thereof. For example, a core of silver bromide can be coated with a layer of silver chloride or a mixture of silver bromide and silver iodide, or a core of silver choride can have deposited thereon a layer of silver bromide. In depositing silver chloride on silver bromide Klein et al teaches obtaining the spectral response of silver bromide and the developability characteristics of silver chloride.

Beckett et al U.S. Pat. No. 3,505,068 uses the techniques taught by Klein et al to prepare a slow emulsion layer to be employed in combination with a faster emulsion layer to achieve lower contrast for a dye image. The silver halide grains employed in the slow emulsion layer have a core of silver iodide or silver haloiodide and a shell which is free of iodide composed of, for example, silver bromide, silver chloride, or silver chlorobromide.

Evans, Daubendiek, and Raleigh U.S. Ser. No. 431,012, filed concurrently herewith and commonly assigned, titled DIRECT REVERSAL EMULSIONS AND PHOTOGRAPHIC ELEMENTS USEFUL IN IMAGE TRANSFER FILM UNITS, which is a continuation-in-part of U.S. Ser. No. 320,891, filed Nov. 12, 1981, now abandoned, discloses image transfer film units containing tabular grain coreshell silver halide emulsions.

Investigation has been directed toward forming composite silver halide grains in which a second silver halide does not form a shell surrounding a first, core silver halide. Maskasky U.S. Pat. No. 4,094,684 discloses the epitaxial deposition of silver chloride onto silver iodide which is in the form of truncated bipyramids (a hexagonal structure of wurtzite type). Maskasky has disclosed that the light absorption characteristics of silver iodide and the developability characteristics of silver chloride can be both achieved by the composite grains. Maskasky U.S. Pat. No. 4,142,900 is essentially cumulative, but differs in that the silver chloride is converted after epitaxial deposition to silver bromide by conventional halide conversion techniques. Koitabashi et al U.K. patent application No. 2,053,499A is essentially cumulative with Maskasky, but directly epitaxially deposits silver bromide on silver iodide. Koitabashi et al European patent application No. 0019917 (published Dec. 10, 1980) discloses epitaxially depositing on silver halide grains containing from 15 to 40 mole percent iodide silver halide which contains less than 10 mole percent iodide.

Hammerstein et al U.S. Pat. No. 3,804,629 discloses that the stability of silver halide emulsion layers against the deleterious effect of dust, particularly metal dust, is improved by adding to physically ripened and washed emulsion before chemical ripening a silver chloride emulsion or by precipitating silver chloride onto the physically ripened and washed silver halide emulsion. Hammerstein et al discloses that silver chloride so deposited will form hillocks on previously formed silver bromide grains.

Berry and Skillman, "Surface Structures and Epitaxial Growths on AgBr Microcrystals", *Journal of Applied Physics,* Vol. 35, No. 7, July 1964, pp. 2165–2169, discloses the growth of silver chloride on silver bromide. Octahedra of silver bromide form growths all over their surface and are more reactive than cubes. Cubes react primarily at the corners and along the edges. Twinned tabular crystals form growths randomly distributed over their major crystal faces, with some preference for growths near their edges being observed. In addition, linear arrangements of growths can be produced after the emulsion coatings have been bent, indicating the influence of slip bands.

c. Speed, granularity, and sensitization

During imagewise exposure a latent image center, rendering an entire grain selectively developable, can be produced by absorption of only a few quanta of radiation, and it is this capability that imparts to silver halide photography exceptional speed capabilities as compared to many alternative imaging approaches.

A variety of chemical sensitizations, such as noble metal (e.g., gold), middle chalcogen (e.g., sulfur and/or selenium), and reduction sensitizations, have been developed which, singly and in combination, are capable of improving the sensitivity of silver halide emulsions. When chemical sensitization is extended beyond optimum levels, relatively small increases in speed are accompanied by sharp losses in image discrimination (maximum density minus minimum density) resulting from sharp increases in fog (minimum density). Optimum chemical sensitization is the best balance among speed, image discrimination, and minimum density for a specific photographic application.

Usually the sensitivity of the silver halide emulsions is only negligibly extended beyond their spectral region of intrinsic sensitivity by chemical sensitization. The sensitivity of silver halide emulsions can be extended over the entire visible spectrum and beyond by employing spectral sensitizers, typically methine dyes. Emulsion sensitivity beyond the region of intrinsic sensitivity increases as the concentration of spectral sensitizer increases up to an optimum and generally declines rapidly thereafter. (See Mees, *Theory of the Photographic Process,* Macmillan, 1942, pp. 1067–1069, for background.)

Within the range of silver halide grain sizes normally encountered in photographic elements the maximum speed obtained at optimum sensitization increases linearly with increasing grain size. The number of quanta necessary to render a grain developable is substantially independent of grain size, but the density that a given number of grains will produce on development is directly related to their size. If the aim is to produce a maximum density of 2, for example, fewer grains of 0.4 micron as compared to 0.2 micron in average diameter are required to produce that density. Less radiation is required to render fewer grains developable.

Unfortunately, because the density produced with the larger grains is concentrated at fewer sites, there are greater point-to-point fluctuations in density. The viewer's perception of point-to-point fluctuations in density is termed "graininess". The objective measurement of point-to-point fluctuations in density is termed "granularity". While quantitative measurements of granularity have taken different forms, granularity is most commonly measured as rms (root mean square) granularity, which is defined as the standard deviation of density within a viewing microaperture (e.g., 24 to 48 microns). Once the maximum permissible granularity (also commonly referred to as grain, but not to be confused with silve halide grains) for a specific emulsion layer is identified, the maximum speed which can be realized for that emulsion layer is also effectively limited.

True improvements in silver halide emulsion sensitivity allow speed to be increased without increasing granularity, granularity to be reduced without decreasing speed, or both speed and granularity to be simultaneously improved. Such sensitivity improvement is commonly and succinctly referred to in the art as improvement in the speed-granularity relationship of an emulsion.

In FIG. 1 a schematic plot of speed versus granularity is shown for five silver halide emulsions 1, 2, 3, 4, and 5 of the same composition, but differing in grain size, each similarly sensitized, identically coated, and identically processed. While the individual emulsions differ in maximum speed and granularity, there is a predictable linear relationship between the emulsions, as indicated by the speed-granularity line A. All emulsions which can be joined along the line A exhibit the same speed-granularity relationship. Emulsions which exhibit true improvements in sensitivity lie above the speed-granularity line A. For example, emulsions 6 and 7, which lie on the common speed-granularity line B, are superior in their speed-granularity relationships to any one of the emulsions 1 through 5. Emulsion 6 exhibits a higher speed than emulsion 1, but no higher granularity. Emulsion 6 exhibits the same speed as emulsion 2, but at a much lower granularity. Emulsion 7 is of higher speed than emulsion 2, but is of a lower granularity than emulsion 3, which is of lower speed than emulsion 7. Emulsion 8, which falls below the speed-granularity line A, exhibits the poorest speed-granularity relationship shown in FIG. 1. Although emulsion 8 exhibits the highest photographic speed of any of the emulsions, its speed is realized only at a disproportionate increase in granularity.

The importance of speed-granularity relationship in photography has led to extensive efforts to quantify and generalize speed-granularity determinations. It is normally a simple matter to compare precisely the speed-granularity relationships of an emulsion series differing by a single characteristic, such as silver halide grain size. The speed-granularity relationships of photographic products which produce similar characteristic curves are often compared. However, universal quantitative speed-granularity comparisons of photographic elements have not been achieved, since speed-granularity comparisons become increasingly judgmental as other photographic characteristics differ. Further, comparisons of speed-granularity relationships of photographic elements which produce silver images (e.g., black-and-white photographic elements) with those which produce dye images (e.g., color and chromogenic photographic elements) involve numerous considerations other than the silver halide grain sensitivities, since the nature and origin of the materials producing density and hence accountng for granularity are much different. (For elaboration of granularity measurements in silver and dye imaging attention is directed to "Understanding Graininess and Granularity", Kodak Publication No. F-20, Revised 11-79 (available from Eastman Kodak Company, Rochester, N.Y. 14650); Zwick, "Quantitative Studies of Factors Affecting Granularity", *Photographic Science and Engineering,* Vol. 9, No. 3, May-June, 1965; Ericson and Marchant, "RMS Granularity of Monodisperse Photographic Emulsions", *Photographic Science and Engineering,* Vol. 16, No. 4, July-August 1972, pp. 253–257; and Trabka, "A Random-Sphere Model for Dye Clouds", *Photographic Science and Engineering, Vol.* 21, No. 4, July-August 1977, pp. 183–192.)

A silver bromoiodide emulsion having outstanding silver imaging (black-and-white) speed-granularity properties is illustrated by Illingsworth U.S. Pat. No. 3,320,069, which discloses a gelatino-silver bromoiodide emulsion in which the iodide preferably comprises from 1 to 10 mole percent of the halide. The emulsion is sensitized with a sulfur, selenium, or tellurium sensitizer. The emulsion, when coated on a support at a silver coverage of between 300 and 1000 mg per square foot (0.0929 $m^2$) and exposed on an intensity scale sensitometer, and processed for 5 minutes in Kodak Developer DK-50® (an N-methyl-p-aminophenol sulfate-hydroquinone developer) at 20° C. (68° F.), has a log speed of 280–400 and a remainder (resulting from subtracting its granularity value from its log speed) of between 180 and 220. Gold is preferably employed in combination with the sulfur group sensitizer, and thiocyanate may be present during silver halide precipitation or, if desired, may be added to the silver halide at any time prior to washing. (Uses of thiocyanate during silver halide precipitation and sensitization are illustrated by Leermakers U.S. Pat. No. 2,221,805, Nietz et al U.S. Pat. No. 2,222,264, and Damschroder U.S. Pat. No. 2,642,361.) The Illingsworth emulsions also provide outstanding speed-granularity properties in color photography, although quantitiative values for dye image granularity are not provided.

Kofron et al U.S. Ser. No. 429,407, filed concurrently herewith and commonly assigned, titled SENSITIZED HIGH ASPECT RATIO SILVER HALIDE EMULSIONS AND PHOTOGRAPHIC ELEMENTS, which is a continuation-in-part of U.S. Ser. No. 320,904, filed Nov. 12, 1981, now abandoned, discloses chemically and spectrally sensitized high aspect ratio tabular grain silver halide emulsions and photographic elements incorporating these emulsions. Improvements in speed-granularity relationships and sharpness are disclosed for high aspect ratio tabular grain silver halide emulsions, regardless of halide content. Increased blue and minus blue sensitivity differences are disclosed for silver bromide and silver bromoiodide high aspect ratio tabular grains. The high aspect ratio tabular grain silver bromoiodide emulsions exhibit improved speed-granularity relationships as compared to previously known tabular grain emulsions and as compared to the best speed-granularity relationships heretofore achieved with silver bromoiodide emulsions generally.

Levy U.S. Pat. Nos. 3,656,962, 3,852,066, and 3,852,067, teach the incorporation of inorganic crystalline materials into silver halide emulsions. It is stated that the intimate physical association of the silver halide grains and the inorganic crystals can alter the sensitivity of the silver halide emulsion to light. Russell U.S. Pat. No. 3,140,179 teaches that the speed and contrast of an optically sensitized emulsion can be further increased by coating therebeneath an emulsion comprised predominantly of silver chloride and having a sufficiently low speed that no visible image is produced in it by exposure and development of the optically sensitized emulsion. Godowsky U.S. Pat. No. 3,152,907 teaches a similar advantage for blending a low speed silver chloride emulsion with an optically sensitized silver chloride or silver bromoiodide emulsion.

Haugh et al U.K. patent application No. 2,038,792A teaches the selective sensitization of cubic grains bounded by {100} crystallographic faces at the corners of the cubes. This is accomplished by first forming tetradecahedral silver bromide grains. These grains are ordinary cubic grains bounded by {100} major crystal faces, but with the corners of the cubes elided, leaving in each instance a {111} crystallographic surface adjacent the missing corner. Silver chloride is then deposited selectively onto these {111} crystallographic surfaces. The resulting grains can be selectively chemically sensitized at the silver chloride corner sites. This localization of sensitization improves photosensitivity. The composite crystals are diclosed to respond to sensitization as if they were silver chloride, but to develop, fix, and wash during photographic processing as if they were silver bromide. Haugh et al provides no teaching or suggestion of how selective site sensitization could be adapted to grains having only {111} crystallographic surfaces. Suzuki and Ueda, "The Active Sites for Chemical Sensitization of Monodisperse AgBr Emulsions", 1973, SPSE Tokyo Symposium, appears cumulative, except that very fine grain silver chloride is Ostwald ripened onto the corners of silver bromide cubes.

SUMMARY OF THE INVENTION

In one aspect this invention is directed to a tabular grain silver halide emulsion comprised of a dispersing medium and silver halide grains. At least 50 percent of the total projected area of the silver halide grains is provided by tabular silver halide grains having a thickness of less than 0.5 micron, preferably less than 0.3 micron, a diameter of at least 0.6 micron, and an average aspect ratio of greater than 8:1. The tabular silver halide grains are bounded by opposed, substantially parallel {111} major crystal faces. Silver salt is epitaxially located on and substantially confined to selected surface sites of the tabular silver halide grains.

In another aspect, this invention is directed to a photographic element comprised of a support and at least one radiation-sensitive emulsion layer comprised of a radiation-sensitive emulsion as described above.

In still another aspect, this invention is directed to producing a visible photographic image by processing in an aqueous alkaline solution in the presence of a developing agent an imagewise exposed photographic element as described above.

The present invention offers significant improvement over the prior state of the art. Specifically, the present invention constitutes one preferred approach for obtaining substantially optimally chemically and spectrally sensitizing high aspect ratio tabular grain silver halide emulsions to obtain the sensitivity advantages taught by Kofron et al, cited above. In one form of the invention extremely high sensitivities are achieved for tabular grain emulsions according to the present invention which have not been sensitized by art-recognized procedures for chemical sensitization—i.e., reduction, gold (noble metal), and/or sulfur (middle chalcogen) sensitization. The present invention can also exhibit a number of additional advantages directly attributable to the presence of epitaxially deposited silver salt, these advantages being more specifically set forth below. The emulsions of the present invention exhibit distinct photographic response advantages over conventional, non-tabular emulsions bearing epitaxially deposited salts on the grain surfaces.

The present invention also shares with Kofron et al, Abbott and Jones, and Jones and Hill, each cited above, additional significant improvements over the prior state of the art. As taught by Kofron et al sharpness of photographic images can be improved by employing emulsions according to the present invention, particularly those of large average grain diameters. When spectrally sensitized outside the blue portion of the spectrum, the emulsions of the present invention exhibit a large separation in their sensitivity in the blue region of the spectrum as compared to the region of the spectrum to which they are spectrally sensitized. Minus blue sensitized emulsions containing tabular silver bromide and silver bromoiodide host grains according to the invention are much less sensitive to blue light than to minus blue light and do not require filter protection to provide acceptable minus blue exposure records when exposed to neutral light, such as daylight at 5500° K. Very large increases in blue speed of the emulsions of the present invention when blue spectral sensitizers are employed have been realized as compared to their native blue speed.

Abbott and Jones, cited above, discloses the use of emulsions according to the present invention in radiographic elements coated on both major surfaces of a radiation transmitting support to control crossover. Comparisons of radiographic elements containing emulsions according to this invention with similar radiographic elements containing conventional emulsions show that reduced cross-over can be attributed to the emulsions of the present invention. Alternatively, comparable cross-over levels can be achieved with the emulsions of the present invention using reduced silver coverages and/or while realizing improved speed-granularity relationships.

Jones and Hill, cited above, discloses image transfer film units containing emulsions according to the present invention. The image transfer film units are capable of producing viewable images with less time elapsed after the commencement of processing. Higher contrast of transferred images can be realized with less time of development. Further, the image transfer film units are capable of producing images of improved sharpness. The emulsions of this invention permit reduction of silver coverages and more efficient use of dye image formers in image transfer film units and more advantageous layer order arrangements, elimination or reduction of yellow filter materials, and less image dependence on temperature generally.

Although the invention has been described with reference to certain specific advantages, other advantages will become apparent in the course of the detailed description of preferred embodiments.

DESCRIPTION OF PREFERRED EMBODIMENTS

Figure 1:
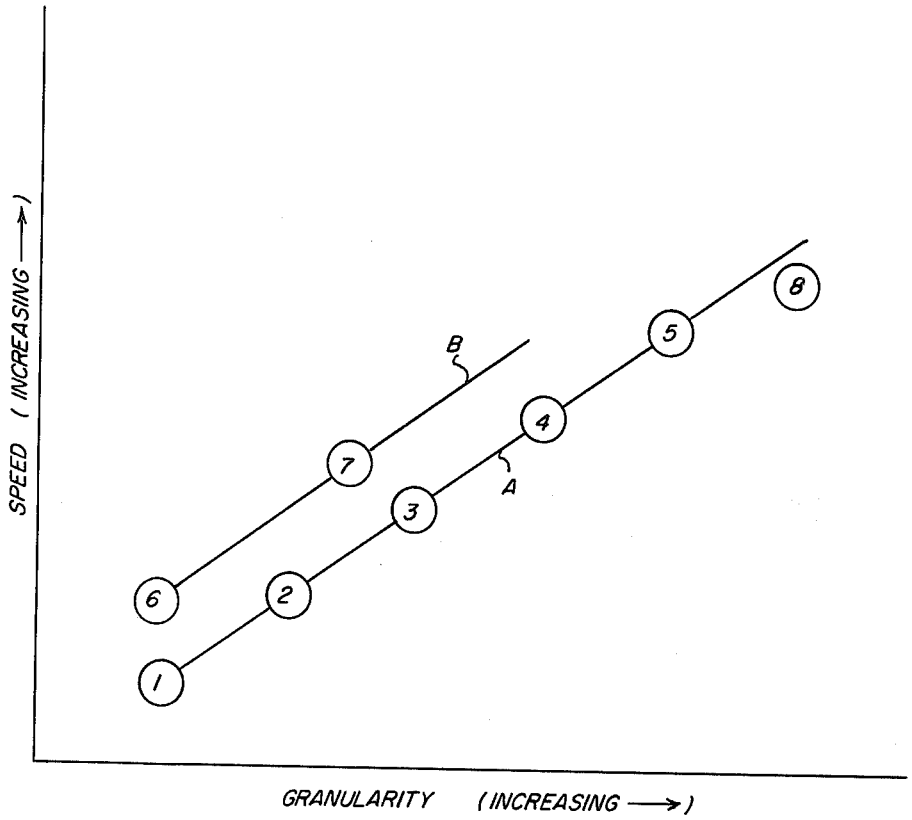
FIG. 1 is a schematic plot of speed versus granularity.

While subheadings are provided for convenience, to appreciate fully the features of the invention it is intended that the disclosure be read and interpreted as a whole.

a. Tabular grain emulsions and their preparation

This invention relates to high aspect ratio tabular grain silver halide emulsions, to photographic elements which incorporate these emulsions, and to processes for the use of the photographic elements. The tabular grains of the present invention are bounded by opposed, substantially parallel {111}. major crystal faces, which are commonly hexagonal or triangular in configuration. As applied to the silver halide emulsions of the present invention the term "high aspect ratio" is herein defined as requiring that the silver halide grains having a thickness of less than 0.3 micron and a diameter of at least 0.6 micron have an average aspect ratio of greater than 8:1 and account for at least 50 percent of the total projected area of the silver halide grains.

The preferred high aspect ratio tabular grain silver halide emulsions of the present invention are those wherein the silver halide grains having a thickness of less than 0.3 micron (optimally less than 0.2 micron) and a diameter of at least 0.6 micron have an average aspect ratio of at least 12:1 and optimally at least 20:1. In a preferred form of the invention these silver halide grains satisfying the above thickness and diameter criteria account for at least 70 percent and optimally at least 90 percent of the total projected area of the silver halide grains.

It is appreciated that the thinner the tabular grains accounting for a given percentage of the projected area, the higher the average aspect ratio of the emulsion. Typically the tabular grains have an average thickness of at least 0.03 micron, although even thinner tabular grains can in principle be employed—e.g., as low as 0.01 micron, depending on the halide present. It is recognized that the tabular grains can be increased in thickness to satisfy specialized applictions. For example, Jones and Hill, cited above, contemplates the use of tabular grains having thicknesses up to 0.5 micron, since enlargement of transferred images is not normally undertaken. Average grain thicknesses of up to 0.5 micron are also discussed below for recording blue light. (For such applications all references to 0.3 micron in reference to aspect ratio determinations should be adjusted to 0.5 micron.) However, to achieve high aspect ratios without unduly increasing grain diameters, it is normally contemplated that the tabular grains of the emulsions of this invention will have an average thickness of less than 0.3 micron. Tabular grain thicknesses as herein reported are based on host grain thicknesses and do not include any increment of thickness attributed to silver salt epitaxially deposited, more fully discussed below.

The grain characteristics described above of the silver halide emulsions of this invention can be readily ascertained by procedures well known to those skilled in the art. As employed herein the term "aspect ratio" refers to the ratio of the diameter of the grain to its thickness. The "diameter" of the grain is in turn defined as the diameter of a circle having an area equal to the projected area of the grain as viewed in a photomicrograph (or an electron micrograph) of an emulsion sample. From shadowed electron micrographs of emulsion samples it is possible to determine the thickness and diameter of each grain and to identify those tabular grains having a thickness of less than 0.3 micron and a diameter of at least 0.6 micron. From this the aspect ratio of each such tabular grain can be calculated, and the aspect ratios of all the tabular grains in the sample meeting the less than 0.3 micron thickness and at least 0.6 micron diameter criteria can be averaged to obtain their average aspect ratio. By this definition the average aspect ratio is the average of individual tabular grain aspect ratios. In practice it is usually simpler to obtain an average thickness and an average diameter of the tabular grains having a thickness of less than 0.3 micron and a diameter of at least 0.6 micron and to calculate the average aspect ratio as the ratio of these two averages. Whether the averaged individual aspect ratios or the averages of thickness and diameter are used to determine the average aspect ratio, within the tolerances of grain measurements contemplated, the average aspect ratios obtained do not significantly differ. The projected areas of the silver halide grains meeting the thickness and diameter criteria can be summed, the projected areas of the remaining silver halide grains in the photomicrograph can be summed separately, and from the two sums the percentage of the total projected area of the silver halide grains provided by the grains meeting the thickness and diameter critera can be calculated.

In the above determinations a reference tabular grain thickness of less than 0.3 micron was chosen to distinguish the uniquely thin tabular grains herein contemplated from thicker tabular grains which provide inferior photographic properties. A reference grain diameter of 0.6 micron was chosen, since at lower diameters it is not always possible to distinguish tabular and nontabular grains in micrographs. The term "projected area" is used in the same sense as the terms "projection area" and "projective area" commonly employed in the art; see, for example, James and Higgins, *Fundamentals of Photographic Theory*, Morgan and Morgan, New York, p. 15.

High aspect ratio tabular grain silver bromoiodide emulsions can be prepared by a precipitation process which forms a part of the teachings of Wilgus and Haefner, cited above and here incorporated by reference. Into a conventional reaction vessel for silver halide precipitation equipped with an efficient stirring mechanism is introduced a dispersing medium. Typically the dispersing medium initially introduced into the reaction vessel is at least about 10 percent, preferably 20 to 80 percent, by weight, based on total weight of the dispersing medium present in the silver bromoidide emulsion at the conclusion of grain precipitation. Since dispersing medium can be removed from the reaction vessel by ultrafiltration during silver bromoiodide grain precipitation, as taught by Mignot U.S. Pat. No. 4,334,012, here incorporated by reference, it is appreciated that the volume of dispersing medium initially present in the reaction vessel can equal or even exceed the volume of the silver bromoiodide emulsion present in the reaction vessel at the conclusion of grain precipitation. The dispersing medium initially introduced into the reaction vessel is preferably water or a dispersion of peptizer in water, optionally containing other ingredients, such as one or more silver halide ripening agents and/or metal dopants, more specifically described below. Where a peptizer is initially present, it is preferably employed in a concentration of at least 10 percent, most preferably at least 20 percent, of the total peptizer present at the completion of silver bromoiodide precipitation. Additional dispersing medium is added to the reaction vessel with the silver and halide salts and can also be introduced through a separate jet. It is common practice to adjust the proportion of dispersing medium, particularly to increase the proportion of peptizer, after the completion of the salt introductions.

A minor portion, typically less than 10 percent, of the bromide salt employed in forming the silver bromoiodide grains is initially present in the reaction vessel to adjust the bromide ion concentration of the dispersing medium at the outset of silver bromoiodide precipitation. Also, the dispersing medium in the reaction vessel is initially substantially free of iodide ions, since the presence of iodide ions prior to concurrent introduction of silver and bromide salts favors the formation of thick and nontabular grains. As employed herein, the term "substantially free of iodide ions" as applied to the contents of the reaction vessel means that there are insufficient iodide ions present as compared to bromide ions to precipitate as a separate silver iodide phase. It is preferred to maintain the iodide concentration in the reaction vessel prior to silver salt introduction at less than 0.5 mole percent of the total halide ion concentration present. If the pBr of the dispersing medium is initially too high, the tabular silver bromoiodide grains produced will be comparatively thick and therefore of low aspect ratios. It is contemplated to maintain the pBr of the reaction vessel initially at or below 1.6, preferably below 1.5. On the other hand, if the pBr is too low, the formation of nontabular silver bromoiodide grains is favored. Therefore, it is contemplated to maintain the pBr of the reaction vessel at or above 0.6, preferably above 1.1. (As herein employed, pBr is defined as the negative logarithm of bromide ion concentration. Both pH and pAg are similarly defined for hydrogen and silver ion concentrations, respectively.)

During precipitation silver, bromide, and iodide salts are added to the reaction vessel by techniques well known in the precipitation of silver bromoiodide grains. Typically an aqueous solution of a soluble silver salt, such as silver nitrate, is introduced into the reaction vessel concurrently with the introduction of the bromide and iodide salts. The bromide and iodide salts are also typically introduced as aqueous salt solutions, such as aqueous solutions of one or more soluble ammonium, alkali metal (e.g., sodium or potassium), or alkaline earth metal (e.g., magnesium or calcium) halide salts. The silver salt is at least initially introduced into the reaction vessel separately from the iodide salt. The iodide and bromide salts can be added to the reaction vessel separately or as a mixture.

With the introduction of silver salt into the reaction vessel the nucleation stage of grain formation is initiated. A population of grain nuclei is formed which is capable of serving as precipitation sites for silver bromide and silver iodide as the introduction of silver, bromide, and iodide salts continues. The precipitation of silver bromide and silver iodide onto existing grain nuclei constitutes the growth stage of grain formation. The aspect ratios of the tabular grains formed according to this invention are less affected by iodide and bromide concentrations during the growth stage than during the nucleation stage. It is therefore possible during the growth stage to increase the permissible latitude of pBr during concurrent introduction of silver, bromide, and iodide salts above 0.6, preferably in the range of from about 0.6 to 2.2, most preferably from about 0.8 to about 1.6. It is, of course, possible and, in fact, preferred to maintain the pBr within the reaction vessel throughout silver and halide salt introduction within the initial limits, described above prior to silver salt introduction. This is particularly preferred where a substantial rate of grain nuclei formation continues throughout the introduction of silver, bromide, and iodide salts, such as in the preparation of highly polydispersed emulsions. Raising pBr values above 2.2 during tabular grain growth results in thickening of the grains, but can be tolerated in many instances while still realizing an average aspect ratio of greater than 8:1.

As an alternative to the introduction of silver, bromide, and iodide salts as aqueous solutions, it is specifically contemplated to introduce the silver, bromide, and iodide salts, initially or in the growth stage, in the form of fine silver halide grains suspended in dispersing medium. The grain size is such that they are readily Ostwald ripened onto larger grain nuclei, if any are present, once introduced into the reaction vessel. The maximum useful grain sizes will depend on the specific conditions within the reaction vessel, such as temperature and the presence of solubilizing and ripening agents. Silver bromide, silver iodide, and/or silver bromoiodide grains can be introduced. (Since bromide and/or iodide is precipitated in preference to chloride, it is also possible to employ silver chlorobromide and silver chlorobromoiodide grains.) The silver halide grains are preferably very fine—e.g., less than 0.1 micron in mean diameter.

Subject to the pBr requirements set forth above, the concentrations and rates of silver, bromide, and iodide salt introductions can take any convenient conventional form. The silver and halide salts are preferably introduced in concentrations of from 0.1 to 5 moles per liter, although broader conventional concentration ranges, such as from 0.01 mole per liter to saturation, for example, are contemplated. Specifically preferred precipitation techniques are those which achieve shortened precipitation times by increasing the rate of silver and halide salt introduction during the run. The rate of silver and halide salt introduction can be increased either by increasing the rate at which the dispersing medium and the silver and halide salts are introduced or by increasing the concentrations of the silver and halide salts within the dispersing medium being introduced. It is specifically preferred to increase the rate of silver and halide salt introduction, but to maintain the rate of introduction below the threshold level at which the formation of new grain nuclei is favored—i.e., to avoid renucleation, as taught by Irie U.S. Pat. No. 3,650,757, Kurz U.S. Pat. No. 3,672,900, Saito U.S. Pat. No. 4,242,445, Wilgus German OLS No. 2,107,118, Teitscheid et al European Patent Application 80102242, and Wey "Growth Mechanism of AgBr Crystals in Gelatin Solution", *Photographic Science and Engineering,* Vol. 21, No. 1, January/February 1977, p. 14, et. seq. By avoiding the formation of additional grain nuclei after passing into the growth stage of precipitation, relatively monodispersed tabular silver bromoiodide grain populations can be obtained. Emulsions having coefficients of variation of less than about 30 percent can be prepared. (As employed herein the coefficient of variation is defined as 100 times the standard deviation of the grain diameters divided by the average grain diameter.) By intentionally favoring renucleation during the growth stage of precipitation, it is, of course, possible to produce polydispersed emulsions of substantially higher coefficients of variation.

The concentration of iodide in the silver bromoiodide emulsions of this invention can be controlled by the introduction of iodide salts. Any conventional iodide concentration can be employed. Even very small amounts of iodide—e.g., as low as 0.05 mole percent—are recognized in the art to be beneficial. In their preferred form the emulsions of the present invention incorporate at least about 0.1 mole percent iodide. Silver iodide can be incorporated into the tabular silver bromoiodide grains up to its solubility limit in silver bromide at the temperature of grain formation. Thus, silver iodide concentrations of up to about 40 mole percent in the tabular silver bromoiodide grains can be achieved at precipitation temperatures of 90° C. In practice precipitation temperatures can range down to near ambient room temperatures—e.g., about 30° C. It is generally preferred that precipitation be undertaken at temperatures in the range of from 40° to 80° C. For most photographic applications it is preferred to limit maximum iodide concentrations to about 20 mole percent, with optimum iodide concentrations being up to about 15 mole percent.

The relative proportion of iodide and bromide salts introduced into the reaction vessel during precipitation can be maintained in a fixed ratio to form a substantially uniform iodide profile in the tabular silver bromoiodide grains or varied to achieve differing photographic effects. Solberg et al, cited above, has recognized specific photographic advantages to result from increasing the proportion of iodide in annular regions of high aspect ratio tabular grain silver bromoiodide emulsions as compared to central regions of the tabular grains. Solberg et al teaches iodide concentrations in the central regions of from 0 to 5 mole percent, with at least one mole percent higher iodide concentrations in the laterally surrounding annular regions up to the solubility limit of silver iodide in silver bromide, preferably up to about 20 mole percent and optimally up to about 15 mole percent. Solberg et al constitutes a preferred species of the present invention and is here incorporated by reference. The tabular silver bromoiodide grains of the present invention can exhibit substantially uniform or graded iodide concentration profiles, and the gradation can be controlled, as desired, to favor higher iodide concentrations internally or, preferably, at or near the surfaces of the tabular silver bromoiodide grains.

Although the preparation of the high aspect ratio tabular grain silver bromoiodide emulsions has been described by reference to the process of Wilgus and Haefner, which produces neutral or nonammoniacal emulsions, the emulsions of the present invention and their utility are not limited by any particular process for their preparation. A process of preparing high aspect ratio tabular grain silver bromoiodide emulsions discovered subsequent to that of Wilgus and Haefner is described by Daubendiek and Strong, cited above and here incorporated by reference. Daubendiek and Strong teaches an improvement over the processes of Maternaghan, cited above, wherein the silver iodide concentration in the reaction vessel is reduced below 0.05 mole per liter and the maximum size of the silver iodide grains initially present in the reaction vessel is reduced below 0.05 micron.

High aspect ratio tabular grain silver bromide emulsions lacking iodide can be prepared by the process described by Wilgus and Haefner modified to exclude iodide. High aspect ratio tabular grain silver bromide emulsions can alternatively be prepared following a procedure similar to that employed by deCugnac and Chateau, cited above and here incorporated by reference. Still other preparations of high aspect ratio tabular grain silver bromide emulsions lacking iodide are illustrated in the examples.

To illustrate further the diversity of high aspect ratio tabular grain silver halide emulsions which can be employed in the practice of this invention, attention is directd to Wey, cited above and here incorporated by reference, which discloses a process of preparing tabular silver chloride grains which are substantially internally free of both silver bromide and silver iodide. Wey employs a double-jet precipitation process wherein chloride and silver salts are concurrently introduced into a reaction vessel containing dispersing medium in the presence of ammonia. During chloride salt introduction the pAg within the dispersing medium is in the range of from 6.5 to 10 and the pH in the range of from 8 to 10. The presence of ammonia at higher temperatures tends to cause thick grains to form, therefore precipitation temperatures are limited to up to 60° C. The process can be optimized to produce high aspect ratio tabular grain silver chloride emulsions.

Maskasky, cited above and here incorporated by reference, discloses a process of preparing tabular grains of at least 50 mole percent chloride having opposed crystal faces lying in {111} crystal planes and, in one preferred form, at least one peripheral edge lying parallel to a <211> crystallographic vector in the plane of one of the major surfaces. Such tabular grain emulsions can be prepared by reacting aqueous silver and chloride-containing halide salt solutions in the presence of a crystal habit modifying amount of an aminoazaindene and a peptizer having a thioether linkage. Maskasky specifically illustrates the formation of dodecahedral as well as hexagonal and triangular major crystal faces.

Wey and Wilgus, cited above and here incorporated by reference, discloses tabular grain emulsions wherein the silver halide grains contain silver chloride and silver bromide in at least annular grain regions and preferably throughout. The tabular grain regions containing silver chloride and bromide are formed by maintaining a molar ratio of chloride and bromide ions of from 1.6 to about 260:1 and the total concentration of halide ions in the reaction vessel in the range of from 0.10 to 0.90 normal during introduction of silver, chloride, bromide, and, optionally, iodide salts into the reaction vessel. The molar ratio of chloride to bromide in the tabular grains can range from 1:99 to 2:3.

High aspect ratio tabular grain emulsions useful in the practice of this invention can have extremely high average aspect ratios. Tabular grain average aspect ratios can be increased by increasing average grain diameters. This can produce sharpness advantages, but maximum average grain diameters are generally limited by granularity requirements for a specific photographic application. Tabular grain average aspect ratios can also or alternatively be increased by decreasing average grain thicknesses. When silver coverages are held constant, decreasing the thickness of tabular grains generally improves granularity as a direct function of increasing aspect ratio. Hence the maximum average aspect ratios of the tabular grain emulsions of this invention are a function of the maximum average grain diameters acceptable for the specific photographic application and the minimum attainable tabular grain thicknesses which can be produced. Maximum average aspect ratios have been observed to vary, depending upon the precipitation technique employed and the tabular grain halide composition. The highest observed average aspect ratios, 500:1, for tabular grains with photographically useful average grain diameters, have been achieved by Ostwald ripening preparations of silver bromide grains, with aspect ratios of 100:1, 200:1, or even higher being obtainable by double-jet precipitation procedures. The presence of iodide generally decreases the maximum average aspect ratios realized, but the preparation of silver bromoiodide tabular grain emulsions having average aspect ratios of 100:1 or even 200:1 or more is feasible. Average aspect ratios as high as 50:1 or even 100:1 for silver chloride tabular grains, optionally containing bromode and/or iodide, can be prepared as taught by Maskasky, cited above.

Modifying compounds can be present during tabular grain precipitation. Such compounds can be initially in the reaction vessel or can be added along with one or more of the salts according to conventional procedures. Modifying compounds, such as compounds of copper, thallium, lead, bismuth, cadmium, zinc, middle chalcogens (i.e., sulfur, selenium, and tellurium), gold, and Group VIII noble metals, can be present during silver halide precipitation, as illustrated by Arnold et al U.S. Pat. No. 1,195,432, Hochstetter U.S. Pat. No. 1,951,933, Trivelli et al U.S. Pat. No. 2,448,060, Overman U.S. Pat. No. 2,628,167, Mueller et al U.S. Pat. No. 2,950,972, Sidebotham U.S. Pat. No. 3,488,709, Rosecrants et al U.S. Pat. No. 3,737,313, Berry et al U.S. Pat. No. 3,772,031, Atwell U.S. Pat. No. 4,269,927, and *Research Disclosure,* Vol. 134, June 1975, Item 13452. *Research Disclosure* and its predecessor, *Product Licensing Index*, are publications of Industrial Opportunities Ltd.; Homewell, Havant; Hampshire, P09 1EF, United Kingdom. The tabular grain emulsions can be internally reduction sensitized during precipitation, as illustrated by Moisar et al, *Journal of Photographic Science*, Vol. 25, 1977, pp. 19–27.

The individual silver and halide salts can be added to the reaction vessel through surface or subsurface delivery tubes by gravity feed or by delivery apparatus for maintaining control of the rate of delivery and the pH, pBr, and/or pAg of the reaction vessel contents, as illustrated by Culhane et al U.S. Pat. No. 3,821,002, Oliver U.S. Pat. No. 3,031,304 and Claes et al, *Photographische Korrespondenz*, Band 102, Number 10, 1967, p. 162. In order to obtain rapid distribution of the reactants within the reaction vessel, specially constructed mixing devices can be employed, as illustrated by Audran U.S. Pat. No. 2,996,287, McCrossen et al U.S. Pat. No. 3,342,605, Frame et al U.S. Pat. No. 3,415,650, Porter et al U.S. Pat. No. 3,785,777, Finnicum et al U.S. Pat. No. 4,147,551, Verhille et al U.S. Pat. No. 4,171,224, Calamur U.K. Patent Application No. 2,022,431A, Saito et al German OLS No. 2,555,364 and 2,556,885, and *Research Disclosure*, Volume 166, February 1978, Item 16662.

In forming the tabular grain emulsions a dispersing medium is initially contained in the reaction vessel. In a preferred form the dispersing medium is comprised of an aqueous peptizer suspension. Peptizer concentrations of from 0.2 to about 10 percent by weight, based on the total weight of emulsion components in the reaction vessel, can be employed. It is common practice to maintain the concentration of the peptizer in the reaction vessel in the range of below about 6 percent, based on the total weight, prior to and during silver halide formation and to adjust the emulsion vehicle concentration upwardly for optimum coating characteristics by delayed, supplemental vehicle additions. It is contemplated that the emulsion as initially formed will contain from about 5 to 50 grams of peptizer per mole of silver halide, preferably about 10 to 30 grams of peptizer per mole of silver halide. Additional vehicle can be added later to bring the concentration up to as high as 1000 grams per mole of silver halide. Preferably the concentration of vehicle in the finished emulsion is above 50 grams per mole of silver halide. When coated and dried in forming a photographic element the vehicle preferably forms about 30 to 70 percent by weight of the emulsion layer.

Vehicles (which include both binders and peptizers) can be chosen from among those conventionally employed in silver halide emulsions. Preferred peptizers are hydrophilic colloids, which can be employed alone or in combination with hydrophobic materials. Suitable hydrophilic materials include both naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, agar-agar, arrowroot, albumin and the like as described in Yutzy et al U.S. Pat. Nos. 2,614,928 and '929, Lowe et al U.S. Pat. Nos. 2,691,582, 2,614,930, '931, 2,327,808 and 2,448,534, Gates et al U.S. Pat. Nos. 2,787,545 and 2,956,880, Himmelmann et al U.S. Pat. No. 3,061,436, Farrell et al U.S. Pat. No. 2,816,027, Ryan U.S. Pat. Nos. 3,132,945, 3,138,461 and 3,186,846, Dersch et al U.K. Pat. No. 1,167,159 and U.S. Pat. Nos. 2,960,405 and 3,436,220, Geary U.S. Pat. No. 3,486,896, Gazzard U.K. Pat. No. 793,549, Gates et al U.S. Pat. Nos. 2,992,213, 3,157,506, 3,184,312 and 3,539,353, Miller et al U.S. Pat. No. 3,227,571, Boyer et al U.S. Pat. No. 3,532,502, Malan U.S. Pat. No. 3,551,151, Lohmer et al U.S. Pat. No. 4,018,609, Luciani et al U.K. Pat. No. 1,186,790, Hori et al U.K. Pat. No. 1,489,080 and Belgian Patent No. 856,631, U.K. Pat. No. 1,490,644, U.K. Pat. No. 1,483,551, Arase et al U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al U.S. Pat. No. 2,725,293, Hilborn U.S. Pat. No. 2,748,022, DePauw et al U.S. Pat. No. 2,956,883, Ritchie U.K. Pat. No. 2,095, DeStubner U.S. Pat. No. 1,752,069, Sheppard et al U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al U.S. Pat. No. 3,923,517.

Other materials commonly employed in combination with hydrophilic colloid peptizers as vehicles (including vehicle extenders—e.g., materials in the form of latices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al U.S. Pat. Nos. 3,679,425, 3,706,564 and 3,813,251, Lowe U.S. Pat. Nos. 2,253,078, 2,276,322, '323, 2,281,703, 2,311,058 and 2,414,207, Lowe et al U.S. Pat. Nos. 2,484,456, 2,541,474 and 2,632,704, Perry et al U.S. Pat. No. 3,425,836, Smith et al U.S. Pat. Nos. 3,415,653 and 3,615,624, Smith U.S. Pat. No. 3,488,708, Whiteley et al U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al U.S. Pat. No. 3,879,205, Nottorf U.S. Pat. No. 3,142,568, Houck et al U.S. Pat. Nos. 3,062,674 and 3,220,844, Dann et al U.S. Pat. No. 2,882,161, Schupp U.S. Pat. No. 2,579,016, Weaver U.S. Pat. No. 2,829,053, Alles et al U.S. Pat. No. 2,698,240, Priest et al U.S. Pat. No. 3,003,879, Merrill et al U.S. Pat. No. 3,419,397, Stonham U.S. Pat. No. 3,284,207, Lohmer et al U.S. Pat. No. 3,167,430, Williams U.S. Pat. No. 2,957,767, Dawson et al U.S. Pat. No. 2,893,867, Smith et al U.S. Pat. Nos. 2,860,986 and 2,904,539, Ponticello et al U.S. Pat. Nos. 3,929,482 and 3,860,428, Ponticello U.S. Pat. No. 3,939,130, Dykstra U.S. Pat. No. 3,411,911 and Dykstra et al Canadian Patent No. 774,054, Ream et al U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No 2,495,918, Graves U.S. Pat. No. 2,289,775, Yackel U.S. Pat. No. 2,565,418, Unruh et al U.S. Pat. Nos. 2,865,893 and 2,875,059, Rees et al U.S. Pat. No. 3,536,491, Broadhead et al U.K. Pat. No. 1,348,815, Taylor et al U.S. Pat. No. 3,479,186, Merrill et al U.S. Pat. No. 3,520,857, Bacon et al U.S. Pat. No. 3,690,888, Bowman U.S. Pat. No. 3,748,143, Dickinson et al U.K. Pat. Nos. 808,227 and '228, Wood U.K. Pat. No. 822,192 and Iguchi et al U.K. Pat. No. 1,398,055. The additional materials need not be present in the reaction vessel during silver halide precipitation, but rather are conventionally added to the emulsion prior to coating. The vehicle materials, including particularly the hydrophilic colloids, as well as the hydrophobic materials useful in combination therewith can be employed not only in the emulsion layers of the photographic elements of this invention, but also in other layers, such as overcoat layers, interlayers and layers positioned beneath the emulsion layers.

It is specifically contemplated that grain ripening can occur during the preparation of silver halide emulsions according to the present invention, and it is preferred that grain ripening occur within the reaction vessel during at least silver bromoiodide grain formation. Known silver halide solvents are useful in promoting ripening. For example, an excess of bromide ions, when present in the reaction vessel, is known to promote ripening. It is therefore apparent that the bromide salt solution run into the reaction vessel can itself promote ripening. Other ripening agents can also be employed and can be entirely contained within the dispersing medium in the reaction vessel before silver and halide salt addition, or they can be introduced into the reaction vessel along with one or more of the halide salt, silver salt, or peptizer. In still another variant the ripening agent can be introduced independently during halide and silver salt additions. Although ammonia is known ripening agent, it is not a preferred ripening agent for the emulsions of this invention exhibiting the highest realized speed-granularity relationships.

Among preferred ripening agents are those containing sulfur. Thiocyanate salts can be used, such as alkali metal, most commonly sodium and potassium, and ammonium thiocyanate salts. While any conventional quantity of the thiocyanate salts can be introduced, preferred concentrations are generally from about 0.1 to 20 grams of thiocyanate salt per mole of silver halide. Illustrative prior teachings of employing thiocyanate ripening agents are found in Nietz et al, U.S. Pat. No. 2,222,264, cited above; Lowe et al U.S. Pat. No. 2,448,534 and Illingsworth U.S. Pat. No. 3,320,069; the disclosures of which are here incorporated by reference. Alternatively, conventional thioether ripening agents, such as those disclosed in McBride U.S. Pat. No. 3,271,157, Jones U.S. Pat. No. 3,574,628, and Rosecrants et al U.S. Pat. No. 3,737,313, here incorporated by reference, can be employed.

The high aspect ratio tabular grain emulsions of the present invention are preferably washed to remove soluble salts. The soluble salts can be removed by decantation, filtration, and/or chill setting and leaching, as illustrated by Craft U.S. Pat. No. 2,316,845 and McFall et al U.S. Pat. No. 3,396,027; by coagulation washing as illustrated by Hewitson et al U.S. Pat. No. 2,618,556, Yutzy et al U.S. Pat. No. 2,614,928, Yackel U.S. Pat. No. 2,565,418, Hart et al U.S. Pat. No. 3,241,969, Waller et al U.S. Pat. No. 2,489,341, Klinger U.K. Pat. No. 1,305,409 and Dersch et al U.K. Pat. No. 1,167,159; by centrifugation and decantation of a coagulated emulsion, as illustrated by Murray U.S. Pat. No. 2,463,794, Ujihara et al U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al *Soviet Chemical Industry*, Vol. 6, No. 3, 1974, pp. 181–185; by diafiltration with a semipermeable membrane, as illustrated by *Research Disclosure*, Vol. 102, October 1972, Item 10208, Hagemaier et al *Research Disclosure*, Vol. 131, March 1975, Item 13122, Bonnet *Research Disclosure*, Vol. 135, July 1975, Item 13577, Berg et al German OLS No. 2,436,461, Bolton U.S. Pat. No. 2,495,918, Mignot U.S. Pat. No. 4,334,012, cited above, or by employing an ion exchange resin, as illustrated by Maley U.S. Pat. No. 3,782,953 and Noble U.S. Pat. No. 2,827,428. The emulsions, with or without sensitizers, can be dried and stored prior to use as illustrated by *Research Disclosure*, Vol. 101, September 1972, Item 10152. In the present invention washing is particularly advantageous in terminating ripening of the tabular grains after the completion of precipitation to avoid increasing their thickness and reducing their aspect ratio.

Although the procedures for preparing tabular silver halide grains described above will produce high aspect ratio tabular grain emulsions in which the tabular grains account for at least 50 percent of the total projected area of the total silver halide grain population, it is recognized that further advantages can be realized by increasing the proportion of such tabular grains present. Preferably at least 70 percent (optimally at least 90 percent) of the total projected area is provided by tabular silver halide grains. While minor amounts of nontabular grains are fully compatible with many photographic applications, to achieve the full advantages of tabular grains the proportion of tabular grains can be increased. Larger tabular silver halide grains can be mechanically separated from smaller, nontabular grains in a mixed population of grains using conventional separation technique—e.g., by using a centrifuge or hydrocyclone. An illustrative teaching of hydrocyclone separation is provided by Audran et al U.S. Pat. No. 3,326,641.

b. Controlled site epitaxy and sensitization

It is a unique feature of the present invention that the tabular grains meeting the thickness and diameter criteria identified above for determining aspect ratio bear at least one silver salt epitaxially grown thereon. That is, the silver salt is in a crystalline form having its orientation controlled by the tabular silver halide grain forming the crystal substrate on which it is grown. Further, the silver salt epitaxy is substantially confined to selected surface sites. The silver salt epitaxy can in varied forms of the invention be substantially confined to a central region of each major crystal face of the tabular grains, an annular region of each major crystal face, and/or a peripheral region at the edges of the major crystal faces. In still another, preferred form the silver salt epitaxy can be substantially confined to regions lying at or near the corners of the tabular grains. Combinations of the above are also contemplated. For example, epitaxy confined to a central region of the tabular grains is contemplated in combination with epitaxy at the corners or along the edges of the tabular grains. A common feature of each of these embodiments is that by confining the silver salt epitaxy to the selected sites it is substantially excluded in a controlled manner from at least a portion of the {111} major crystal faces of the tabular silver halide grains.

It has been discovered quite surprisingly that by confining epitaxial deposition to selected sites on the tabular grains an improvement in sensitivity can be achieved as compared to allowing the silver salt to be epitaxially deposited randomly over the major faces of the tabular grains, as observed by Berry and Skillman, cited above. The degree to which the silver salt is confined to selected sensitization sites, leaving at least a portion of the major crystal faces substantially free of epitaxially deposited silver salt, can be varied widely without departing from the invention. In general, larger increases in sensitivity are realized as the epitaxial coverage of the major crystal faces decreases. It is specifically contemplated to confine epitaxially deposited silver salt to less than half the area of the major crystal faces of the tabular grains, preferably less than 25 percent, and in certain forms, such as corner epitaxial silver salt deposits, optimally to less than 10 or even 5 percent of the area of the major crystal faces of the tabular grains. In some embodiments epitaxial deposition has been observed to commence on the edge surfaces of the tabular grains. Thus, where epitaxy is limited, it may be otherwise confined to selected edge sensitization sites and effectively excluded from the major crystal faces.

The epitaxially deposited silver salt can be used to provide sensitization sites on the tabular silver halide host grains. By controlling the sites of epitaxial deposition, it is possible to achieve selective site sensitization of the tabular host grains. Sensitization can be achieved at one or more ordered sites on the tabular silver halide grains. By ordered it is meant that the sensitization sites bear a predictable, nonrandom relationship to the major crystal faces of the tabular grains and, preferably, to each other. By controlling epitaxial deposition with respect to the major crystal faces of the tabular grains it is possible to control both the number and lateral spacing of sensitization sites.

In some instances selective site sensitization can be detected when the silver halide grains are exposed to radiation to which they are sensitive and surface latent image centers are produced at sensitization sites. If the grains bearing latent image centers are entirely developed, the location and number of the latent image centers cannot be determined. However, if development is arrested before development has spread beyond the immediate vicinity of the latent image center, and the partially developed grain is then viewed under magnification, the partial development sites are clearly visible. They correspond generally to the sites of the latent image centers which in turn generally correspond to the sites of sensitization.

Figure 2:
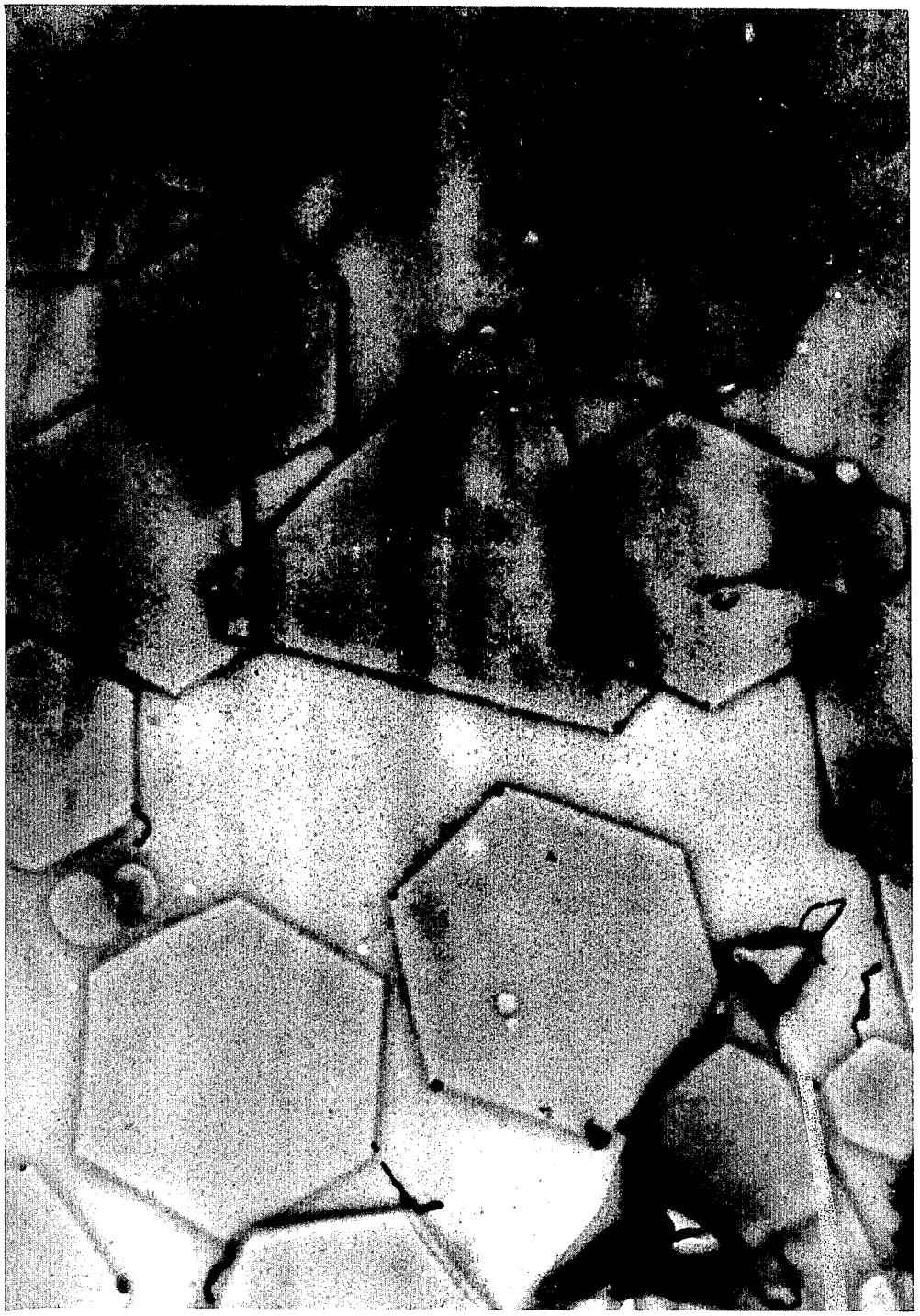
FIGS. 2, 3, and 5 through 26 are electron micrographs of emulsion samples.

This is illustrated by FIG. 2, which is a photomicrograph of a partially developed tabular grain sensitized according the present invention. The black spots in the photomicrograph are developed silver. Although the silver extends out laterally beyond the grains in an irregular way, it is to be noted that the point of contact between the silver and the tabular grains is ordered. That is, the point of contact is in a predetermined relationship to the corners of the grains. This effectively spaces the points of contact from each other and limits the number of points of contact for each individual grain.

Figure 3:
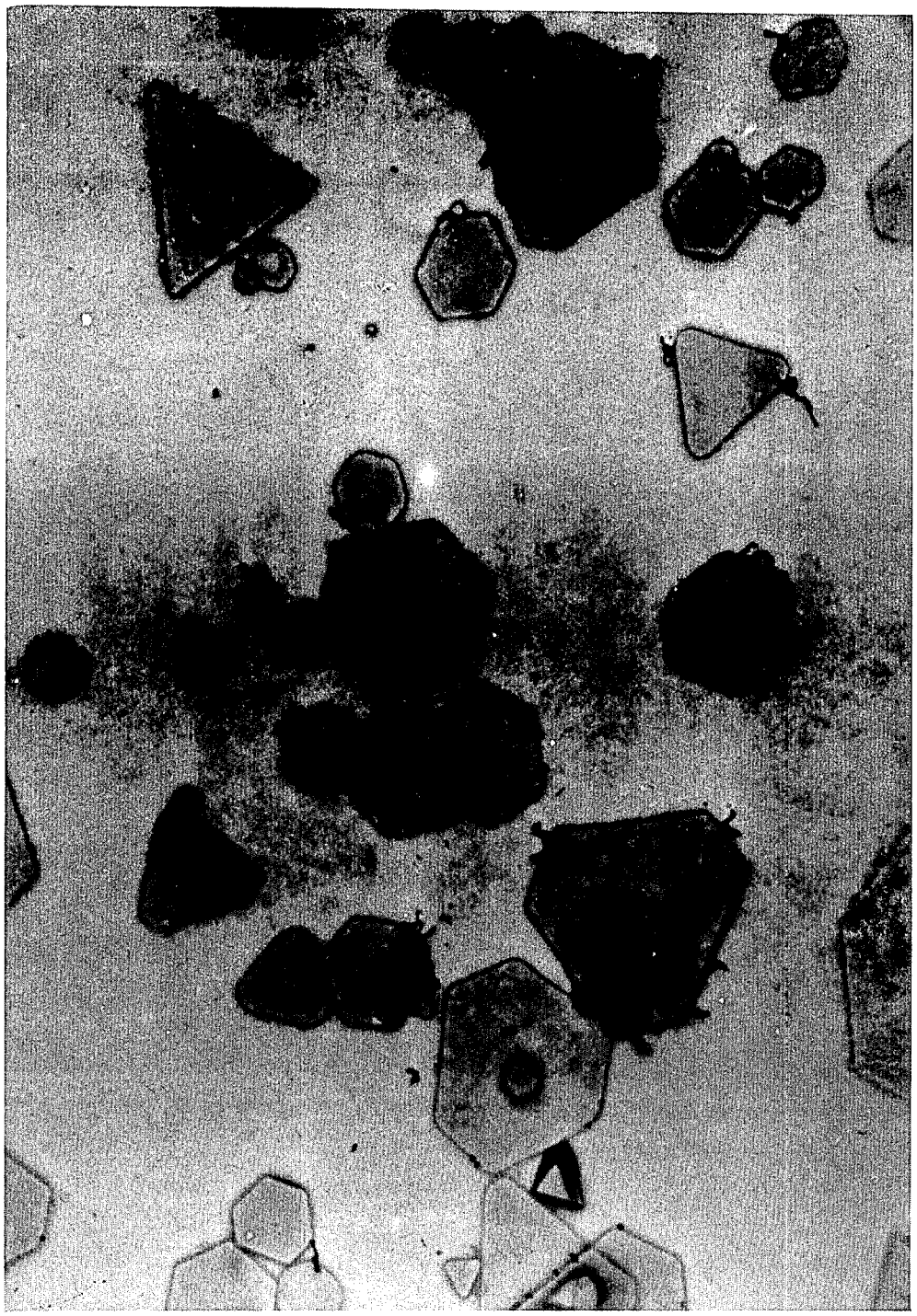

To contrast the ordered relationship of the sensitization sites in FIG. 2, attention is directed to FIG. 3, which illustrates a high aspect ratio tabular grain emulsion which is not sensitized according to this invention. Note that the black spots, indicating silver development, are more or less randomly distributed among the grains. In many occurrences points of contact of developed silver with a grain edge lie very close together. In FIG. 3 the ordered relationship between the sensitization sites and the grain major crystal faces is not observed.

Although in certain preferred emulsions, such as illustrated in FIG. 2, it is possible to demonstrate by arrested development the ordered nature of the sensitization sites, this is not possible in all instances. For example, if the latent images from internally rather than at or near the grain surface, it is difficult to demonstrate the latent image sites by partial grain development, as dissolution of the grain occurs concurrently with development. In other instances the sensitization sites, though themselves ordered in relation to the grain geometry do not result in latent image sites being formed in any clearly ordered manner. For example, where the ordered sensitization sites act as hole traps, they capture photogenerated holes and sensitize the grains by preventing annihilation of photogenerated electrons. However, the photogenerated electrons remain free to migrate and can form latent images at any propitious location in or on the grain. Thus, sensitization at discrete, ordered sites according to this invention can be independent of whether latent images are produced at ordered or random sites on the grains.

In many instances selective site sensitization according to the present invention at discrete ordered sites can be detected from electron micrographs without undertaking partial grain development. For instance, referring back to FIG. 2, epitaxially deposited silver halide employed to provide selective site sensitization is clearly visible at the corners of the tabular grains. The discrete, ordered silver salt epitaxy positioned at the corners of the tabular grains is in the emulsion of FIG. 2 acting to provide selective site sensitization according to this invention. Where epitaxial deposition is limited, it may not be possible to confirm selective site sensitization directly from viewing electron micrographs of grain samples, but rather some knowledge of the preparation of the emulsions may be required.

In one preferred embodiment of the present invention a high aspect ratio tabular grain silver bromoiodide emulsion prepared as taught by Wilgus and Haefner or Daubendiek and Strong is chemically sensitized at ordered grain sites. The tabular silver bromoiodide grains have {111} major crystal faces. An aggregating spectral sensitizing dye is first adsorbed to the surfaces of the tabular grains by conventional spectral sensitizing techniques. Sufficient dye is employed to provide a monomolecular adsorbed coverage of at least about 15 percent and preferably at least 70 percent of the total grain surface. Although dye concentrations are conveniently calculated in terms of monomolecular coverages, it is recognized that the dye does not necessarily distribute itself uniformly on the grain surfaces. (More dye can be introduced than can be adsorbed to the grain surface, if desired, but this is not preferred, since the excess dye does not further improve perforance.) The aggregated dye is employed at this stage of sensitization not for its spectral sensitizing properties, but for its ability to direct epitaxial deposition of silver chloride onto the high aspect ratio silver bromoiodide tabular grains. Thus, any other adsorbable species capable of directing epitaxial deposition and capable of being later displaced by spectral sensitizing dye can be employed. Since the aggregated dye performs both the functions of directing epitaxial deposition and spectral sensitization and does not require removal once positioned, it is clearly the preferred material for directing epitaxial deposition.

Once the aggregated dye is adsorbed to the surfaces of the silver bromoiodide grains, deposition of silver chloride can be undertaken by conventional techniques of precipitation or Ostwald ripening. The epitaxial silver chloride does not form a shell over the silver bromoiodide grains nor does it deposit randomly. Rather it is deposited selectively in an ordered manner adjacent the corners of the tabular grains. Generally the slower the rate of epitaxial deposition the fewer the sites at which epitaxial deposition occurs. Thus, epitaxial deposition can, if desired, be confined to less than all the corners. In a variant form the silver chloride can form a peripheral ring at the edges of the major crystal faces, although the ring may be incomplete if the quantity of silver chloride available for deposition is limited. The epitaxial silver chloride can itself act to increase markedly the sensitivity of the resulting composite grain emulsion without the use of additional chemical sensitization.

In the foregoing specific preferred embodiment of the invention the tabular grains are silver bromoiodide grains while silver chloride is epitaxially deposited onto the grains at ordered sites. However, it is specifically contemplated that the tabular grains and the silver salt sensitizer can take a variety of forms. The host tabular grains can be of any conventional silver halide composition known to be useful in photography and capable of forming a high aspect ratio tabular grain emulsion. As fully described above, high aspect ratio tabular grain emulsions of a variety of silver halide compositions are known from which to choose. Thus, in place of silver bromoiodide the high aspect ratio tabular grain emulsion to be sensitized can contain tabular silver bromide, silver chlorobromide, silver bromochloride, or silver chloride grains, optionally including minor amounts of iodide. The useful proportions of the various halides are set forth above.

The sensitizing silver salt that is deposited onto the host tabular grains at selected sites can be generally chosen from among any silver salt capable of being epitaxially grown on a silver halide grain and heretofore known to be useful in photography. The anion content of the silver salt and the tabular silver halide grains differ sufficiently to permit differences in the respective crystal structures to be detected. (Surprisingly, nontabular corner and edge growths have been observed when deposition onto the tabular host grains occurs in the presence of an adsorbed site director even when the tabular grain and corner or edge deposit are of the same silver halide composition.) Whether the anion content of the silver salt and the tabular silver halide grains differ or are identical, incorporated modifiers can be present in either or both. It is specifically contemplated to choose the silver salts from among those heretofore known to be useful in forming shells for core-shell silver halide emulsions. In addition to all the known photographically useful silver halides, the silver salts can include other silver salts known to be capable of precipitating onto silver halide grains, such as silver thiocyanate, silver phosphate, silver cyanide, silver carbonate, and the like. Depending upon the silver salt chosen and the intended application, the silver salt can usefully be deposited in the presence of any of the modifying compounds described above in connection with the tabular silver halide grains. Some of the silver halide forming the host tabular grains usually enters solution during epitaxial deposition and is incorporated in the silver salt epitaxy. For example a silver chloride deposit on a silver bromide host grain will usually contain a minor proportion of bromide ion. Thus, reference to a particular silver salt as being epitaxially located on a host tabular grain is not intended to exclude the presence of some silver halide of a composition also present in the host tabular grain, unless otherwise indicated.

It is generally preferred as a matter of convenience that the silver salt exhibit a higher solubility than the silver halide of the host tabular grain. This reduces any tendency toward dissolution of the tabular grain while the silver salt is being deposited. This avoids restricting sensitization to just those conditions which minimize tabular grain dissolution, as would be required, for example, if deposition of a less soluble silver salt onto a tabular grain formed of a more soluble silver halide is undertaken. Since silver bromoiodide is less soluble than silver bromide, silver chloride, or silver thiocyanate and can readily serve as a host for deposition of each of these salts, it is preferred that the host tabular grains consist essentially of silver bromodiode. Conversely, silver chloride, being more soluble than either silver bromoiodide or silver bromide, can be readily epitaxially deposited on tabular grains of either of these halide compositions and is a preferred silver salt for selective site sensitization. Silver thiocyanate, which is less soluble than silver chloride, but much more soluble than silver bromide or silver bromoiodide, can be substituted for silver chloride, in most instances. However, to achieve maximum stability silver chloride is generally preferred over silver thiocyanate. Epitaxial deposition of less soluble silver salts onto more soluble nontabular silver halide host grains has been reported in the art, and this can be undertaken in the practice of this invention. For instance the epitaxial deposition of silver bromoiodide onto silver bromide or the deposition of silver bromide or thiocyanate onto silver chloride is specifically contemplated. Multilevel epitaxy—that is, silver salt epitaxy located on a differing silver salt which is itself epitaxially deposited onto the host tabular grain—is specifically contemplated. For example, it is possible to epitaxially grow silver thiocyanate onto silver chloride which is in turn epitaxially grown on a silver bromoiodide or silver bromide host grain.

Controlled site epitaxy can be achieved over a wide range of epitaxially deposited silver salt concentrations. Incremental sensitivity can be achieved with silver salt concentration as low as about 0.05 mole percent, based on total silver present in the composite sensitized grains. On the other hand, maximum levels of sensitivity are achieved with silver salt concentrations of less than 50 mole percent. Generally epitaxially deposited silver salt concentrations of from 0.3 to 25 mole percent are preferred, with concentrations of from about 0.5 to 10 mole percent being generally optimum for sensitization.

Depending upon the silver salt to be employed and the halide content of the tabular grains presenting {111} major crystal faces, adsorbed site directors, such as aggregated dye, can be eliminated and still achieve controlled site epitaxy. When the host tabular grain at its surface consists essentially of at least 8 mole percent iodide (preferably at least 12 mole percent iodide), silver chloride epitaxially deposits selectively adjacent the corners of the host tabular grains in the absence of adsorbed site director. Surprisingly, similar results can be achieved when tabular silver bromide or bromoiodide grains are contacted with aqueous iodide salts to incorporate as little as 0.1 mole percent iodide in the tabular silver bromide grains prior to epitaxial deposition of the silver chloride. Silver thiocyanate can be selectively epitaxially located at the edges of tabular silver halide grains of any of the compositions herein disclosed in the absence of an adsorbed site director. Although the use of an adsorbed site director is not required for these combinations of host tabular grain and silver salt sensitizer, the use of an adsorbed site director is often preferred to confine the epitaxial deposit more narrowly at the corner or edge sites.

Solberg et al, cited above, discloses high aspect ratio tabular grain emulsions in which the tabular silver bromoiodide grains contain lower concentrations of iodide in a central region than in a laterally surrounding annular region. If the laterally surrounding annular region exhibits a surface iodide concentration of at least 8 mole percent (preferably at least 12 mole percent) while the central region contains less than 5 mole percent iodide, as taught by Solberg et al, it is possible to confine sensitization of the tabular silver bromoiodide grains to a central region of the grain without the use of an adsorbed site director. Or, stated another way, the iodide at the surface of the annular grain region is itself acting as a site director for selective epitaxial deposition at the central grain region. Sensitization can be restricted in area merely by restricting the size of the central grain region as compared to the laterally surrounding annular grain region. One distinct advantage for this approach to selective site sensitization is the central location of the sensitization sites. This decreases the diffusion path required of the photogenerated electrons or holes to reach the sensitization sites. Thus, holes and electrons can be trapped more efficiently with less risk of annihilation. Where the sensitization sites serve to locate the latent image, reducing the number of sensitization sites reduces competition for photogenerated electrons. This approach to selective site sensitization is useful with epitaxially deposited silver chloride.

In another variant form of the invention not requiring the use of an adsorbed site director a tabular grain silver bromoiodide emulsion as described by Solberg et al, cited above, is employed. The tabular silver bromoiodide grains are chosen to have a central region low in iodide which is itself an annular region. That is, the tabular grains contain a most central region of silver bromoiodide, a laterally surrounding central region which contains less iodide, and a laterally surrounding peripheral annular region. Similarly as described above, the annular central region contains less than 5 mole percent iodide while the most central region and the annular peripheral region each contain at least 8 mole percent (preferably at least 12 mole percent) iodide. Silver chloride is epitaxially deposited on and substantially confined to the portions of the major crystal faces of the tabular grains defined by the annular central region. By controlling the extent of the central annular region the extent of epitaxial deposition on the major faces of the tabular grains is correspondingly controlled. Of course, if the amount of silver chloride epitaxially deposited is limited, the epitaxy may not occupy all of the permissible deposition surface area offered by the annular central region. Silver chloride can be limited to a few discrete sites within the annular central region, if desired. In the absence of a central region of lower iodide content silver chloride would be directed instead to the corners of the tabular silver bromoiodide grains for epitaxial deposition. It is surprizing that silver chloride is preferentially deposited at the central region. If the rate of silver chloride deposition is sufficiently accelerated, it should be possible to deposit silver chloride both at the central region and at the periphery of the tabular grains.

Depending upon the composition of the silver salt epitaxy and the tabular silver halide host grains, the silver salt can sensitize either by acting as a hole trap or an electron trap. In the latter instance the silver salt epitaxy also locates the latent image sites formed on imagewise exposure. Modifying compounds present during epitaxial deposition of silver salt, such as compounds of copper, thallium, lead, bismuth, cadmium, zinc, middle chalcogens (i.e., sulfur, selenium, and tellurium), gold and Group VIII noble metals, are particularly useful in enhancing sensitization. The presence of electron trapping metal ions in the silver salt epitaxy is useful in favoring the formation of internal latent images. For example, a particularly preferred embodiment of the present invention is to deposit silver chloride in the center of a relatively high iodide silver bromoiodide tabular grain as described above in the presence of a modifying compound favoring electron trapping, such as a lead or iridium compound. Upon imagewise exposure internal latent image sites are formed in the tabular grains at the doped silver chloride epitaxy sensitization sites.

Another approach for favoring the formation of an internal latent image associated with the epitaxially deposited silver salt is to undertake halide conversion after epitaxial deposition of the silver salt. For example, where the epitaxially deposited salt is silver chloride, it can be modified by contact with a halide of lower solubility, such as a bromide salt or a mixture of bromide and iodide salts. This results in the substitution of bromide and iodide ions, if present, for chloride ions in the epitaxial deposit. Resulting crystal imperfections are believed to account for internal latent image formation. Halide conversion of epitaxial salt deposits is taught by Maskasky, U.S. Pat. No. 4,142,900, cited above and here incorporated by reference.

In various embodiments of the invention described above the silver salt epitaxy can either be confined to discrete sites on the tabular host grains, such as the center or the corners, or form a ring, such as a peripheral ring at the edge of the major crystal faces. Where the silver salt epitaxy functions as an electron trap and therefore also locates the latent image sites on the grains, it is preferred to confine the epitaxy to discrete grain sites, such as the center of the major crystal faces or adjacent the corners of the tabular host grains. In this instance the opportunity for latent image sites to form close together and thereby compete for photogenerated electrons is reduced as compared to allowing latent image sites to form along the edges of the tabular grains, as can occur when they are ringed with silver salt epitaxy.

Since silver salt epitaxy on the tabular host grains can act either as an electron trap or as a hole trap, it is appreciated that silver salt epitaxy acting as a hole trap in combination with silver salt epitaxy acting as an electron trap forms a complementary sensitizing combination. For example, it is specifically contemplated to sensitize tabular host grains selectively at or near their center with electron trapping silver salt epitaxy. Thereafter, hole trapping silver salt epitaxy can be selectively deposited at the corners of the grains. In this instance a latent image is formed centrally at the electron trapping epitaxy site while the corner epitaxy further enhances sensitivity by trapping photogenerated holes that would otherwise be available for annihilation of photogenerated electrons. In a specific illustrative form silver chloride is epitaxially deposited on a silver bromoiodide tabular grain containing a central region of less than 5 mole percent iodide with the remainder of the major crystal faces containing at least 8 mole (preferably 12 mole) percent iodide, as described above. The silver chloride is epitaxially deposited in the presence of a modifying compound favoring electron trapping, such a compound providing a lead or iridium dopant. Thereafter hole trapping silver salt epitaxy can be selectively deposited at the corners of the host tabular grains or as a ring along the edges of the major crystal faces by using an adsorbed site director. For example, silver thiocyanate or silver chloride including a copper dopant can be deposited on the host tabular grains. Other combinations are, of course, possible. For example, the central epitaxy can function as a hole trap while the epitaxy at the corners of the host tabular grains can function as an electron trap when the locations of the modifying materials identified above are exchanged.

Although the epitaxial deposition of silver salt is discussed above with reference to selective site sensitization, it is appreciated that the controlled site epitaxial deposition of silver salt can be useful in other respects. For example, the epitaxially deposited silver salt can improve the incubation stability of the tabular grain emulsion. It can also be useful in facilitating partial grain development and in dye image amplification processing, as is more fully discussed below. The epitaxially deposited silver salt can also relieve dye desensitization. It can also facilitate dye aggregation by leaving major portions of silver bromoiodide crystal surfaces substantially free of silver chloride, since many aggregating dyes more efficiently adsorb to silver bromoiodide as compared to silver chloride grain surfaces. Another advantage that can be realized is improved developability. Also, localized epitaxy can produce higher contrast.

Conventional chemical sensitization can be undertaken prior to controlled site epitaxial deposition of silver salt on the host tabular grain or as a following step. When silver chloride and/or silver thiocyanate is deposited on silver bromoiodide, a large increase in sensitivity is realized merely by selective site deposition of the silver salt. Thus, further chemical sensitization steps of a conventional type need not be undertaken to obtain photographic speed. On the other hand, an additional increment in speed can generally be obtained when further chemical sensitization is undertaken, and it is a distinct advantage that neither elevated temperature nor extended holding times are required in finishing the emulsion. The quantity of sensitizers can be reduced, if desired, where (1) epitaxial deposition itself improves sensitivity or (2) sensitization is directed to epitaxial deposition sites. Substantially optimum sensitization of tabular silver bromoiodide emulsions have been achieved by the epitaxial deposition of silver chloride without further chemical sensitization. If silver bromide is epitaxially deposited on silver bromoiodide, a much larger increment in sensitivity is realized when further chemical sensitization following selective site deposition is undertaken together with the use of conventional finishing times and temperatures.

When an adsorbed site director is employed which is itself an efficient spectral sensitizer, such as an aggregated dye, no spectral sensitization step following chemical sensitization is required. However, in a variety of instances spectral sensitization during or following chemical sensitization is contemplated. When no spectral sensitizing dye is employed as an adsorbed site director, such as when an aminoazaindene (e.g., adenine) is employed as an adsorbed site director, spectral sensitization, if undertaken, follows chemical sensitization. If the adsorbed site director is not itself a spectral sensitizing dye, then the spectral sensitizer must be capable of displacing the adsorbed site director or at least obtaining sufficient proximity to the grain surfaces to effect spectral sensitization. In many instances even when an adsorbed spectral sensitizing dye is employed as a site director, it is still desirable to perform a spectral sensitization step following chemical sensitization. An additional spectral sensitizing dye can either displace or supplement the spectral sensitizing dye employed as a site director. For example, additional spectral sensitizing dye can provide additive or, most preferably, supersensitizing enhancement of spectral sensitization. It is, of course, recognized that it is immaterial whether the spectral sensitizers introduced after chemical sensitization are capable of acting as site directors for chemical sensitization.

Any conventional technique for chemical sensitization following controlled site epitaxial deposition can be employed. In general chemical sensitization should be undertaken based on the composition of the silver salt deposited rather than the composition of the host tabular grains, since chemical sensitization is believed to occur primarily at the silver salt deposition sites or perhaps immediately adjacent thereto.

The high aspect ratio tabular grain silver halide emulsions of the present invention can be chemically sensitized before or after epitaxial deposition with active gelatin, as illustrated by T. H. James, *The Theory of the Photographic Process,* 4th Ed., Macmillan, 1977, pp. 67–76, or with sulfur, selenium, tellurium, gold, platinum, palladium, iridium, osmium, rhodium, rhenium, or phosphorus sensitizers or combinations of these sensitizers, such as at pAg levels of from 5 to 10, pH levels of from 5 to 8 and temperatures of from 30° to 80° C., as illustrated by *Research Disclosure,* Vol. 120, April 1974, Item 12008, *Research Disclosure,* Vol. 134, June 1975, Item 13452, Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Pat. No. 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Pat. No. 1,396,696; chemical sensitization being optionally conducted in the presence of thiocyanate compounds, preferably in concentrations of from $2\times10^{-3}$ to 2 mole percent, based on silver, as described in Damschroder U.S. Pat. No. 2,642,361; sulfur containing compounds of the type disclosed in Lowe et al U.S. Pat. No. 2,521,926, Willams et al U.S. Pat. No. 3,021,215, and Bigelow U.S. Pat. No. 4,054,457. It is specifically contemplated to sensitize chemically in the presence of finish (chemical sensitization) modifiers—that is, compounds known to suppress fog and increase speed when present during chemical sensitization, such as azaindenes, azapyridazines, azapyrimidines, benzothiazolium salts, and sensitizers having one or more heterocyclic nuclei. Exemplary finish modifiers are described in Brooker et al U.S. Pat. No. 2,131,038, Dostes U.S. Pat. No. 3,411,914, Kuwabara et al U.S. Pat. No. 3,554,757, Oguchi et al U.S. Pat. No. 3,565,631, Oftedahl U.S. Pat. No. 3,901,714, Walworth Canadian Patent No. 778,723, and Duffin *Photographic Emulsion Chemistry,* Focal Press (1966), New York, pp. 138–143. Additionally or alternatively, the emulsions can be reduction sensitized—e.g., with hydrogen, as illustrated by Janusonis U.S. Pat. No. 3,891,446 and Bobcock et al U.S. Pat. No. 3,984,249, by low pAg (e.g., less than 5) and/or high pH (e.g., greater than 8) treatment or through the use of reducing agents, such as stannous chloride, thiourea dioxide, polyamines and amineboranes, as illustrated by Allen et al U.S. Pat. No. 2,983,609, Oftedahl et al *Research Disclosure,* Vol. 136, August 1975, Item 13654, Lowe et al U.S. Pat. Nos. 2,518,698 and 2,739,060, Roberts et al U.S. Pat. Nos. 2,743,182 and '183, Chambers et al U.S. Pat. No. 3,026,203 and Bigelow et al U.S. Pat. No. 3,361,564. Surface chemical sensitization, including sub-surface sensitization, illustrated by Morgan U.S. Pat. No. 3,917,485 and Becker U.S. Pat. No. 3,966,476, is specifically contemplated.

Although the high aspect ratio tabular grain silver halide emulsions of the present invention are generally responsive to the techniques for chemical sensitization known in the art in a qualitative sense, in a quantitative sense—that is, in terms of the actual speed increases realized—the tabular grain emulsions require careful investigation to identify the optimum chemical sensitization for each individual emulsion, certain preferred embodiments being more specifically discussed below.

In addition to being chemically sensitized the high aspect ratio tabular grain silver halide emulsions of the present invention are also spectrally sensitized. It is specifically contemplated to employ spectral sensitizing dyes that exhibit absorption maxima in the blue and minus blue—i.e., green and red, portions of the visible spectrum. In addition, for specialized applications, spectral sensitizing dyes can be employed which improve spectral response beyond the visible spectrum. For example, the use of infrared absorbing spectral sensitizers is specifically contemplated.

The silver halide emulsions of this invention can be spectrally sensitized with dyes from a variety of classes, including the polymethine dye class, which includes the cyanines, merocyanines, complex cyanines and merocyanines (i.e., tri-, tetra- and poly-nuclear cyanines and merocyanines), oxonols, hemioxonols, styryls, merostyryls and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, oxazolinium, thiazolium, thiazolinium, selenazolium, selenazolinium, imidazolium, imidazolinium, benzoxazolium, benzothiazolium, benzoselenazolium, benzimidazolium, naphthoxazolium, naphthothiazolium, naphthoselenazolium, dihydronaphthothiazolium, pyrylium, and imidazopyrazinium quaternary salts.

The merocyanine spectral sensitizing dyes include, joined by a methine linkage, a basic heterocyclic nucleus of the cyanine dye type and an acidic nucleus, such as can be derived from barbituric acid, 2-thiobarbituric acid, rhodanine, hydantoin, 2-thiohydantoin, 4-thiohydantoin, 2-pyrazoline-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, and chroman-b 2,4-dione.

One or more spectral sensitizing dyes may be used. Dyes with sensitizing maxima at wavelengths throughout the visible spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as compounds which can be responsible for supersensitization are discussed by Gilman, "Review of the Mechanisms of Supersensitization", *Photographic Science and Engineering,* Vol. 18, 1974, pp. 418–430.

Spectral sensitizing dyes also affect the emulsions in other ways. Spectral sensitizing dyes can also function as antifoggants or stabilizers, development accelerators or inhibitors, and halogen acceptors or electron acceptors, as disclosed in Brooker et al U.S. Pat. No. 2,131,038 and Shiba et al U.S. Pat. No. 3,930,860.

In a preferred form of this invention the spectral sensitizing dyes also function as adsorbed site directors during silver salt deposition and chemical sensitization. Useful dyes of this type are aggregating dyes. Such dyes exhibit a bathochromic or hypsochromic increase in light absorption as a function of adsorption on silver halide grains surfaces. Dyes satisfying such criteria are well known in the art, as illustrated by T. H. James, *The Theory of the Photographic Process,* 4th Ed., Macmillan, 1977, Chapter 8 (particularly, F. Induced Color Shifts in Cyanine and Merocyanine Dyes) and Chapter 9 (particularly, H. Relations Between Dye Structure and Surface Aggregation) and F. M. Hamer, *Cyanine Dyes and Related Compounds,* John Wiley and Sons, 1964, Chapter XVII (particularly, F. Polymerization and Sensitization of the Second Type). Merocyanine, hemicyanine, styryl, and oxonol spectral sensitizing dyes which produce H aggregates (hypsochromic shifting) are known to the art, although J aggregates (bathochromic shifting) are not common for dyes of these classes. Preferred spectral sensitizing dyes are cyanine dyes which exhibit either H or J aggregation.

In a specifically preferred form the spectral sensitizing dyes are carbocyanine dyes which exhibit J aggregation. Such dyes are characterized by two or more basic heterocyclic nuclei joined by a linkage of three methine groups. The heterocyclic nuclei preferably include fused benzene rings to enhance J aggregation. Preferred heterocyclic nuclei for promoting J aggregation are quinolinium, benzoxazolium, benzothiazolium, benzoselenazolium, benzimidazolium, naphthooxazolium, naphthothiazolium, and naphthoselenazolium quaternary salts.

Specific preferred dyes for use as adsorbed site directors in accordance with this invention are illustrated by the dyes listed below in Table I.

Table I

Illustrative Preferred Adsorbed Site Directors

AD-1: Anhydro-9-ethyl-3,3'-bis(3-sulfopropyl)-4,5,4',5'-dibenzothiacarbocyanine hydroxide, AD-2: Anhydro-5,5'-dichloro-9-ethyl-3,3'-bis(3-sulfobutyl)thiacarbocyanine hydroxide AD-3: Anhydro-5,5',6,6'-tetrachloro-1,1'-diethyl-3,3'-bis(3-sulfobutyl)benzimidazolocarbocyanine hydroxide AD-4: Anhydro-5,5',6,6'-tetrachloro-1,1',3-triethyl-3'-(3-sulfobutyl)benzimidazolocarbocyanine hydroxide AD-5: Anhydro-5-chloro-3,9-diethyl-5'-phenyl-3'-(3-sulfopropyl)oxacarbocyanine hydroxide AD-6: Anhydro-5-chloro-3',9-diethyl-5'-phenyl-3-(3-sulfopropyl)oxacarbocyanine hydroxide AD-7: Anhdro-5-chloro-9-ethyl-5'-phenyl-3,3'-bis(3-sulfopropyl)oxacarbocyanine hydroxide AD-8: Anhydro-9-ethyl-5,5'-diphenyl-3,3'-bis(3-sulfobutyl)oxacarbocyanine hydroxide AD-9: Anhydro-5,5'-dichloro-3,3'-bis(3-sulfopropyl)-thiacyanine hydroxide AD-10: 1,1'-Diethyl-2,2'-cyanine p-toluenesulfonate Sensitizing action can be correlated to the position of molecular energy levels of a dye with respect to ground state and conduction band energy levels of the silver halide crystals. These energy levels can in turn be correlated to polarographic oxidation and reduction potentials, as discussed in *Photographic Science and Engineering,* Vol. 18, 1974, pp. 49–53 (Sturmer et al), pp. 175–178 (Leubner) and pp. 475–485 (Gilman). Oxidation and reduction potentials can be measured as described by R. J. Cox, *Photographic Sensitivity,* Academic Press, 1973, Chapter 15.

The chemistry of cyanine and related dyes is illustrated by Weissberger and Taylor, *Special Topics of Heterocyclic Chemistry,* John Willey and Sons, New York, 1977, Chapter VIII; Venkataraman, *The Chemistry of Synthetic Dyes,* Academic Press, New York, 1971, Chapter V; James, *The Theory of the Photographic Process,* 4th Ed., Macmillan, 1977, Chapter 8, and F. M. Hamer, *Cyanine Dyes and Related Compounds,* John Wiley and Sons, 1964.

Although native blue sensitivity of silver bromide or bromoiodide is usually relied upon in the art in emulsion layers intended to record exposure to blue light, significant advantages can be obtained by the use of spectral sensitizers, even where their principal absorption is in the spectral region to which the emulsions possess native sensitivity. For example, it is specifically recognized that advantages can be realized from the use of blue spectral sensitizing dyes. Even when the emulsions of the invention are high aspect ratio tabular grain silver bromide and silver bromoiodide emulsions, very large increases in speed are realized by the use of blue spectral sensitizing dyes. Where it is intended to expose emulsions according to the present invention in their region of native sensitivity, advantages in sensitivity can be gained by increasing the thickness of the tabular grains. For example, in one preferred form of the invention the emulsions are blue sensitized silver bromide and bromoiodide emulsions in which the tabular grains having a thickness of less than 0.5 micron and a diameter of at least 0.6 micron have an average aspect ratio of greater than 8:1, preferably at least 12:1 and account for at least 50 percent of the total projected area of the silver halide grains present in the emulsion, preferably 70 percent and optimally at least 90 percent. In the foregoing description 0.3 micron can, of course, be substituted for 0.5 micron without departing from the invention.

Among useful spectral sensitizing dyes for sensitizing silver halide emulsions are those found in U.K. Pat. No. 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,231,658, 2,493,747, '748, 2,526,632, 2,739,964 (Reissue 24,292), 2,778,823, 2,917,516, 3,352,857, 3,411,916 and 3,431,111, Wilmanns et al U.S. Pat. No. 2,295,276, Sprague U.S. Pat. Nos. 2,481,698 and 2,503,776, Carroll et al U.S. Pat. Nos. 2,688,545 and 2,704,714, Larive et al U.S. Pat. No. 2,921,067, Jones U.S. Pat. No. 2,945,763, Nys et al U.S. Pat. No. 3,282,933, Schwan et al U.S. Pat. No. 3,397,060, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349. Examples of useful dye combinations, including supersensitizing dye combinations, are found in Motter U.S. Pat. No. 3,506,443 and Schwan et al U.S. Pat. No. 3,672,898. As examples of supersensitizing combinations of spectral sensitizing dyes and non-light absorbing addenda, it is specifically contemplated to employ thiocyanates during spectral sensitization, as taught by Leermakers U.S. Pat. No. 2,221,805; bis-triazinylaminostilbenes, as taught by McFall et al U.S. Pat. No. 2,933,3909; sulfonated aromatic compounds, as taught by Jones et al U.S. Pat. No. 2,937,089; mercapto-substituted heterocycles, as taught by Riester U.S. Pat. No. 3,457,078; iodide, as taught by U.K. Pat. No. 1,413,826; and still other compounds, such as those disclosed by Gilman, "Review of the Mechanisms of Supersensitization", cited above.

Conventional amounts of dyes can be employed in spectrally sensitizing the emulsion layers containing nontabular or low aspect ratio tabular silver halide grains. To realize the full advantages of this invention it is preferred to adsorb spectral sensitizing dye to the grain surfaces of the high aspect ratio tabular grain emulsions in a substantially optimum amount—that is, in an amount sufficient to realize at least 60 percent of the maximum photographic speed attainable from the grains under contemplated conditions of exposure. The quantity of dye employed will vary with the specific dye or dye combination chosen as well as the size and aspect ratio of the grains. It is known in the photographic art that optimum spectral sensitization is obtained with organic dyes at about 25 percent to 100 percent or more of monolayer coverage of the total available surface area of surface sensitive silver halide grains, as disclosed, for example, in West et al, "The Adsorption of Sensitizing Dyes in Photographic Emulsions", *Journal of Phys. Chem.,* Vol. 56, p. 1065, 1952, and Spence et al, "Desensitization of Sensitizing Dyes", *Journal of Physcial and Colloid Chemistry,* Vol. 56, No. 6, June 1948, pp. 1090–1103; and Gilman et al U.S. Pat.

No. 3,979,213. Optimum dye concentration levels can be chosen by procedures taught by Mees, *Theory of the Photographic Process,* pp. 1067–1069, cited above.

It has been discovered quite unexpectedly that high aspect ratio tubular grain silver halide emulsions which are given selective site sensitizations according to this invention exhibit higher photographic sensitivities than comparable high aspect ratio tubular grain silver halide emulsions which are chemically and spectrally sensitized by previously known techniques. Specifically, the present invention constitutes one preferred species for implementing generic concepts of the inventions of Kofron et al and Solberg et al, cited above. The high aspect ratio tubular grain silver bromoiodide emulsions of the present invention exhibit higher speed-granularity relationships than have heretofore been observed in the art of photography. Best results have been achieved using minus blue spectral sensitizing dyes.

Although not required to realize all of their advantages, the emulsions of the present invention are preferably, in accordance with prevailing manufacturing practices, substantially optimally chemically and spectrally sensitized. That is, they preferably achieve speeds of at least 60 percent of the maximum log speed attainable from the grains in the spectral region of sensitization under the contemplated conditions of use and processing. Log speed is herein defined as 100 (1-log E), where E is measured in meter-candle-seconds at a density of 0.1 above fog. Once the host tabular grains of an emulsion layer have been characterized, it is possible to estimate from further product analysis and performance evaluation whether an emulsion layer of a product appears to be substantially optimally chemically and spectrally sensitized in relation to comparable commercial offerings of other manufacturers. To achieve the sharpness advantages of the present invention it is immaterial whether the silver halide emulsions are chemically or spectrally sensitized efficiently or inefficiently.

c. Silver imaging

Once high aspect ratio tabular grain emulsions have been generated by precipitation procedures, washed, and sensitized, as described above, their preparation can be completed by the incorporation of conventional photographic addenda, and they can be usefully applied to photographic applications requiring a silver image to be produced—e.g., conventional black-and-white photography.

Dickerson, cited above and here incorporated by reference, discloses that hardening photographic elements according to the present invention intended to form silver images to an extent sufficient to obviate the necessity of incorporating additional hardener during processing permits increased silver covering power to be realized as compared to photographic elements similarly hardened and processed, but employing nontabular or less than high aspect ratio tabular grain emulsions. Specifically, it is taught to harden the high aspect ratio tabular grain emulsion layers and other hydrophilic colloid layers of black-and-white photographic elements in an amount sufficient to reduce swelling of the layers to less than 200 percent, percent swelling being determined by (a) incubating the photographic element at 38° C. for 3 days at 50 percent relative humidity, (b) measuring layer thickness, (c) immersing the photographic element in distilled water at 21° C. for 3 minutes, and (d) measuring change in layer thickness. Although hardening of the photographic elements intended to form silver images to the extent that hardeners need not be incorporated in processing solutions is specifically preferred, it is recognized that the emulsions of the present invention can be hardened to any conventional level. It is further specifically contemplated to incorporate hardeners in processing solutions, as illustrated, for example, by *Research Disclosure,* Vol. 184, August 1979, Item 18431, Paragraph K, relating particularly to the processing of radiographic materials.

Typical useful incorporated hardeners (forehardeners) include formaldehyde and free dialdehydes, such as succinaldehyde and glutaraldehyde, as illustrated by Allen et al U.S. Pat. No. 3,232,764; blocked dialdehydes, as illustrated by Kaszuba U.S. Pat. No. 2,586,168, Jeffreys U.S. Pat. No. 2,870,013, and Yamamoto et al U.S. Pat. No. 3,819,608; α-diketones, as illustrated by Allen et al U.S. Pat. No. 2,725,305; active esters of the type described by Burness et al U.S. Pat. No. 3,542,558; sulfonate esters, as illustrated by Allen et al U.S. Pat. Nos. 2,725,305 and 2,726,162; active halogen compounds, as illustrated by Burness U.S. Pat. No. 3,106,468, Silverman et al U.S. Pat. No. 3,839,042, Ballantine et al U.S. Pat. No. 3,951,940 and Himmelmann et al U.S. Pat. No. 3,174,861; s-triazines and diazines, as illustrated by Yamamoto et al U.S. Pat. No. 3,325,287, Anderau et al U.S. Pat. No. 3,288,775 and Stauner et al U.S. Pat. No. 3,992,366; epoxides, as illustrated by Allen et al U.S. Pat. No. 3,047,394, Burness U.S. Pat. No. 3,189,459 and Birr et al German Patent No. 1,085,663; aziridines, as illustrated by Allen et al U.S. Pat. No. 2,950,197, Burness et al U.S. Pat. No. 3,271,175 and Sato et al U.S. Pat. No. 3,575,705; active olefins having two or more active vinyl groups (e.g. vinylsulfonyl groups), as illustrated by Burness et al U.S. Pat. Nos. 3,490,911, 3,539,644 and 3,841,872 (Reissue 29,305), Cohen U.S. Pat. No. 3,640,720, Kleist et al German Patent No. 872,153 and Allen U.S. Pat. No. 2,992,109; blocked active olefins, as illustrated by Burness et al U.S. Pat. No. 3,360,372 and Wilson U.S. Pat. No. 3,345,177; carbodiimides, as illustrated by Blout et al German Patent No. 1,148,446; isoxazolium salts unsubstituted in the 3-position, as illustrated by Burness et al U.S. Pat. No. 3,321,313; esters of 2-alkoxy-N-carboxydihydroquinoline, as illustrated by Bergthaller et al U.S. Pat. No. 4,013,468; N-carbamoyl and N-carbamoyloxypyridinium salts, as illustrated by Himmelmann U.S. Pat. No. 3,880,665; hardeners of mixed function, such as halogen-substituted aldehyde acids (e.g., mucochloric and mucobromic acids), as illustrated by White U.S. Pat. No. 2,080,019, 'onium substituted acroleins, as illustrated by Tschopp et al U.S. Pat. No. 3,792,021, and vinyl sulfones containing other hardening functional groups, as illustrated by Sera et al U.S. Pat. No. 4,028,320; and polymeric hardeners, such as dialdehyde starches, as illustrated by Jeffreys et al U.S. Pat. No. 3,057,723, and copoly(acrolein-methacrylic acid), as illustrated by Himmelmann et al U.S. Pat. No. 3,396,029.

The use of forehardeners in combination is illustrated by Sieg et al U.S. Pat. No. 3,497,358, Dallon et al U.S. Pat. No. 3,832,181 and 3,840,370 and Yamamoto et al U.S. Pat. No. 3,898,089. Hardening accelerators can be used, as illustrated by Sheppard et al U.S. Pat. No. 2,165,421, Kleist German Patent No. 881,444, Riebel et al U.S. Pat. No. 3,628,961 and Ugi et al U.S. Pat. No. 3,901,708. The patents illustrative of hardeners and hardener combinations are here incorporated by reference.

Instability which increases minimum density in negative type emulsion coatings (i.e., fog) or which increases minimum density or decreases maximum density in direct-positive emulsion coatings can be protected against by incorporation of stabilizers, antifoggants, antikinking agents, latent image stabilizers and similar addenda in the emulsion and contiguous layers prior to coating. Many of the antifoggants which are effective in emulsions can also be used in developers and can be classified under a few general headings, as illustrated by C.E.K. Mees, *The Theory of the Photographic Process,* 2nd Ed., Macmillan, 1954, pp. 677–680.

To avoid such instability in emulsion coatings stabilizers and antifoggants can be employed, such as halide ions (e.g., bromide salts); chloropalladates and chloropalladites, as illustrated by Trivelli et al U.S. Pat. No. 2,566,263; water-soluble inorganic salts of magnesium, calcium, cadmium, cobalt, manganese and zinc, as illustrated by Jones U.S. Pat. No. 2,839,405 and Sidebotham U.S. Pat. No. 3,488,709; mercury salts, as illustrated by Allen et al U.S. Pat. No. 2,728,663; selenois and diselenides, as illustrated by Brown et al U.K. Pat. No. 1,336,570 and Pollet et al U.K. Pat. No. 1,282,303; quaternary ammonium salts of the type illustrated by Allen et al U.S. Pat. No. 2,694,716, Brooker et al U.S. Pat. No. 2,131,038, Graham U.S. Pat. No. 3,342,596 and Arai et al U.S. Pat. No. 3,954,478; azomethine desensitizing dyes, as illustrated by Thiers et al U.S. Pat. No. 3,630,744; isothiourea derivatives, as illustrated by Herz et al U.S. Pat. No. 3,220,839 and Knott et al U.S. Pat. No. 2,514,650; thiazolidines, as illustrated by Scavron U.S. Pat. No. 3,565,625; peptide derivatives, as illustrated by Maffet U.S. Pat. No. 3,274,002; pyrimidines and 3-pyrazolidones, as illustrated by Welsh U.S. Pat. No. 3,161,515 and Hood et al U.S. Pat. No. 2,751,297; azotriazoles and azotetrazoles, as illustrated by Baldassarri et al U.S. Pat. No. 3,925,086; azaindenes, particularly tetraazaindenes, as illustrated by Heimbach U.S. Pat. No. 2,444,605, Knott U.S. Pat. No. 2,933,388, Williams U.S. Pat. No. 3,202,512, *Research Disclosure,* Vol. 134, June 1975, Item 13452, and Vol. 148, August 1976, Item 14851, and Nepker et al U.K. Pat. No. 1,338,567; mercaptotetrazoles, -triazoles and -diazoles, as illustrated by Kendall et al U.S. Pat. No. 2,403,927, Kennard et al U.S. Pat. No. 3,266,897, *Research Disclosure,* Vol. 116, December 1973, Item 11684, Luckey et al U.S. Pat. No. 3,397,987 and Salesin U.S. Pat. No. 3,708,303; azoles, as illustrated by Peterson et al U.S. Pat. No. 2,271,229 and *Research Disclosure,* Item 11684, cited above; purines, as illustrated by Sheppard et al U.S. Pat. No. 2,319,090, Birr et al U.S. Pat. No. 2,152,460, *Research Disclosure,* Item 13452, cited above, and Dostes et al French Patent No. 2,296,204 and polymers of 1,3-dihydroxy(and/or 1,3-carbamoxy)-2-methylenepropane, as illustrated by Saleck et al U.S. Pat. No. 3,926,635.

Among useful stabilizers for gold sensitized emulsions are water-insoluble gold compounds of benzothiazole, benzoxazole, naphthothiazole and certain merocyanine and cyanine dyes, as illustrated by Yutzy et al U.S. Pat. No. 2,597,915, and sulfinamides, as illustrated by Nishio et al U.S. Pat. No. 3,498,792.

Among useful stabilizers in layers containing poly(alkylene oxides) are tetraazaindenes, particularly in combination with Group VIII noble metals or resorcinol derivatives, as illustrated by Carroll et al U.S. Pat. No. 2,716,062, U.K. Pat. No. 1,466,024 and Habu et al U.S. Pat. No. 3,929,486; quaternary ammonium salts of the type illustrated by Piper U.S. Pat. No. 2,886,437; water-insoluble hydroxides, as illustrated by Maffet U.S. Pat. No. 2,953,455; phenols, as illustrated by Smith U.S. Pat. Nos. 2,955,037 and '038; ethylene diurea, as illustrated by Dersch U.S. Pat. No. 3,582,346; barbituric acid derivatives, as illustrated by Wood U.S. Pat. No. 3,617,290; boranes, as illustrated by Bigelow U.S. Pat. No. 3,725,078; 3-pyrazolidinones, as illustrated by Wood U.K. Pat. No. 1,158,059 and aldoximines, amides, anilides and esters, as illustrated by Butler et al U.K. Pat. No. 988,052.

The emulsions can be protected from fog and desensitization caused by trace amounts of metals such as copper, lead, tin, iron and the like, by incorporating addenda, such as sulfocatechol-type compounds, as illustrated by Kennard et al U.S. Pat. No. 3,236,652; aldoximines, as illustrated by Carroll et al U.K. Pat. No. 623,448 and meta- and poly-phosphates, as illustrated by Draisbach U.S. Pat. No. 2,239,284, and carboxylic acids such as ethylenediamine tetraacetic acid, as illustrated by U.K. Pat. No. 691,715.

Among stabilizers useful in layers containing synthetic polymers of the type employed as vehicles and to improve covering power are monohydric and polyhydric phenols, as illustrated by Forsgard U.S. Pat. No. 3,043,697; saccharides, as illustrated by U.K. Pat. No. 897,497 and Stevens et al U.K. Pat. No. 1,039,471 and quinoline derivatives, as illustrated by Dersch et al U.S. Pat. No. 3,446,618.

Among stabilizers useful in protecting the emulsion layers against dichroic fog are addenda, such as salts of nitron, as illustrated by Barbier et al U.S. Pat. Nos. 3,679,424 and 3,820,998; mercaptocarboxylic acids, as illustrated by Willems et al U.S. Pat. No. 3,600,178, and addenda listed by E. J. Birr, *Stabilization of Photographic Silver Halide Emulsions,* Focal Press, London, 1974, pp. 126–218.

Among stabilizers useful in protecting emulsion layers against development fog are addenda such as azabenzimidazoles, as illustrated by Bloom et al U.K. Pat. No. 1,356,142 and U.S. Pat. No. 3,575,699, Rogers U.S. Pat. No. 3,473,924 and Carlson et al U.S. Pat. No. 3,649,267; substituted benzimidazoles, benzothiazoles, benzotriazoles and the like, as illustrated by Brooker et al U.S. Pat. No. 2,131,038, Land U.S. Pat. No. 2,704,721, Rogers et al U.S. Pat. No. 3,265,498; mercapto-substituted compounds, e.g., mercaptotetrazoles, as illustrated by Dimsdale et al U.S. Pat. No. 2,432,864, Rauch et al U.S. Pat. No. 3,081,170, Weyerts et al U.S. Pat. No. 3,260,597, Grasshoff et al U.S. Pat. No. 3,674,478 and Arond U.S. Pat. No. 3,706,557; isothiourea derivatives, as illustrated by Herz et al U.S. Pat. No. 3,220,839, and thiodiazole derivatives, as illustrated by von Konig U.S. Pat. No. 3,364,028 and von Konig et al U.K. Pat. No. 1,186,441.

Where hardeners of the aldehyde type are employed, the emulsion layers can be protected with antifoggants, such as monohydric and polyhydric phenols of the type illustrated by Sheppard et al U.S. Pat. No. 2,165,421; nitro-substituted compounds of the type disclosed by Rees et al U.K. Pat. No. 1,269,268; poly(alkylene oxides), as illustrated by Valbusa U.K. Pat. No. 1,151,914, and mucohalogenic acids in combination with urazoles, as illustrated by Allen et al U.S. Pat. Nos. 3,232,761 and 3,232,764, or further in combination with maleic acid hydrazide, as illustrated by Rees et al U.S. Pat. No. 3,295,980.

To protect emulsion layers coated on linear polyester supports addenda can be employed such as parabanic acid, hydantoin acid hydrazides and urazoles, as illustrated by Anderson et al U.S. Pat. No. 3,287,135, and piazines containing two symmetrically fused 6-member carbocyclic rings, especially in combination with an aldehyde-type hardening agent, as illustrated in Rees et al U.S. Pat. No. 3,396,023.

Kink desensitization of the emulsions can be reduced by the incorporation of thallous nitrate, as illustrated by Overman U.S. Pat. No. 2,628,167; compounds, polymeric latices and dispersions of the type disclosed by Jones et al U.S. Pat. Nos. 2,759,821 and '822; azole and mercaptotetrazole hydrophilic colloid dispersions of the type disclosed by *Research Disclosure,* Vol. 116, December 1973, Item 11684; plasticized gelatin compositions of the type disclosed by Milton et al U.S. Pat. No. 3,033,680; water-soluble interpolymers of the type disclosed by Rees et al U.S. Pat. No. 3,536,491; polymeric latices prepared by emulsion polymerization in the presence of poly(alkylene oxide), as disclosed by Pearson et al U.S. Pat. No. 3,772,032, and gelatin graft copolymers of the type disclosed by Rakoczy U.S. Pat. No. 3,837,861.

Where the photographic element is to be processed at elevated bath or drying temperatures, as in rapid access processors, pressure desensitization and/or increased fog can be controlled by selected combinations of addenda, vehicles, hardeners and/or processing conditions, as illustrated by Abbott et al U.S. Pat. No. 3,295,976, Barnes et al U.S. Pat. No. 3,545,971, Salesin U.S. Pat. No. 3,708,303, Yamamoto et al U.S. Pat. No. 3,615,619, Brown et al U.S. Pat. No. 3,623,873, Taber U.S. Pat. No. 3,671,258, Abele U.S. Pat. No. 3,791,830, *Research Disclosure,* Vol. 99, July 1972, Item 9930, Florens et al U.S. Pat. No. 3,843,364, Priem et al U.S. Pat. No. 3,867,152, Adachi et al U.S. Pat. No. 3,967,965 and Mikawa et al U.S. Pat. Nos. 3,947,274 and 3,954,474.

In addition to increasing the pH or decreasing the pAg of an emulsion and adding gelatin, which are known to retard latent image fading, latent image stabilizers can be incorporated, such as amino acids, as illustrated by Ezekiel U.K. Pat. Nos. 1,335,923, 1,378,354, 1,387,654 and 1,391,672, Ezekiel et al U.K. Pat. No. 1,394,371, Jefferson U.S. Pat. No. 3,843,372, Jefferson et al U.K. Pat. No. 1,412,294 and Thurston U.K. Pat. No. 1,343,904; carbonyl-bisulfite addition products in combination with hydroxybenzene or aromatic amine developing agents, as illustrated by Seiter et al U.S. Pat. No. 3,424,583; cycloalkyl-1,3-diones, as illustrated by Beckett et al U.S. Pat. No. 3,447,926; enzymes of the catalase type, as illustrated by Matejec et al U.S. Pat. No. 3,600,182; halogen-substituted hardeners in combination with certain cyanine dyes, as illustrated by Kumai et al U.S. Pat. No. 3,881,933; hydrazides, as illustrated by Honig et al U.S. Pat. No. 3,386,831; alkenylbenzothiazolium salts, as illustrated by Arai et al U.S. Pat. No. 3,954,478; soluble and sparingly soluble mercaptides, as illustrated by Herz U.S. Pat. No. 4,374,196, commonly assigned and here incorporated by reference; hydroxy-substituted benzylidene derivatives, as illustrated by Thurston U.K. Pat. No. 1,308,777 and Ezekiel et al U.K. Pat. Nos. 1,347,544 and 1,353,527; mercapto-substituted compounds of the type disclosed by Sutherns U.S. Pat. No. 3,519,427; metal-organic complexes of the type disclosed by Matejec et al U.S. Pat. No. 3,639,128; penicillin derivatives, as illustrated by Ezekiel U.K. Pat. No. 1,389,089; propynylthio derivatives of benzimidazoles, pyrimidines, etc., as illustrated by von Konig et al U.S. Pat. No. 3,910,791; combinations of iridium and rhodium compounds, as disclosed by Yamasue et al U.S. Pat. No. 3,901,713; sydnones or sydnone imines, as illustrated by Noda et al U.S. Pat. No. 3,881,939; thiazolidine derivatives, as illustrated by Ezekiel U.K. Pat. No. 1,458,197 and thioether-substituted imidazoles, as illustrated by *Research Disclosure,* Vol. 136, August 1975, Item 13651.

The present invention is equally applicable to photographic elements intended to form negative or positive images. For example, the photographic elements can be of a type which form either surface or internal latent images on exposure and which produce negatively images on processing. Alternatively, the photographic elements can be of a type that produce direct positive images in response to a single development step. When the composite grains comprised of the host tabular grain and the silver salt epitaxy form an internal latent image, surface fogging of the composite grains can be undertaken to facilitate the formation of a direct positive image. In a specifically preferred form the silver salt epitaxy is chosen to itself form an internal latent image site (i.e., to internally trap electrons) and surface fogging can, if desired, be limited to just the silver salt epitaxy. In another form the host tabular grain can trap electrons internally with the silver salt epitaxy preferably acting as a hole trap. The surface fogged emulsions can be employed in combination with an organic electron acceptor as taught, for example, by Kendall et al U.S. Pat. No. 2,541,472, Shouwenaars U.K. Pat. No. 723,019, Illingsworth U.S. Pat. Nos. 3,501,305, '306, and '307, *Research disclosure,* Vol. 134, June, 1975, Item 13452, Kurz U.S. Pat. No. 3,672,900, Judd et al U.S. Pat. No. 3,600,180, and Taber et al U.S. Pat. No. 3,647,643. The organic electron acceptor can be employed in combination with a spectrally sensitizing dye or can itself be a spectrally sensitizing dye, as illustrated by Illingsworth et al U.S. Pat. No. 3,501,310. If internally sensitive emulsions are employed, surface fogging and organic electron acceptors can be employed in combination as illustrated by Lincoln et al U.S. Pat. No. 3,501,311, but neither surface fogging nor organic electron acceptors are required to produce direct positive images.

In addition to the specific features described above, the photographic elements of this invention can employ conventional features, such as disclosed in *Research Disclosure,* Vol. 176, December 1978, Item 17643, here incorporated by reference. Optical brighteners can be introduced, as disclosed by Item 17643 at Paragraph V. Absorbing and scattering materials can be employed in the emulsions of the invention and in separate layers of the photographic elements, as described in Paragraph VIII. Coating aids, as described in Paragraph XI, and plasticizers and lubricants, as described in Paragraph XII, can be present. Antistatic layers, as described in Paragraph XIII, can be present. Methods of addition of addenda are described in Paragraph XIV. Matting agents can be incorporated, as described in Paragraph XVI. Developing agents and development modifiers can, if desired, be incorporated, as described in Paragraphs XX and XXI. When the photographic elements of the invention are intended to serve radiographic applications, emulsion and other layers of the radiographic element can take any of the forms specifically described in *Research Disclosure,* Item 18431, cited above, here incorporated by reference. The emulsions of the invention, as well as other, conventional silver halide emulsion layers, interlayers, overcoats, and subbing layers, if any, present in the photographic elements can be coated and dried as described in Item 17643, Paragraph XV.

In accordance with established practices within the art it is specifically contemplated to blend the high aspect ratio tabular grain emulsions of the present invention with each other or with conventional emulsions to satisfy specific emulsion layer requirements. For example, it is known to blend emulsions to adjust the characteristic curve of a photographic element to satisfy a predetermined aim. Blending can be employed to increase or decrease maximum densities realized on exposure and processing, to decrease or increase minimum density, and to adjust characteristic curve shape intermediate its toe and shoulder. To accomplish this the emulsions of this invention can be blended with conventional silver halide emulsions, such as those described in Item 17643, cited above, Paragraph I. It is specifically contemplated to blend the emulsions as described in sub-paragraph F of Paragraph I.

In their simplest form photographic elements according to the present invention employ a single silver halide emulsion layer containing a high aspect ratio tabular grain emulsion according to the present invention and a photographic support. It is, of course, recognized that more than one silver halide emulsion layer as well as overcoat, subbing, and interlayers can be usefully included. Instead of blending emulsions as described above the same effect can usually by achieved by coating the emulsions to be blended as separate layers. Coating of separate emulsion layers to achieve exposure latitude is well known in the art, as illustrated by Zelikman and Levi, *Making and Coating Photographic Emulsions,* Focal Press, 1964, pp. 234–238; Wyckoff U.S. Pat. No. 3,663,228; and U.K. Pat. No. 923,045. It is further well known in the art that increased photographic speed can be realized when faster and slower silver halide emulsions are coated in separate layers as opposed to blending. Typically the faster emulsion layer is coated to lie nearer the exposing radiation source than the slower emulsion layer. This approach can be extended to three or more superimposed emulsion layers. Such layer arrangements are specifically contemplated in the practice of this invention.

The layers of the photographic elements can be coated on a variety of supports. Typical photographic supports include polymeric film, wood fiber—e.g., paper, metallic sheet and foil, glass and ceramic supporting elements provided with one or more subbing layers to enhance the adhesive, antistatic, dimensional, abrasive, hardness, frictional, antihalation and/or other properties of the support surface.

Typical of useful polymeric film supports are films of cellulose nitrate and cellulose esters such as cellulose triacetate and diacetate, polystyrene, polyamides, homo- and co-polymers of vinyl chloride, poly(vinyl acetal), polycarbonate, homo- and co-polymers of olefins, such as polyethylene and polypropylene, and polyesters of dibasic aromatic carboxylic acids with divalent alcohols, such as poly(ethylene terephthalate).

Typical of useful paper supports are those which are partially acetylated or coated with baryta and/or a polyolefin, particularly a polymer of an α-olefin containing 2 to 10 carbon atoms, such as polyethylene, polypropylene, copolymers of ethylene and propylene and the like.

Polyolefins, such as polyethylene, polypropylene and polyallomers—e.g., copolymers of ethylene with propylene, as illustrated by Hagemeyer et al U.S. Pat. No. 3,478,128, are preferably employed as resin coatings over paper, as illustrated by Crawford et al U.S. Pat. No. 3,411,908 and Joseph et al U.S. Pat. No. 3,630,740, over polystyrene and polyester film supports, as illustrated by Crawford et al U.S. Pat. No. 3,630,742, or can be employed as unitary flexible reflection supports, as illustrated by Venor et al U.S. Pat. No. 3,973,963.

Preferred cellulose ester supports are cellulose triacetate supports, as illustrated by Fordyce et al U.S. Pat. Nos. 2,492,977, '978 and 2,739,069, as well as mixed cellulose ester supports, such as cellulose acetate propionate and cellulose acetate butyrate, as illustrated by Fordyce et al U.S. Pat. No. 2,739,070.

Preferred polyester film supports are comprised of linear polyester, such as illustrated by Alles et al U.S. Pat. No. 2,627,088, Wellman U.S. Pat. No. 2,720,503, Alles U.S. Pat. No. 2,779,684 and Kibler et al U.S. Pat. No. 2,901,466. Polyester films can be formed by varied techniques, as illustrated by Alles, cited above, Czerkas et al U.S. Pat. No. 3,663,683 and Williams et al U.S. Pat. No. 3,504,075, and modified for use as photographic film supports, as illustrated by Van Stappen U.S. Pat. No. 3,227,576, Nadeau et al U.S. Pat. No. 3,501,301, Reedy et al U.S. Pat. No. 3,589,905, Babbitt et al U.S. Pat. No. 3,850,640, Bailey et al U.S. Pat. No. 3,888,678, Hunter U.S. Pat. No. 3,904,420 and Mallinson et al U.S. Pat. No. 3,928,697.

The photographic elements can employ supports which are resistant to dimensional change at elevated temperatures. Such supports can be comprised of linear condensation polymers which have glass transition temperatures above about 190° C., preferably 220° C., such as polycarbonates, polycarboxylic esters, polyamides, polysulfonamides, polyethers, polyimides, polysulfonates and copolymer variants, as illustrated by Hamb U.S. Pat. Nos. 3,634,089 and 3,772,405; Hamb et al U.S. Pat. Nos. 3,725,070 and 3,793,249; Wilson *Research Disclosure,* Vol. 118, February 1974, Item 11833, and Vol. 120, April 1974, Item 12046; Conklin et al *Research Disclosure,* Vol. 120, April 1974, Item 12012; *Product Licensing Index,* Vol. 92, December 1971, Items 9205 and 9207; *Research Disclosure,* Vol. 101, September 1972, Items 10119 and 10148; *Research Disclosure,* Vol. 106, February 1973, Item 10613; *Research Disclosure,* Vol. 117, January 1974, Item 11709, and *Research Disclosure,* Vol. 134, June 1975, Item 13455.

Although the emulsion layer or layers are typically coated as continuous layers on supports having opposed planar major surfaces, this need not be the case. The emulsion layers can be coated as laterally displaced layer segments on a planar support surface. When the emulsion layer or layers are segmented, it is preferred to employ a microcellular support. Useful microcellular supports are disclosed by Whitmore Patent Cooperation Treaty published application W080/01614, published Aug. 7, 1980, (Belgian Patent No. 881,513, Aug. 1, 1980, corresponding), Blazey et al U.S. Pat. No. 4,307,165, and Gilmour et al U.S. Ser. No. 293,080, filed Aug. 17, 1981, here incorporated by reference. Microcells can range from 1 to 200 microns in width and up to 1000 microns in depth. It is generally preferred that the microcells be at least 4 microns in width and less than 200 microns in depth, with optimum dimensions being about 10 to 100 microns in width and depth for ordinary black-and-white imaging applications—particularly where the photographic image is intended to be enlarged.

The photographic elements of the present invention can be imagewise exposed in any conventional manner. Attention is directed to *Research Disclosure* Item 17643, cited above, Paragraph XVIII, here incorporated by reference. The present invention is particularly advantageous when imagewise exposure is undertaken with electromagnetic radiation within the region of the spectrum in which the spectral sensitizers present exhibit absorption maxima. When the photographic elements are intended to record blue, green, red, or infrared exposures, spectral sensitizer absorbing in the blue, green, red, or infrared portion of the spectrum is present. For black-and-white imaging applications it is preferred that the photographic elements be orthochromatically or panchromatically sensitized to permit light to extend sensitivity within the visible spectrum. Radiant energy employed for exposure can be either noncoherent (random phase) or coherent (in phase), produced by lasers. Imagewise exposures at ambient, elevated or reduced temperatures and/or pressures, including high or low intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process,* 4th Ed., Macmillan, 1977, Chapters 4, 6, 17, 18, and 23.

The light-sensitive silver halide contained in the photographic elements can be processed following exposure to form a visible image by associating the silver halide with an aqueous alkaline medium in the presence of a developing agent contained in the medium or the element. Processing formulations and techniques are described in L. F. Mason, *Photographic Processing Chemistry,* Focal Press, London, 1966; *Processing Chemicals and Formulas,* Publication J-1, Eastman Kodak Company, 1973; *Photo-Lab Index,* Morgan and Morgan, Inc., Dobbs Ferry, New York, 1977, and *Neblette's Handbook of Photography and Reprography-Materials, Processes and Systems,* VanNostrand Reinhold Company, 7th Ed., 1977.

Included among the processing methods are web processing, as illustrated by Tregillus et al U.S. Pat. No. 3,179,517; stabilization processing, as illustrated by Herz et al U.S. Pat. No. 3,220,839, Cole U.S. Pat. No. 3,615,511, Shipton et al U.K. Pat. No. 1,258,906 and Haist et al U.S. Pat. No. 3,647,453; monobath processing as described in Haist, *Monobath Manual,* Morgan and Morgan, Inc., 1966, Schuler U.S. Pat. No. 3,240,603, Haist et al U.S. Pat. Nos. 3,615,513 and 3,628,955 and Price U.S. Pat. No. 3,723,126; infectious development, as illustrated by Milton U.S. Pat. Nos. 3,294,537, 3,600,174, 3,615,519 and 3,615,524, Whiteley U.S. Pat. No. 3,516,830, Drago U.S. Pat. No. 3,615,488, Salesin et al U.S. Pat. No. 3,625,689, Illingsworth U.S. Pat. No. 3,632,340, Salesin U.K. Pat. No. 1,273,030 and U.S. Pat. No. 3,708,303; hardening development, as illustrated by Allen et al U.S. Pat. No. 3,232,761; roller transport processing, as illustrated by Russell et al U.S. Pat. Nos. 3,025,779 and 3,515,556, Masseth U.S. Pat. No. 3,573,914, Taber et al U.S. Pat. No. 3,647,459 and Rees et al U.K. Pat. No. 1,269,268; alkaline vapor processing, as illustrated by *Product Licensing Index,* Vol. 97, May 1972, Item 9711, Goffe et al U.S. Pat. No. 3,816,136 and King U.S. Pat. No. 3,985,564; metal ion development as illustrated by Price, *Photographic Science and Engineering,* Vol. 19, Number 5, 1975, pp. 283–287 and Vought *Research Disclosure,* Vol. 150, October 1976, Item 15034; reversal processing, as illustrated by Henn et al U.S. Pat. No. 3,576,633; and surface application processing, as illustrated by Kitze U.S. Pat. No. 3,418,132.

Once a silver image has been formed in the photographic element, it is conventional practice to fix the undeveloped silver halide. The high aspect ratio tabular grain emulsions of the present invention are particularly advantageous in allowing fixing to be accomplished in a shorter time period. This allows processing to be accelerated.

d. Dye Imaging

The photographic elements and the techniques described above for producing silver images can be readily adapted to provide a colored image through the use of dyes. In perhaps the simplest approach to obtaining a projectable color image a conventional dye can be incorporated in the support of the photographic element, and silver image formation undertaken as described above. In areas where a silver image is formed the element is rendered substantially incapable of transmitting light therethrough, and in the remaining areas light is transmitted corresponding in color to the color of the support. In this way a colored image can be readily formed. The same effect can also be achieved by using a separate dye filter layer or element with a transparent support element.

The silver halide photographic elements can be used to form dye images therein through the selective destruction or formation of dyes. The photographic elements described above for forming silver images can be used to form dye images by employing developers containing dye image formers, such as color couplers, as illustrated by U.K. Pat. No. 478,984, Yager et al U.S. Pat. No. 3,113,864, Vittum et al U.S. Pat. Nos. 3,002,836, 2,271,238 and 2,362,598, Schwan et al U.S. Pat. No. 2,950,970, Carroll et al U.S. Pat. No. 2,592,243, Porter et al U.S. Pat. Nos. 2,343,703, 2,376,380 and 2,369,489, Spath U.K. Pat. No. 886,723 and U.S. Pat. No. 2,899,306, Tuite U.S. Pat. No. 3,152,896 and Mannes et al U.S. Pat. Nos. 2,115,394, 2,252,718 and 2,108,602, and Pilato U.S. Pat. No. 3,547,650. In this form the developer contains a color-developing agent (e.g., a primary aromatic amine) which in its oxidized form is capable of reacting with the coupler (coupling) to form the image dye.

The dye-forming couplers can be incorporated in the photographic elements, as illustrated by Schneider et al, *Die Chemie,* Vol. 57, 1944, p. 113, Mannes et al U.S. Pat. No. 2,304,940, Martinez U.S. Pat. No. 2,269,158, Jelley et al U.S. Pat. No. 2,322,027, Frolich et al U.S. Pat. No. 2,376,679, Fierke et al U.S. Pat. No. 2,801,171, Smith U.S. Pat. No. 3,748,141, Tong U.S. Pat. No. 2,772,163, Thirtle et al U.S. Pat. No. 2,835,579, Sawdey et al U.S. Pat. No. 2,533,514, Peterson U.S. Pat. No. 2,353,754, Seidel U.S. Pat. No. 3,409,435 and Chen *Research Disclosure,* Vol. 159, July 1977, Item 15930. The dye-forming couplers can be incorporated in different amounts to achieve differing photographic effects. For example, U.K. Pat. No. 923,045 and Kumai et al U.S. Pat. No. 3,843,369 teach limiting the concentration of coupler in relation to the silver coverage to less than normally employed amounts in faster and intermediate speed emulsion layers.

The dye-forming couplers are commonly chosen to form subtractive primary (i.e., yellow, magenta and cyan) image dyes and are nondiffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high-boiling organic (coupler) solvents. Such couplers are illustrated by Salminen et al U.S. Pat. Nos. 2,423,730, 2,772,162, 2,895,826, 2,710,803, 2,407,207, 3,737,316 and 2,367,531, Loria et al U.S. Pat. Nos. 2,772,161, 2,600,788, 3,006,759, 3,214,437 and 3,253,924, McCrossen et al U.S. Pat. No. 2,875,057, Bush et al U.S. Pat. No. 2,908,573, Gledhill et al U.S. Pat. No. 3,034,892, Weissberger et al U.S. Pat. Nos. 2,474,293, 2,407,210, 3,062,653, 3,265,506 and 3,384,657, Porter et al U.S. Pat. No. 2,343,703, Greenhalgh et al U.S. Pat. No. 3,127,269, Feniak et al U.S. Pat. Nos. 2,865,748, 2,933,391 and 2,865,751, Bailey et al U.S. Pat. No. 3,725,067, Beavers et al U.S. Pat. No. 3,758,308, Lau U.S. Pat. No. 3,779,763, Fernandez U.S. Pat. No. 3,785,829, U.K. Pat. No. 969,921, U.K. Pat. No. 1,241,069, U.K. Pat. No. 1,011,940, Vanden Eynde et al U.S. Pat. No. 3,762,921, Beavers U.S. Pat. No. 2,983,608, Loria U.S. Pat. Nos. 3,311,476, 3,408,194, 3,458,315, 3,447,928, 3,476,563, Cressman et al U.S. Pat. No. 3,419,390, Young U.S. Pat. No. 3,419,391, Lestina U.S. Pat. No. 3,519,429, U.K. Pat. No. 975,928, U.K. Pat. No. 1,111,554, Jaeken U.S. Pat. No. 3,222,176 and Canadian Pat. No. 726,651, Schulte et al U.K. Pat. No. 1,248,924 and Whitmore et al U.S. Pat. No. 3,227,550. Dye-forming couplers of differing reaction rates in single or separate layers can be employed to achieve desired effects for specific photographic applications.

The dye-forming couplers upon coupling can release photographically useful fragments, such as development inhibitors or accelerators, bleach accelerators, developing agents, silver halide solvents, toners, hardeners, fogging agents, antifoggants, competing couplers, chemical or spectral sensitizers and desensitizers. Development inhibitor-releasing (DIR) couplers are illustrated by Whitmore et al U.S. Pat. No. 3,148,062, Barr et al U.S. Pat. No. 3,227,554, Barr U.S. Pat. No. 3,733,201, Sawdey U.S. Pat. No. 3,617,291, Groet et al U.S. Pat. No. 3,703,375, Abbott et al U.S. Pat. No. 3,615,506, Weissberger et al U.S. Pat. No. 3,265,506, Seymour U.S. Pat. No. 3,620,745, Marx et al U.S. Pat. No. 3,632,345, Mader et al U.S. Pat. No. 3,869,291, U.K. Pat. No. 1,201,110, Oishi et al U.S. Pat. No. 3,642,485, Verbrugghe U.K. Pat. No. 1,236,767, Fujiwhara et al U.S. Pat. No. 3,770,436 and Matsuo et al U.S. Pat. No. 3,808,945. Dye-forming couplers and nondye-forming compounds which upon coupling release a variety of photographically useful groups are described by Lau U.S. Pat. No. 4,248,962. DIR compounds which do not form dye upon reaction with oxidized color-developing agents can be employed, as illustrated by Fujiwhara et al German OLS No. 2,529,350 and U.S. Pat. Nos. 3,928,041, 3,958,993 and 3,961,959, Odenwalder et al German OLS No. 2,448,063. Tanaka et al German OLS No. 2,610,546, Kikuchi et al U.S. Pat. No. 4,049,455 and Credner et al U.S. Pat. No. 4,052,213. DIR compounds which oxidatively cleave can be employed, as illustrated by Porter et al U.S. Pat. No. 3,379,529, Green et al U.S. Pat. No. 3,043,690, Barr U.S. Pat. No. 3,364,022, Duennebier et al U.S. Pat. No. 3,297,445 and Rees et al U.S. Pat. No. 3,287,129. Silver halide emulsions which are relatively light insensitive, such as Lippmann emulsions, have been utilized as interlayers and overcoat layers to prevent or control the migration of development inhibitor fragments as described in Shiba et al U.S. Pat. No. 3,892,572.

The photographic elements can incorporate colored dye-forming couplers, such as those employed to form integral masks for negative color images, as illustrated by Hanson U.S. Pat. No. 2,449,966, Glass et al U.S. Pat. No. 2,521,908, Gledhill et al U.S. Pat. No. 3,034,892, Loria U.S. Pat. No. 3,476,563, Lestina U.S. Pat. No. 3,519,429, Friedman U.S. Pat. No. 2,543,691, Puschel et al U.S. Pat. No. 3,028,238, Menzel et al U.S. Pat. No. 3,061,432 and Greenhalgh U.K. Pat. No. 1,035,959, and/or competing couplers, as illustrated by Murin et al U.S. Pat. No. 3,876,428, Sakamoto et al U.S. Pat. No. 3,580,722, Puschel U.S. Pat. No. 2,998,314, Whitmore U.S. Pat. No. 2,808,329, Salminen U.S. Pat. No. 2,742,832 and Weller et al U.S. Pat. No. 2,689,793.

The photographic elements can include image dye stabilizers. Such image dye stabilizers are illustrated by U.K. Pat. No. 1,326,889, Lestina et al U.S. Pat. Nos. 3,432,300 and 3,698,909, Stern et al U.S. Pat. No. 3,574,627, Brannock et al U.S. Pat. No. 3,573,050, Arai et al U.S. Pat. No. 3,764,337 and Smith et al U.S. Pat. No. 4,042,394.

Dye images can be formed or amplified by processes which employ in combination with a dye-image-generating reducing agent an inert transition metal ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent, as illustrated by Matejec U.S. Pat. No. 3,674,490, *Research Disclosure,* Vol. 116, December 1973, Item 11660, and Bissonette *Research Disclosure,* Vol. 148, August 1976, Items 14836, 14846 and 14847. The photographic elements can be particularly adapted to form dye images by such processes, as illustrated by Dunn et al U.S. Pat. No. 3,822,129, Bissonette U.S. Pat. Nos. 3,834,907 and 3,902,905, Bissonette et al U.S. Pat. No. 3,847,619 and Mowrey U.S. Pat. No. 3,904,413. Where the tabular grain silver halide emulsions of the present invention contain iodide, amplification reactions, particularly those utilizing iodide ions for catalyst poisoning, can be undertaken as taught by Maskasky U.S. Pat. Nos. 4,094,684 and 4,192,900, cited above and here incorporated by reference.

The photographic elements can produce dye images through the selective destruction of dyes or dye precursors, such as silver-dye-bleach processes, as illustrated by A. Meyer, *The Journal of Photographic Science,* Vol. 13, 1965, pp. 90–97. Bleachable azo, azoxy, xanthene, azine, phenylmethane, nitroso complex, indigo, quinone, nitrosubstituted, phthalocyanine and formazan dyes, as illustrated by Stauner et al U.S. Pat. No. 3,754,923, Piller et al U.S. Pat. No. 3,749,576, Yoshida et al U.S. Pat. No. 3,738,839, Froelich et al U.S. Pat. No. 3,716,368, Piller U.S. Pat. No. 3,655,388, Williams et al U.S. Pat. No. 3,642,482, Gilman U.S. Pat. No. 3,567,448, Loeffel U.S. Pat. No. 3,443,953, Anderau U.S. Pat. Nos. 3,443,952 and 3,211,556, Mory et al U.S. Pat. Nos. 3,202,511 and 3,178,291 and Anderau et al U.S. Pat. Nos. 3,178,285 and 3,178,290, as well as their hydrazo, diazonium and tetrazolium precursors and leuco and shifted derivatives, as illustrated by U.K. Pat. Nos. 923,265, 999,996 and 1,042,300, Pelz et al U.S. Pat. No. 3,684,513, Watanabe et al U.S. Pat. No. 3,615,493, Wilson et al U.S. Pat. No. 3,503,741, Boes et al U.S. Pat. No. 3,340,059, Gompf et al U.S. Pat. No. 3,493,372 and Puschel et al U.S. Pat. No. 3,561,970, can be employed.

It is common practice in forming dye images in silver halide photographic elements to remove the developed silver by bleaching. Such removal can be enhanced by incorporation of a bleach accelerator or a precursor thereof in a processing solution or in a layer of the element. In some instances the amount of silver formed by development is small in relation to the amount of dye produced, particularly in dye image amplification, as described above, and silver bleaching is omitted without substantial visual effect. In still other applications the silver image is retained and the dye image is intended to enhance or supplement the density provided by the image silver. In the case of dye enhanced silver imaging it is usually preferred to form a neutral dye or a combination of dyes which together produce a neutral image. Neutral dye-forming couplers useful for this purpose are disclosed by Pupo et al *Research Disclosure,* Vol. 162, October 1977, Item 16226. The enhancement of silver images with dyes in photographic elements intended for thermal processing is disclosed in *Research Disclosure,* Vol. 173, September 1973, Item 17326, and Houle U.S. Pat. No. 4,137,079. It is also possible to form monochromatic or neutral dye images using only dyes, silver being entirely removed from the image-bearing photographic elements by bleaching and fixing, as illustrated by Marchant et al U.S. Pat. No. 3,620,747.

The photographic elements can be processed to form dye images which correspond to or are reversals of the silver halide rendered selectively developable by imagewise exposure. Reversal dye images can be formed in photographic elements having differentially spectrally sensitized silver halide layers by black-and-white development followed by (i) where the elements lack incorporated dye image formers, sequential reversal color development with developers containing dye image formers, such as color couplers, as illustrated by Mannes et al U.S. Pat. No. 2,252,718, Schwan et al U.S. Pat. No. 2,950,970 and Pilato U.S. Pat. No. 3,547,650; (ii) where the elements contain incorporated dye image formers, such as color couplers, a single color development step, as illustrated by the Kodak Ektachrome E4 and E6 and Agfa processes described in *British Journal of Photography Annual,* 1977, pp. 194–197, and *British Journal of Photography,* Aug. 2, 1974, pp. 668–669; and (iii) where the photographic elements contain bleachable dyes, silver-dye-bleach processing, as illustrated by the Cibachrome P-10 and P-18 processes described in the *British Journal of Photography Annual,* 1977, pp. 209–212.

The photographic elements can be adapted for direct color reversal processing (i.e., production of reversal color images without prior black-and-white development), as illustrated by U.K. Pat. No. 1,075,385, Barr U.S. Pat. No. 3,243,294, Hendess et al U.S. Pat. No. 3,647,452, Puschel et al German Pat. No. 1,257,570 and U.S. Pat. Nos. 3,457,077 and 3,467,520, Accary-Venet et al U.K. Pat. No. 1,132,736, Schranz et al German Pat. No. 1,259,700, Marx et al German Pat. No. 1,259,701 and Muller-Bore German OLS No. 2,005,091.

Dye images which correspond to the silver halide rendered selectively developable by imagewise exposure, typically negative dye images, can be produced by processing, as illustrated by the Kodacolor C-22, the Kodak Flexicolor C-41 and the Agfacolor processes described in *British Journal of Photography Annual,* 1977, pp. 201–205. The photographic elements can also be processed by the Kodak Ektaprint-3 and -300 processes as described in Kodak Color Dataguide, 5th Ed., 1975, pp. 18–19, and the Agfa color process as described in *British Journal of Photography Annual,* 1977, pp. 205–206, such processes being particularly suited to processing color print materials, such as resin-coated photographic papers, to form positive dye images.

e. Partial grain development

It has been recognized and reported in the art that some photodetectors exhibit detective quantum efficiencies which are superior to those of silver halide photographic elements. A study of the basic properties of conventional silver halide photographic elements shows that this is largely due to the binary, on-off nature of individual silver halide grains, rather than their low quantum sensitivity. This is discussed, for example, by Shaw, "Multilevel Grains and the Ideal Photographic Detector", *Photographic Science and Engineering,* Vol. 16, No. 3, May/June 1972, pp. 192–200. What is meant by the on-off nature of silver halide grains is that once a latent image center is formed on a silver halide grain, the grain becomes entirely developable. Ordinarily development is independent of the amount of light which has struck the grain above a threshold, latent image forming amount. The silver halide grain produces exactly the same product upon development whether it has absorbed many photons and formed several latent image centers or absorbed only the minimum number of photons to produce a single latent image center.

Upon exposure by light, for instance, latent image centers are formed in and on the silver halide grains of the high aspect ratio tabular grain emulsions of this invention. Some grains may have only one latent image center, some many, and some none. However, the number of latent image centers formed is related to the amount of exposing radiation. Because the tabular grains can be relatively large in diameter and since their speed-granularity relationship can be high, particularly when formed of substantially optimally chemically and spectrally sensitized silver bromoiodide, their speed can be relatively high. Because the number of latent image centers in or on each grain is directly related to the amount of exposure that the grain has received, the potential is present for a high detective quantum efficiency, provided this information is not lost in development.

In a preferred form each latent image center is developed to increase its size without completely developing the silver halide grains. This can be undertaken by interrupting silver halide development at an earlier than usual stage, well before optimum development for ordinary photographic applications has been achieved. Another approach is to employ a DIR coupler and a color developing agent. The inhibitor released upon coupling can be relied upon to prevent complete development of the silver halide grains. In another approach to practicing this step self-inhibiting developers are employed. A self-inhibiting developer is one which initiates development of silver halide grains, but itself stops development before the silver halide grains have been entirely developed. Preferred developers of this type are self-inhibiting developers containing p-phenylenediamines, such as disclosed by Neuberger et al, "Anomalous Concentration Effect: An inverse Relationship Between the Rate of Development and Developer Concentration of Some p-Phenylenediamines", *Photographic Science and Engi-*

*neering,* Vol. 19, No. 6, Nov.-Dec. 1975, pp. 327–332. Whereas with interrupted development and development in the presence of DIR couplers silver halide grains having a longer development induction period than adjacent developing grains can be entirely precluded from development, the use of a self-inhibiting developer has the advantage that development of an individual silver halide grain is not inhibited until after some development of that grain has occurred. It is also recognized that differences in the developability of the epitaxial silver salt and the silver halide forming the host tabular grains can be relied upon to obtain or aid in obtaining partial grain development. Maskasky U.S. Pat. No. 4,094,684 discloses techniques for obtaining parallel grain development by selection of developing agents and development conditions.

Development enhancement of the latent image centers produces a plurality of silver specks. These specks are proportional in size and number to the degree of exposure of each grain. Inasmuch as the preferred self-inhibiting developers contain color developing agent, the oxidized developing agent produced can be reacted with a dye-forming coupler to create a dye image. However, since only a limited amount of silver halide is developed, the amount of dye which can be formed in this way is also limited. An approach which removes any such limitation on maximum dye density formation, but which retains the proportionality of dye density to the degree of exposure is to employ a silver catalyzed oxidation-reduction reaction using a peroxide or transition metal ion complex as an oxidizing agent and a dye-image-generating reducing agent, such as a color developing agent, as illustrated by the patents cited above of Bissonette, Travis, Dunn et al, Matejec, and Mowrey and the accompanying publications. In these patents it is further disclosed that where the silver halide grains form surface latent image centers the centers can themselves provide sufficient silver to catalyze a dye image amplification reaction. Accordingly, the step of enhancing the latent image by development is not absolutely essential, although it is preferred. In the preferred form any visible silver remaining in the photographic element after forming the dye image is removed by bleaching, as is conventional in color photography.

The resulting photographic image is a dye image which exhibits a point-to-point dye density which is proportional to the amount of exposing radiation. The result is that the detective quantum efficiency of the photographic element is quite high. High photographic speeds are readily obtainable, although oxidation reduction reactions as described above can contribute in increased levels of graininess.

Graininess can be reduced by employing a microcellular support as taught by Whitmore PCT application W080/01614, cited above. The sensation of graininess is created not just by the size of individual image dye clouds, but also by the randomness of their placement. By coating the emulsions in a regular array of microcells formed by the support and smearing the dye produced in each microcell so that it is uniform throughout, a reduced sensation of graininess can be produced.

Although partial grain development has been described above with specific reference to forming dye images, it can be applied to forming silver images as well. In developing to produce a silver image for viewing the graininess of the silver image can be reduced by terminating development before grains containing latent image sites have been completely developed. Since a greater number of silver centers or specks can be produced by partial grain development than by whole grain development, the sensation of graininess at a given density is reduced. (A similar reduction in graininess can also be achieved in dye imaging using incorporated couplers by limiting the concentration of the coupler so that it is present in less than its normally employed stoichiometric relationship to silver halide.) Although silver coverages in the photographic element must be initially higher to permit partial grain development to achieve maximum density levels comparable to those of total grain development, the silver halide that is not developed can be removed by fixing and recovered; hence the net consumption of silver need not be increased.

By employing partial grain development in silver imaging of photographic elements having microcellular supports it is possible to reduce silver image graininess similarly as described above in connection with dye imaging. For example, if a silver halide emulsion according to the present invention is incorporated in an array of microcells on a support and partially developed after imagewise exposure, a plurality of silver specks are produced proportional to the quanta of radiation received on exposure and the number of latent image sites formed. Although the covering power of the silver specks is low in comparison to that achieved by total grain development, it can be increased by fixing out undeveloped silver halide, rehalogenating the silver present in the microcells, and then physically developing the silver onto a uniform coating of physical development nuclei contained in the microcells. Since silver physically developed onto fine nuclei can have a much higher density than chemically developed silver, a much higher maximum density is readily obtained. Further, the physically developed silver produces a uniform density within each microcell. This produces a reduction in graininess, since the random occurrence of the silver density is replaced by the regularity of the microcell pattern.

f. Sensitivity as a function of spectral region

When the high aspect ratio tabular grain emulsions of the present invention are substantially optimally sensitized as described above within a selected spectral region and the sensitivity of the emulsion within that spectral region is compared to a spectral region to which the emulsion would be expected to possess native sensitivity by reason of its halide composition, it has been observed that a much larger sensitivity difference exists than has heretofore been observed in conventional emulsions. Inadequate separation of blue and green or red sensitivities of silver bromide and silver bromoiodide emulsions has long been a disadvantage in multicolor photography. The advantageous use of the spectral sensitivity differences of the silver bromide and bromoiodide emulsions of this invention are illustrated below with specific reference to multicolor photographic elements. It is to be recognized, however, that this is but an illustrative application. The increased spectral sensitivity differences exhibited by the emulsions of the present invention are not limited to multicolor photography or to silver bromide or bromiodide emulsions. It can be appreciated that the spectral sensitivity differences of the emulsions of this invention can be observed in single emulsion layer photographic elements. Further, advantages of increased spectral sensitivity differences can in varied applications be realized with emulsions of any halide composition known to be useful in photography. For example, while silver chloride and chlorobromide emulsions are known to possess sufficiently low native blue sensitivity that they can be used to record green or red light in multicolor photography without protection from blue light exposure, there are advantages in other applications for increasing the sensitivity difference between different spectral regions. For example, if a high aspect ratio tabular grain silver chloride emulsion is sensitized to infrared radiation and imagewise exposed in the spectral region of sensitization, it can thereafter be processed in light with less increase in minimum density levels because of the reduced sensitivity of the emulsions according to the invention in spectral regions free of spectral sensitization. From the foregoing other applications for the high aspect ratio tabular grain emulsions of the present invention permitting their large differences in sensitivity as a function of spectral region to be advantageously employed will be readily suggested to those skilled in the art.

g. Multicolor photography

The present invention can be employed to produce multicolor photographic images. Generally any conventional multicolor imaging element containing at least one silver halide emulsion layer can be improved merely by adding or substituting a high aspect ratio tabular grain emulsion according to the present invention. The present invention is fully applicable to both additive multicolor imaging and subtractive multicolor imaging.

To illustrate the application of this invention to additive multicolor imaging, a filter array containing interlaid blue, green, and red filter elements can be employed in combination with a photographic element according to the present invention capable of producing a silver image. A high aspect ratio tabular grain emulsion of the present invention which is panchromatically sensitized and which forms a layer of the photographic element is imagewise exposed through the additive primary filter array. After processing to produce a silver image and viewing through the filter array, a multicolor image is seen. Such images are best viewed by projection. Hence both the photographic element and the filter array both have or share in common a transparent support.

Significant advantages can be realized by the application of this invention to multicolor photographic elements which produce multicolor images from combinations of subtractive primary imaging dyes. Such photographic elements are comprised of a support and typically at least a triad of superimposed silver halide emulsion layers for separately recording blue, green, and red exposures as yellow, magenta, and cyan dye images, respectively. Although the present invention generally embraces any multicolor photographic element of this type including at least one high aspect ratio tabular grain silver halide emulsion, additional advantages can be realized when high aspect ratio tabular grain silver bromide and bromoiodide emulsions are employed. Consequently, the following description is directed to certain preferred embodiments incorporating silver bromide and bromoiodide emulsions, but high aspect ratio tabular grain emulsions of any halide composition can be substituted, if desired. Except as specifically otherwise described, the multicolor photographic elements can incorporate the features of the photographic elements described previously.

In a specific preferred form of the invention a minus blue sensitized high aspect ratio tabular grain silver bromide or bromoiodide emulsion according to the invention forms at least one of the emulsion layers intended to record green or red light in a triad of blue, green, to red recording emulsion layers of a multicolor photographic element and is positioned to receive during exposure of the photographic element to neutral light at 5500° K. blue light in addition to the light the emulsion is intended to record. The relationship of the blue and minus blue light the layer receives can be expressed in terms of $\Delta$ log E, where $$\Delta \log E = \log E_T - \log E_B$$

log $E_T$ being the log of exposure to green or red light the tabular grain emulsion is intended to record and log $E_B$ being the log of concurrent exposure to blue light the tabular grain emulsion also receives. (In each occurrence exposure, E, is in meter-candle-seconds, unless otherwise indicated.)

In the practice of the present invention $\Delta$ log E can be a positive value less than 0.7 (preferably less than 0.3) while still obtaining acceptable image replication of a multicolor subject. This is surprising in view of the high proportion of grains present in the emulsions of the present invention having an average diameter of greater than 0.7 micron. If a comparable nontabular or lower aspect ratio tabular grain emulsion of like halide composition and average grain diameter is substituted for a high aspect ratio tabular grain silver bromide or bromoiodide emulsion of the present invention a higher and usually unacceptable level of color falsification will result. It is known in the art that color falsification by green or red sensitized silver bromide and bromoiodide emulsions can be reduced by reduction of average grain diameters, but this results in limiting maximum achievable photographic speeds as well. The present invention achieves not only advantageous separation in blue and minus blue speeds, but is able to achieve this advantage without any limitation on maximum realizable minus blue photographic speeds. In a specific preferred form of the invention at least the minus blue recording emulsion layers are silver bromide or bromoiodide emulsions according to the present invention. It is specifically contemplated that the blue recording emulsion layer of the triad can advantageously also be a high aspect ratio tabular grain emulsion according to the present invention. In a specific preferred form of the invention the tabular grains present in each of the emulsion layers of the triad having a thickness of less than 0.3 micron have an average grain diameter of at least 1.0 micron, preferably at least 2.0 microns. In a still further preferred form of the invention the multicolor photographic elements can be assigned as ISO speed exposure index of at least 180.

The multicolor photographic elements of the invention need contain no yellow filter layer positioned between the exposure source and the high aspect ratio tabular grain green and/or red emulsion layers to protect these layers from blue light exposure, or the yellow filter layer, if present, can be reduced in density to less than any yellow filter layer density heretofore employed to protect from blue light exposure red or green recording emulsion layers of photographic elements intended to be exposed in daylight. In one specifically preferred form of the invention no blue recording emulsion layer is interposed between the green and/or red recording emulsion layers of the triad and the source of exposing radiation. Therefore the photographic element is substantially free of blue absorbing material between the green and/or red emulsion layers and incident exposing radiation. If, in this instance, a yellow filter layer is interposed between the green and/or red recording emulsion layers and incident exposing radiation, it accounts for all for the interposed blue density.

Although only one green or red recording high aspect ratio tabular grain silver bromide or bromoiodide emulsion as described above is required, the multicolor photographic element contains at least three separate emulsions for recording blue, green, and red light, respectively. The emulsions other than the required high aspect ratio tabular grain green or red recording emulsion can be of any convenient conventional form. Various conventional emulsions are illustrated by *Research Disclosure,* Item 17643, cited above, Paragraph I, Emulsion preparation and types, here incorporated by reference. In a preferred form of the invention all of the emulsion layers contain silver bromide or bromoiodide host tabular grains. In a particularly preferred form of the invention at least one green recording emulsion layer and at least one red recording emulsion layer is comprised of a high aspect ratio tabular grain emulsion according to this invention. If more than one emulsin layer is provided to record in the green and/or red portion of the spectrum, it is preferred that at least the faster emulsion layer contain high aspect ratio tabular grain emulsion as described above. It is, of course, recognized that all of the blue, green, and red recording emulsion layers of the photographic element can advantageously be tabular as described above, if desired, although this is not required for the practice of this invention.

The present invention is fully applicable to multicolor photographic elements as described above in which the speed and contrast of the blue, green, and red recording emulsion layers vary widely. The relative blue insensitivity of green or red spectrally sensitized high aspect ratio tabular grain silver bromide or silver bromoiodide emulsion layers employed in this invention allow green and/or red recording emulsion layers to be positioned at any location within a multicolor photographic element independently of the remaining emulsion layers and without taking any conventional precautions to prevent their exposure by blue light.

The present invention is particularly applicable to multicolor photographic elements intended to replicate colors accurately when exposed in daylight. Photographic elements of this type are characterized by producing blue, green, and red exposure records of substantially matched contrast and limited speed variation when exposed to a 5500° K. (daylight) source. The term "substantially matched contrast" as employed herein means that the blue, green, and red records differ in contrast by less than 20 (preferably less than 10) percent, based on the contrast of the blue record. The limited speed variation of the blue, green, and red records can be expressed as a speed variation ($\Delta$ log E) of less than 0.3 log E, where the speed variation is the larger of the differences between the speed of the green or red record and the speed of the blue record.

Both contrast and log speed measurements necessary for determining these relationships of the photographic elements of the invention can be determined by exposing a photographic element at a color temperature of 5500° K. through a spectrally nonselective (neutral density) step wedge, such as a carbon test object, and processing the photographic element, preferably under the processing conditions contemplated in use. By measuring the blue, green, and red densities of the photographic element to transmission of blue light of 435.8 nm in wavelength, green light of 546.1 nm in wavelength, and red light of 643.8 nm in wavelength, as described by American Standard PH2.1-1952, published by American National Standards Institute (ANSI), 1430 Broadway, New York, N.Y. 10018, blue, green, and red characteristic curves can be plotted for the photographic element. If the photographic element has a reflective support rather than a transparent support, reflection densities can be substituted for transmission densities. From the blue, green, and red characteristic curves speed and constrast can be ascertained by procedures well known to those skilled in the art. The specific speed and contrast measurement procedure followed is of little significance, provided each of the blue, green, and red records are identically measured for purposes of comparison. A variety of standard sensitometric measurement procedures for multicolor photographic elements intended for differing photographic applications have been published by ANSI. The following are representative: American Standard PH2.21-1979, PH2.47-1979, and PH2.27-1979.

The multicolor photographic elements of this invention capable of replicating accurately colors when exposed in daylight offer significant advantages over conventional photographic elements exhibiting these characteristics. In the photographic elements of the invention the limited blue sensitivity of the green and red spectrally sensitized tabular silver bromide or bromoiodide emulsion layers can be relied upon to separate the blue speed of the blue recording emulsion layer and the blue speed of the minus blue recording emulsion layers. Depending upon the specific application, the use of tabular grains in the green and red recording emulsion layers can in and of itself provide a desirable large separation in the blue response of the blue and minus blue recording emulsion layers.

In some applications it may be desirable to increase further blue speed separations of blue and minus blue recording emulsion layers by employing conventional blue speed separation techniques to supplement the blue speed separations obtained by the presence of the high aspect ratio tabular grains. For example, if a photographic element places the fastest green recording emulsion layer nearest the exposing radiation source and the fastest blue recording emulsion layer farthest from the exposing radiation source, the separation of the blue speeds of the blue and green recording emulsion layers, though a full order of magnitude (1.0 log E) different when the emulsions are separately coated and exposed, may be effectively reduced by the layer order arrangement, since the green recording emulsion layer receives all of the blue light during exposure, but the green recording emulsion layer and other overlying layers may absorb or reflect some of the blue light before it reaches the blue recording emulsion layer. In such circumstance employing a higher proportion of iodide in the blue recording emulsion layer can be relied upon to supplement the tabular grains in increasing the blue speed separation of the blue and minus blue recording emulsion layers. When a blue recording emulsion layer is nearer the exposing radiation source than the minus blue recording emulsion layer, a limited density yellow filter material coated between the blue and minus blue recording emulsion layers can be employed to increase blue and minus blue separation. In no instance, however, is it necessary to make use of any of these conventional speed separation techniques to the extent that they in themselves provide an order of magnitude difference in the blue speed separation or an approximation thereof, as has heretofore been required in the art (although this is not precluded if exceptionally large blue and minus blue speed separation is desired for a specific application). Thus, the present invention achieves the objectives for multicolor photographic elements intended to replicate accurately image colors when exposed under balanced lighting conditions while permitting a much wider choice in element construction than has heretofore been possible.

Multicolor photographic elements are often described in terms of color-forming layer units. Most commonly multicolor photographic elements contain three superimposed color-forming layer units each containing at least one silver halide emulsion layer capable of recording exposure to a different third of the spectrum and capable of producing a complementary subtractive primary dye image. Thus, blue, green, and red recording color-forming layer units are used to produce yellow, magenta, and cyan dye images, respectively. Dye imaging materials need not be present in any color-forming layer unit, but can be entirely supplied from processing solutions. When dye imaging materials are incorporated in the photographic element, they can be located in an emulsion layer or in a layer located to receive oxidized developing or electron transfer agent from and adjacent emulsion layer of the same color-forming layer unit.

To prevent migration of oxidized developing or electron transfer agents between color-forming layer units with resultant color degradation, it is common practice to employ scavengers. The scavengers can be located in the emulsion layers themselves, as taught by Yutzy et al U.S. Pat. No. 2,937,086 and/or in interlayers beween adjacent color-forming layer units, as illustrated by Weissberger et al U.S. Pat. No. 2,336,327.

Although each color-forming layer unit can contain a single emulsion layer, two, three, or more emulsion layers differing in photographic speed are often incorporated in a single color-forming layer unit. Where the desired layer order arrangement does not permit multiple emulsion layers differing in speed to occur in a single color-forming layer unit, it is common practice to provide multiple (usually two or three) blue, green, and/or red recording color-forming layer units in a single photographic element.

It is a unique feature of this invention that at least one green or red recording emulsion layer containing tabular silver bromide or bromoiodide grains as described above is located in the multicolor photographic element to receive an increased proportion of blue light during imagewise exposure of the photographic element. The increased proportion of blue light reaching the high aspect ratio tabular grain emulsion layer can result from reduced blue light absorption by an overlying yellow filter layer or, preferably, elimination of overlying yellow filter layers entirely. The increased proportion of blue light reaching the high aspect ratio tabular emulsion layer can result also from repositioning the color-forming layer unit in which it is contained nearer to the source of exposing radiation. For example, green and red recording color-forming layer units containing green and red recording high aspect ratio tabular emulsions, respectively, can be positioned nearer to the source of exposing radiation than a blue recording color-forming layer unit.

The multicolor photographic elements of this invention can take any convenient form consistent with the requirements indicated above. Any of the six possible layer arrangements of Table 27a, p. 211, disclosed by Gorokhovskii, *Spectral Studies of the Photographic Process,* Focal Press, New York, can be employed. To provide a simple, specific illustration, it is contemplated to add to a conventional multicolor silver halide photographic element during its preparation one or more high aspect ratio tabular grain emulsion layers sensitized to the minus blue portion of the spectrum and positioned to receive exposing radiation prior to the remaining emulsion layers. However, in most instances it is preferred to substitute one or more minus blue recording high aspect ratio tabular grain emulsion layers for conventional minus blue recording emulsion layers, optionally in combination with layer order arrangement modifications. The invention can be better appreciated by reference to the following preferred illustrative forms.

| Layer Order Arrangement I |
|---|
| Exposure |
| ↓ |
| B |
| IL |
| TG |
| IL |
| TR |

| Layer Order Arrangement II |
|---|
| Exposure |
| ↓ |
| TFB |
| IL |
| TFG |
| IL |
| TFR |
| IL |
| SB |
| IL |
| SG |
| IL |
| SR |

| Layer Order Arrangement III |
|---|
| Exposure |
| ↓ |
| TG |
| IL |
| TR |
| IL |
| B |

| Layer Order Arrangement IV |
|---|
| Exposure |
| ↓ |
| TFG |
| IL |
| TFR |
| IL |
| TSG |
| IL |
| TSR |
| IL |
| B |

| Layer Order Arrangement V |
|---|
| Exposure |
| ↓ |
| TFG |
| IL |
| TFR |
| IL |
| TFB |
| IL |

-continued

TSG
IL
TSR
IL
SB

Layer Order Arrangement VI

Exposure
↓
TFR
IL
TB
IL
TFG
IL
TFR
IL
SG
IL
SR

Layer Order Arrangement VII

Exposure
↓
TFR
IL
TFG
IL
TB
IL
TFG
IL
TSG
IL
TFR
IL
TSR where

B, G, and R designate blue, green, and red recording color-forming layer units, respectively, of any conventional type;

T appearing before the color-forming layer unit B, G, or R indicates that the emulsion layer or layers contain a high aspect ratio tabular grain silver bromide or bromoiodide emulsions, as more specifically described above, F appearing before the color-forming layer unit B, G, or R indicates that the color-forming layer unit is faster in photographic speed than at least one other color-forming layer unit which records light exposure in the same third of the spectrum in the same Layer Order Arrangement;

S appearing before the color-forming layer unit B, G, or R indicates that the color-forming layer unit is slower in photographic speed than at least one other color-forming layer unit which records light exposure in the same third of the spectrum in the same Layer Order Arrangement; and IL designates an interlayer containing a scavenger, but substantially free of yellow filter material. Each faster or slower color-forming layer unit can differ in photographic speed from another color-forming layer unit which records light exposure in the same third of the spectrum as a result of its position in the Layer Order Arrangement, its inherent speed particles, or a combination of both.

In Layer Order Arrangements I through VII, the location of the support is not shown. Following customary practice, the support will in most instances be positioned farthest from the source of exposing radiation—that is, beneath the layers as shown. If the support is colorless and specularly transmissive—i.e., transparent, it can be located between the exposure source and the indicated layers. Stated more generally, the support can be located between the exposure source and any color-forming layer unit intended to record light to which the support is transparent.

Turning first to Layer Order Arrangement I, it can be seen that the photographic element is substantially free of yellow filter material. However, following conventional practice for elements containing yellow filter material, the blue recording color-forming layer unit lies nearest the source of exposing radiation. In a simple form each color-forming layer unit is comprised of a single silver halide emulsion layer. In another form each color-forming layer unit can contain two, three, or more different silver halide emulsion layers. When a triad of emulsion layers, one of highest speed from each of the color-forming layer units, are compared, they are preferably substantially matched in contrast and the photographic speed of the green and red recording emulsion layers differ from the speed of the blue recording emulsion layer by less than 0.3 log E. When there are two, three, or more different emulsion layers differing in speed in each color-forming layer unit, there are preferably two, three, or more triads of emulsion layers in Layer Order Arrangement I having the stated contrast and speed relationship. The absence of yellow filter material beneath the blue recording color-forming unit increases the photographic speed of this unit.

It is not necessary that the interlayers be substantially free of yellow filter material in Layer Order Arrangement I. Less than conventional amounts of yellow filter material can be located between the blue and green recording color-forming units without departing from the teachings of this invention. Further, the interlayer separating the green and red recording color-forming layer units can contain up to conventional amounts of yellow filter material without departing from the invention. Where conventional amounts of yellow filter material are employed, the red recording color-forming unit is not restricted to the use of tabular silver bromide or bromoiodide grains, as described above, but can take any conventional form, subject to the contrast and speed considerations indicated.

To avoid repetition, only features that distinguish Layer Order Arrangements II through VII from Layer Order Arrangement I are specifically discussed. In Layer Order Arrangement II, rather than incorporate faster and slower blue, red, or green recording emulsion layers in the same color-forming layer unit, two separate blue, green, and red recording color-forming layer units are provided. Only the emulsion layer or layers of the faster color-forming units need contain tabular silver bromide or bromoiodide grains, as described above. The slower green and red recording color-forming layer units because of their slower speeds as well as the overlying faster blue recording color-forming layer unit, are adequately protected from blue light exposure without employing a yellow filter material. The use of high aspect ratio tabular grain silver bromide or bromoiodide emulsions in the emulsion layer or layers of the slower green and/or red recording color-forming layer units is, of course, not precluded. In placing the faster red recording color-forming layer unit above the slower green recording color-forming layer unit, increased speed can be realized, as taught by Eeles et al U.S. Pat. No. 4,184,876, Ranz et al German OLS No. 2,704,797, and Lohman et al German OLS Nos. 2,622,923, 2,622,924, and 2,704,826.

Layer Order Arrangement III differs from Layer Order Arrangement I in placing the blue recording color-forming layer unit farthest from the exposure source. This then places the green recording color-forming layer unit nearest and the red recording color-forming layer unit nearer the exposure source. This arrangement is highly advantageous in producing sharp, high quality multicolor images. The green recording color-forming layer unit, which makes the most important visual contribution to multicolor imaging, as a result of being located nearest the exposure source is capable of producing a very sharp image, since there are no overlying layers to scatter light. The red recording color-forming layer unit, which makes the next most important visual contribution to the multicolor image, receives light that has passed through only the green recording color-forming layer unit and has therefore not been scattered in a blue recording color-forming layer unit. Though the blue recording color-forming layer unit suffers in comparison to Layer Order Arrangement I, the loss of sharpness does not offset the advantages realized in the green and red recording color-forming layer units, since the blue recording color-forming layer unit makes by far the least significant visual contribution to the multicolor image produced.

Layer Order Arrangement IV expands Layer Order Arrangement III to include green and red recording color-forming layer units containing separate faster and slower high aspect ratio tabular grain emulsions. Layer Order Arrangement V differs from Layer Order Arrangement IV in providing an additional blue recording color-forming layer unit above the slower green, red, and blue recording color-forming layer units. The faster blue recording color-forming layer unit employs high aspect ratio tabular grain silver bromide or bromoiodide emulsion, as described above. The faster blue recording color-forming layer unit in this instance acts to absorb blue light and therefore reduces the proportion of blue light reaching the slower green and red recording color-forming layer units. In a variant form, the slower green and red recording color-forming layer units need not employ high aspect ratio tabular grain emulsions.

Layer Order Arrangement VI differs from Layer Order Arrangement IV in locating a tabular grain blue recording color-forming layer unit between the green and red recording color-forming layer units and the source of exposing radiation. As is pointed out above, the tabular grain blue recording color-forming layer unit can be comprised of one or more tabular grain blue recording emulsion layers and, where multiple blue recording emulsion layers are present, they can differ in speed. To compensate for the less favored position the red recording color-forming layer units would otherwise occupy, Layer Order Arrangement VI also differs from Layer Order Arrangement IV in providing a second fast red recording color-forming layer unit, which is positioned between the tabular grain blue recording color-forming layer unit and the source of exposing radiation. Because of the favored location which the second tabular grain fast red recording color-forming layer unit occupies it is faster than the first fast red recording layer unit if the two fast red-recording layer units incorporate identical emulsions. It is, of course, recognized that the first and second fast tabular grain red recording color-forming layer units can, if desired, be formed of the same or different emulsions and that their relative speeds can be adjusted by techniques well known to those skilled in the art. Instead of employing two fast red recording layer units, as shown, the second fast red recording layer unit can, if desired, be replaced with a second fast green recording color-forming layer unit. Layer Order Arrangement VII can be identical to Layer Order Arrangement VI, but differs in providing both a second fast tabular grain red recording color-forming layer unit and a second fast tabular grain green recording color-forming layer unit interposed between the exposing radiation source and the tabular grain blue recording color-forming layer unit.

There are, of course, many other advantageous layer order arrangements possible, Layer Order Arrangements I through VII being merely illustrative. In each of the various Layer Order Arrangements corresponding green and red recording color-forming layer units can be interchanged—i.e., the faster red and green recording color-forming layer units can be interchanged in position in the various layer order arrangements and additionally or alternatively the slower green and red recording color-forming layer units can be interchanged in position.

Although photographic emulsions intended to form multicolor images comprised of combinations of subtractive primary dyes normally take the form of a plurality of superimposed layers containing incorporated dye-forming materials, such as dye-forming couplers, this is by no means required. Three color-forming components, normally referred to as packets, each containing a silver halide emulsion for recording light in one third of the visible spectrum and a coupler capable of forming a complementary subtractive primary dye, can be placed together in a single layer of a photographic element to produce multicolor images. Exemplary mixed packet multicolor photographic elements are disclosed by Godowsky U.S. Pat. Nos. 2,698,794 and 2,843,489. Although discussion is directed to the more common arrangement in which a single color-forming layer unit produces a single subtractive primary dye, relevance to mixed packet multicolor photographic elements will be readily apparent.

It is the relatively large separation in the blue and minus blue sensitivities of the green and red recording color-forming layer units containing tabular grain silver bromide or bromoiodide emulsions that permits reduction or elimination of yellow filter materials and/or the employment of novel layer order arrangements. One technique that can be employed for providing a quantitative measure of the relative response of green and red recording color-forming layer units to blue light in multicolor photographic elements is to expose through a step tablet a sample of a multicolor photographic element according to this invention employing first a neutral exposure source—i.e., light at 5500° K.—and thereafter to process the sample. A second sample is then identically exposed, except for the interposition of a Wratten 98 filter, which transmits only light between 400 and 490 nm, and thereafter identically processed. Using blue, green, and red transmission densities determined according to American Standard PH2.1-1952, as described above, three dye characteristic curves can be plotted for each sample. The difference in blue speed of the blue recording color-forming layer unit(s) and the blue speed of the green or red recording color-forming layer unit(s) can be determined from the relationship:

$$(B_{W98}-G_{W98})-(B_N-G_N) \text{ or} \quad (A)$$

$$(B_{W98}-R_{W98})-(B_N-R_N) \quad (B)$$

where $B_{W98}$ is the blue speed of the blue recording color-forming layer unit(s) exposed through the Wratten 98 filter;

$G_{W98}$ is the blue speed of the green recording color-forming layer unit(s) exposed through the Wratten 98 filter;

$R_{W98}$ is the blue speed of the red recording color-forming layer unit(s) exposed through the Wratten 98 filter;

$B_N$ is the blue speed of the blue recording color-forming layer unit(s) exposed to neutral (5500° K.) light;

$G_N$ is the green speed of the green recording color-forming layer unit(s) exposed to neutral (5500° K.) light; and $R_N$ is the red speed of the red recording color-forming layer unit(s) exposed to neutral (5500° K.) light.

(The above description imputes blue, green, and red densities to the blue, green, and red recording color-forming layer units, respectively, ignoring unwanted spectral absorption by the yellow, magenta, and cyan dyes. Such unwanted spectral absorption is rarely of sufficient magnitude to affect materially the results obtained for the purposes they are here employed.)

The multicolor photographic elements of the present invention in the absence of any yellow filter material exhibit a blue speed by the blue recording color-forming layer units which is at least 6 times, preferably at least 8 times, and optimally at least 10 times the blue speed of green and/or red recording color-forming layer units containing high aspect ratio tabular grain emulsions, as described above.

Another measure of the large separation in the blue and minus blue sensitivities of the multi-color photographic elements of the present invention is to compare the green speed of a green recording color-forming layer unit or the red speed of a red recording color-forming layer unit to its blue speed. The same exposure and processing techniques described above are employed, except that the neutral light exposure is changed to a minus blue exposure by interposing a Wratten 9 filter, which transmits only light beyond 490 nm. The quantitative difference being determined is $$G_{W9}-G_{W98} \text{ or} \quad (C)$$

$$R_{W9}-R_{W98} \quad (D)$$

where $G_{W98}$ and $R_{W98}$ are defined above;

$G_{W9}$ is the green speed of the green recording color-forming layer unit(s) exposed through the Wratten 9 filter; and $R_{W9}$ is the red speed of the red recording color-forming layer unit(s) exposed through the Wratten 9 filter. (Again unwanted spectral absorption by the dyes is rarely material and is ignored.)

Red and green recording color-forming layer units containing tabular silver bromide or bromoiodide emulsions, as described above, exhibit a difference between their speed in the blue region of the spectrum and their speed in the portion of the spectrum to which they are spectrally sensitized (i.e., a difference in their blue and minus blue speeds) of at least 10 times (1.0 log E), preferably at least 20 times (1.3 log E).

In comparing the quantitative relationships A to B and C to D for a single layer order arrangement, the results will not be identical, even if the green and red recording color-forming layer units are identical (except for their wavelengths of spectral sensitization). The reason is that in most instances the red recording color-forming layer unit(s) will be receiving light that has already passed through the corresponding green recording color-forming layer unit(s). However, if a second layer order arrangement is prepared which is identical to the first, except that the corresponding green and red recording color-forming layer units have been interchanged in position, then the red recording color-forming layer unit(s) of the second layer order arrangement should exhibit substantially identical values for relationships B and D that the green recording color-forming layer units of the first layer order arrangement exhibit for relationships A and C, respectively. Stated more succinctly, the mere choice of green spectral sensitization as opposed to red spectral sensitization does not significantly influence the values obtained by the above quantitative comparisons. Therefore, it is common practice not to differentiate green and red speeds in comparision to blue speed, but to refer to green and red speeds generically as minus blue speeds.

h. Reduced high-angle scattering

The high aspect ratio tabular grain emulsions of the present invention are advantageous because of their reduced high angle light scattering as compared to nontabular and lower aspect ratio tabular grain emulsions.

Figure 4:
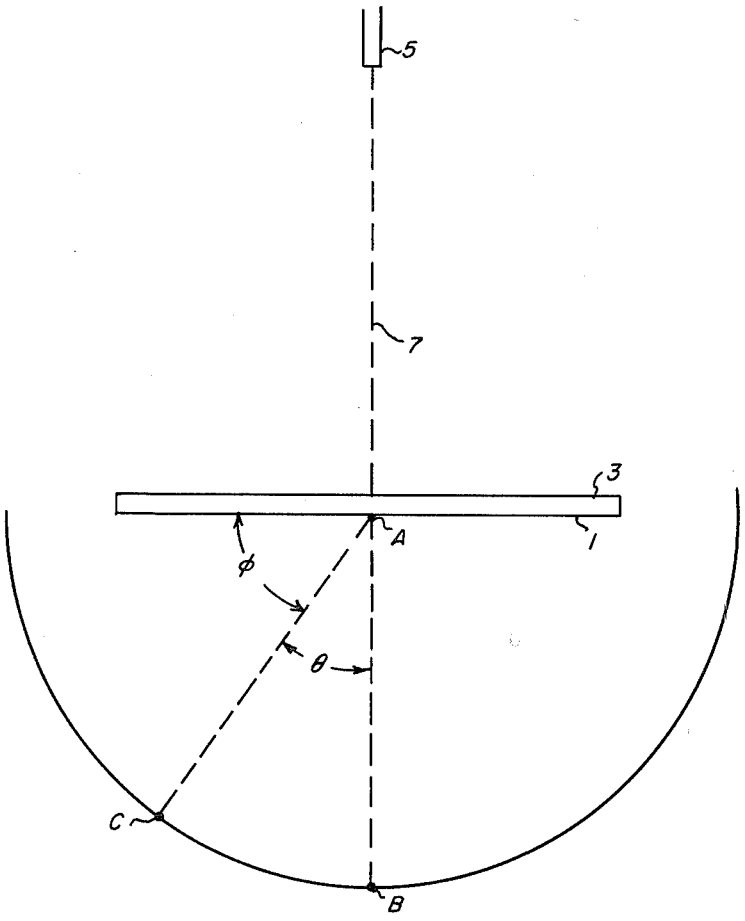
FIG. 4 is a schematic diagram intended to illustrate quantitative determinations of light scattering.

This can be quantitatively demonstrated. Referring to FIG. 4, a sample of an emulsion 1 according to the present invention is coated on a transparent (specularly transmissive) support 3 at a silver coverage of 1.08 g/m$^2$. Although not shown, the emulsion and support are preferably immersed in a liquid having a substantially matched refractive index to minimize Fresnel reflections at the surfaces of the support and the emulsion. The emulsion coating is exposed perpendicular to the support plane by a collimated light source 5. Light from the source following a path indicated by the dashed line 7, which forms an optical axis, strikes the emulsion coating at point A. Light which passes through the support and emulsion can be sensed at a constant distance from the emulsion at a hemispherical detection surface 9. At a point B, which lies at the intersection of the extension of the initial light path and the detection surface, light of a maximum intensity level is detected.

An arbitrarily selected point C is shown in FIG. 4 on the detection surface. The dashed line between A and C forms an angle $\phi$ with the emulsion coating. By moving point C on the detection surface it is possible to vary $\phi$ from 0° to 90°. By measuring the intensity of the light scattered as a function of the angle $\phi$ it is possible (because of the rotational symmetry of light scattering about the optical axis 7) to determine the cumulative light distribution as a function of the angle $\phi$. (For a background description of the cumulative light distribution see DePalma and Gasper, "Determining the Optical Properties of Photographic Emulsions by the Monte Carlo Method", *Photographic Science and Engineering*, Vol. 16, No. 3, May-June 1971, pp. 181–191.)

After determining the cumulative light distribution as a function of the angle $\phi$ at values from 0° to 90° for the emulsion 1 according to the present invention, the same procedure is repeated, but with a conventional emulsion of the same average grain volume coated at the same silver coverage on another portion of support 3. In comparing the cumulative light distribution as a function of the angle $\phi$ for the two emulsions, for values of $\phi$ up to 70° (and in some instances up to 80° and higher) the amount of scattered light is lower with the emulsions according to the present invention. In FIG. 4 the angle $\theta$ is shown as the complement of the angle $\phi$. The angle of scattering is herein discussed by reference to the angle $\phi$. Thus, the high aspect ratio tabular grain emulsions of this invention exhibit less high-angle scattering. Since it is high-angle scattering of light that contributes disproportionately to reduction in image sharpness, it follows that the high aspect ratio tabular grain emulsions of the present invention are in each instance capable of producing sharper images.

As herein defined the term "collection angle" is the value of the angle $\theta$ at which half of the light striking the detection surface lies within an area subtended by a cone formed by rotation of line AC about the polar axis at the angle $\theta$ while half of the light striking the detection surface strikes the detection surface within the remaining area.

While not wishing to be bound by any particular theory to account for the reduced high angle scattering properties of high aspect ratio tabular grain emulsions according to the present invention, it is believed that the large flat major crystal faces presented by the high aspect ratio tabular grains as well as the orientation of the grains in the coating account for the improvements in sharpness observed. Specifically, it has been observed that the tabular grains present in a silver halide emulsion coating are substantially aligned with the planar support surface on which they lie. Thus, light directed perpendicular to the photographic element striking the emulsion layer tends to strike the tabular grains substantially perpendicular to one major crystal face. The thinness of tabular grains as well as their orientation when coated permits the high aspect ratio tabular grain emulsion layers of this invention to be substantially thinner than conventional emulsion coatings, which can also contribute to sharpness. However, the emulsion layers of this invention exhibit enhanced sharpness even when they are coated to the same thicknesses as conventional emulsion layers.

In a specific preferred form of the invention the high aspect ratio tabular grain emulsion layers exhibit a minimum average grain diameter of at least 1.0 micron, most preferably at least 2 microns. Both improved speed and sharpness are attainable as average grain diameters are increased. While maximum useful average grain diameters will vary with the graininess that can be tolerated for a specific imaging application, the maximum average grain diameters of high aspect ratio tabular grain emulsions according to the present invention are in all instances less than 30 microns, preferably less than 15 microns, and optimally no greater than 10 microns.

Although it is possible to obtain reduced high angle scattering with single layer coatings of high aspect ratio tabular grain emulsions according to the present invention, it does not follow that reduced high angle scattering is necessarily realized in multicolor coatings. In certain multicolor coating formats enhanced sharpness can be achieved with the high aspect ratio tabular grain emulsions of this invention, but in other multicolor coating formats the high aspect ratio tabular grain emulsions of this invention can actually degrade the sharpness of underlying emulsion layers.

Referring back to Layer Order Arrangement I, it can be seen that the blue recording emulsion layer lies nearest to the exposing radiation source while the underlying green recording emulsion layer is a tabular emulsion according to this invention. The green recording emulsion layer in turn overlies the red recording emulsion layer. If the blue recording emulsion layer contains grains having an average diameter in the range of from 0.2 to 0.6 micron, as is typical of many nontabular emulsions, it will exhibit maximum scattering of light passing through it to reach the green and red recording emulsion layers. Unfortunately, if light has already been scattered before it reaches the high aspect ratio tabular grain emulsion forming the green recording emulsion layer, the tabular grains can scatter the light passing through to the red recording emulsion layer to an even greater degree than a conventional emulsion. Thus, this particular choice of emulsions and layer arrangement results in the sharpness of the red recording emulsion layer being significantly degraded to an extent greater than would be the case if no emulsions according to this invention were present in the layer order arrangement.

In order to realize fully the sharpness advantages of the present invention in an emulsion layer that underlies a high aspect ratio tabular grain emulsion layer according to the present invention it is preferred that the the tabular grain emulsion layer be positioned to receive light that is free of significant scattering (preferably positioned to receive substantially specularly transmitted light). Stated another way, in the photographic elements of this invention improvements in sharpness in emulsion layers underlying tabular grain emulsion layers are best realized only when the tabular grain emulsion layer does not itself underlie a turbid layer. For example, if a high aspect ratio tabular grain green recording emulsion layer overlies a red recording emulsion layer and underlies a Lippmann emulsion layer and/or a high aspect ratio tabular grain blue recording emulsion layer according to this invention, the sharpness of the red recording emulsion layer will be improved by the presence of the overlying tabular grain emulsion layer or layers. Stated in quantitative terms, if the collection angle of the layer or layers overlying the high aspect ratio tabular grain green recording emulsion layer is less than about 10°, an improvement in the sharpness of the red recording emulsion layer can be realized. It is, of course, immaterial whether the red recording emulsion layer is itself a high aspect ratio tabular grain emulsion layer according to this invention insofar as the effect of the overlying layers on its sharpness is concerned.

In a multicolor photographic element containing superimposed color-forming units it is preferred that at least the emulsion layer lying nearest the source of exposing radiation be a high aspect ratio tabular grain emulsion in order to obtain the advantages of sharpness offered by this invention. In a specifically preferred form of the invention each emulsion layer which lies nearer the exposing radiation source than another image recording emulsion layer is a high aspect ratio tabular grain emulsion layer. Layer Order Arrangements II, III, IV, V, VI, and VII, described above, are illustrative of multicolor photographic element layer arrangements according to the invention which are capable of imparting significant increases in sharpness to underlying emulsion layers.

Although the advantageous contribution of high aspect ratio tabular grain emulsions to image sharpness in multicolor photographic elements has been specifically described by reference to multicolor photographic elements, sharpness advantages can also be realized in multilayer black-and-white photographic elements intended to produce silver images. It is conventional practice to divide emulsions forming black-and-white images into faster and slower layers. By employing high aspect ratio tabular grain emulsions according to this invention in layers nearest the exposing radiation source the sharpness of underlying emulsion layers will be improved.

EXAMPLES

The invention is further illustrated by the following examples. In each of the examples the contents of the reaction vessel were stirred vigorously throughout silver and halide salt introductions; the term "percent" means percent by weight, unless otherwise indicated; and the term "M" stands for a molar concentration, unless otherwise stated. All solutions, unless otherwise stated, are aqueous solutions. Although some tabular grains of less than 0.6 micron in diameter were included in computing the tabular grain average diameters and percent projected area, except where their exclusion is specifically noted, insufficient small diameter tabular grains were present to alter significantly the numbers reported.

COMPARATIVE EXAMPLE 1

This example illustrates the nonselective epitaxial deposition of silver chloride on a tabular grain AgBrI emulsion containing 6 mole % iodide and not previously spectrally sensitized.

Emulsion 1A Tabular Grain AgBrI (6 mole % iodide) Host

To 6.0 liters of a 1.5% gelatin solution containing 0.12 M potassium bromide at 55° C. were added with stirring and by double-jet, a 2.0 molar KBr solution containing 0.12 molar KI and a 2.0 molar $AgNO_3$ solution over an eight minute period while maintaining the pBr of 0.92 (consuming 5.3% of the total silver used). The bromide and silver solutions were then run concurrently maintaining pBr 0.92 in an accelerated flow (6.0X from start to finish—i.e., six times faster at the end than at the start) over 41 minutes (consuming 94.7% of the total silver used). A total of 3.0 moles of silver was used. The emulsion was cooled to 35° C., washed by the coagulation method of U.S. Pat. No. 2,614,929 of Yutzy and Russell, and stored at pAg 7.6 measured at 40° C. The resultant tabular grain AgBrI (6 mole % iodide) emulsion had an average grain diameter of 3.0 μm, an average thickness of 0.09 μm, an average aspect ratio of 33:1, and 85% of the grains were tabular based on projected area.

Emulsion 1B Major Crystal Face AgCl Epitaxial Growth 40 g of the tabular grain AgBrI Emulsion 1A (0.04 mole) prepared above was adjusted to pAg 7.2 at 40° C. with a 0.1 molar $AgNO_3$ solution. 1.0 ml of a 0.79 molar NaCl solution was added. Then the double-jet addition for 8.3 minutes of 0.54 molar NaCl and 0.5 molar $AgNO_3$ solutions while maintaining the pAg at 7.5 at 40° C. resulted in the epitaxial deposition of AgCl in the amount of 5 mole % of the total silver halide. For succinctness this emulsion is referred as a 5 mole % AgCl emulsion, and similar terminology is applied to subsequent emulsions.

Figure 5:
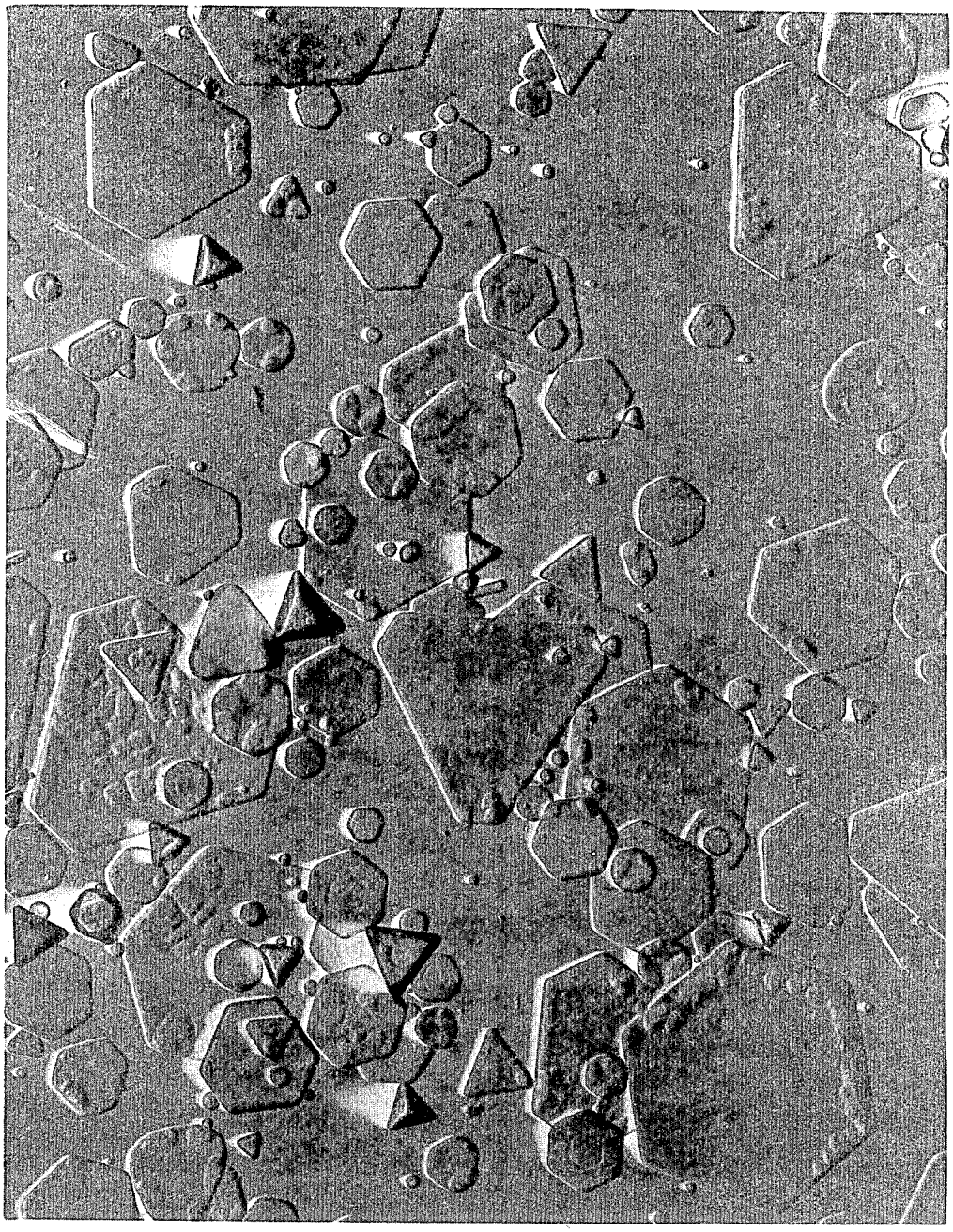

FIG. 5 represents a carbon replica electron micrograph of the emulsion. It shows that the silver chloride was deposited on the major crystal faces. Although some grains exhibit an observed preference for epitaxy near the edges of the major crystal faces, deposition is, in general, more or less random over the major crystal faces. Note that the AgBrI (6 mole % iodide) host emulsion was not spectrally sensitized prior to the addition of the silver chloride.

EXAMPLE 2

This example demonstrates the deposition of AgCl along the grain edges of a spectrally sensitized tabular grain AgBr emulsion.

Emulsion 2A Tabular Grain AgBr Host

To 2.0 liters of a 1.5% gelatin solution containing 0.073 M sodium bromide at 80° were added with stirring and by double-jet, a 0.30 molar NaBr solution and a 0.05 molar $AgNO_3$ solution over a five minute period, while maintaining the pBr of 1.14 (consuming 0.4% of the total silver used). The bromide and silver solutions were then run concurrently maintaining pBr 1.14 in an accelerated flow (3.0X from start to finish) over 4 minutes (consuming 0.66% of the silver used). Then a 1.5 molar NaBr solution and a 1.5 molar $AgNO_3$ solution were added while maintaining pBr 1.14 in an accelerated flow (14.3X from start to finish) over 25 minutes (consuming 66.2% of the silver used). Then the acceleration was stopped and the solutions were added at a constant flow rate for 6.6 minutes (consuming 32.8% of the silver used). A total of approximately 3.03 moles of silver was used. The emulsion was cooled to 40° C., washed by the coagulation process of U.S. Pat. No. 2,614,929 of Yutzy and Russell, and stored at pAg 8.0 measured at 40° C. The resultant tabular grain AgBr emulsion had an average grain diameter of 5.0 μm, an average thickness of 0.09 μm, an aspect ratio of 56:1, and 85% of the grains were tabular based on total projected area.

Emulsion 2B Major Crystal Face AgCl Epitaxial Growth

The AgBr host emulsion prepared above was centrifuged and resuspended in a $1.85\times10^{-2}$ molar NaCl solution. 2.5 mole % AgCl was precipitated into 40 grams of the emulsion (0.04 mole) by double-jet addition for 4.1 minutes of 0.55 molar NaCl and 0.50 molar $AgNO_3$ solutions while maintaining the pAg at 7.5 at 40° C. The emulsion was spectrally sensitized with 1.0 millimole Dye A, anhydro-5-chloro-9-ethyl-5'-phenyl-3,3'-bis(3-sulfopropyl)oxacarbocyanine hydroxide, triethylamine salt/Ag mole.

Emulsion 2C Edge Selective AgCl Epitaxial Growth

This emulsion was prepared the same as in paragraph B above, except that spectral sensitization with 1.0 millimole Dye A/Ag mole occured prior to the addition of the NaCl and $AgNO_3$ solutions.

Figure 6:
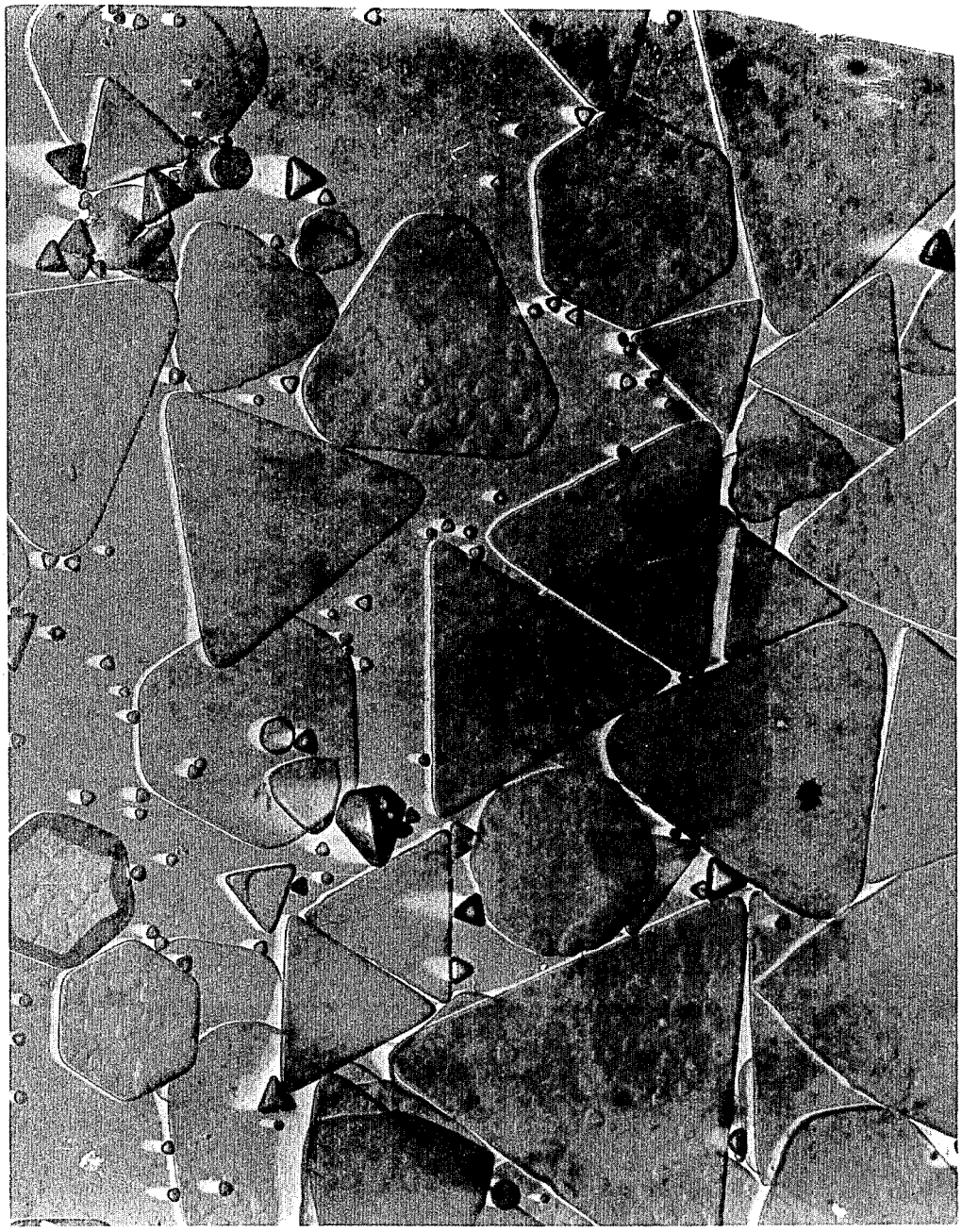
Figure 7:
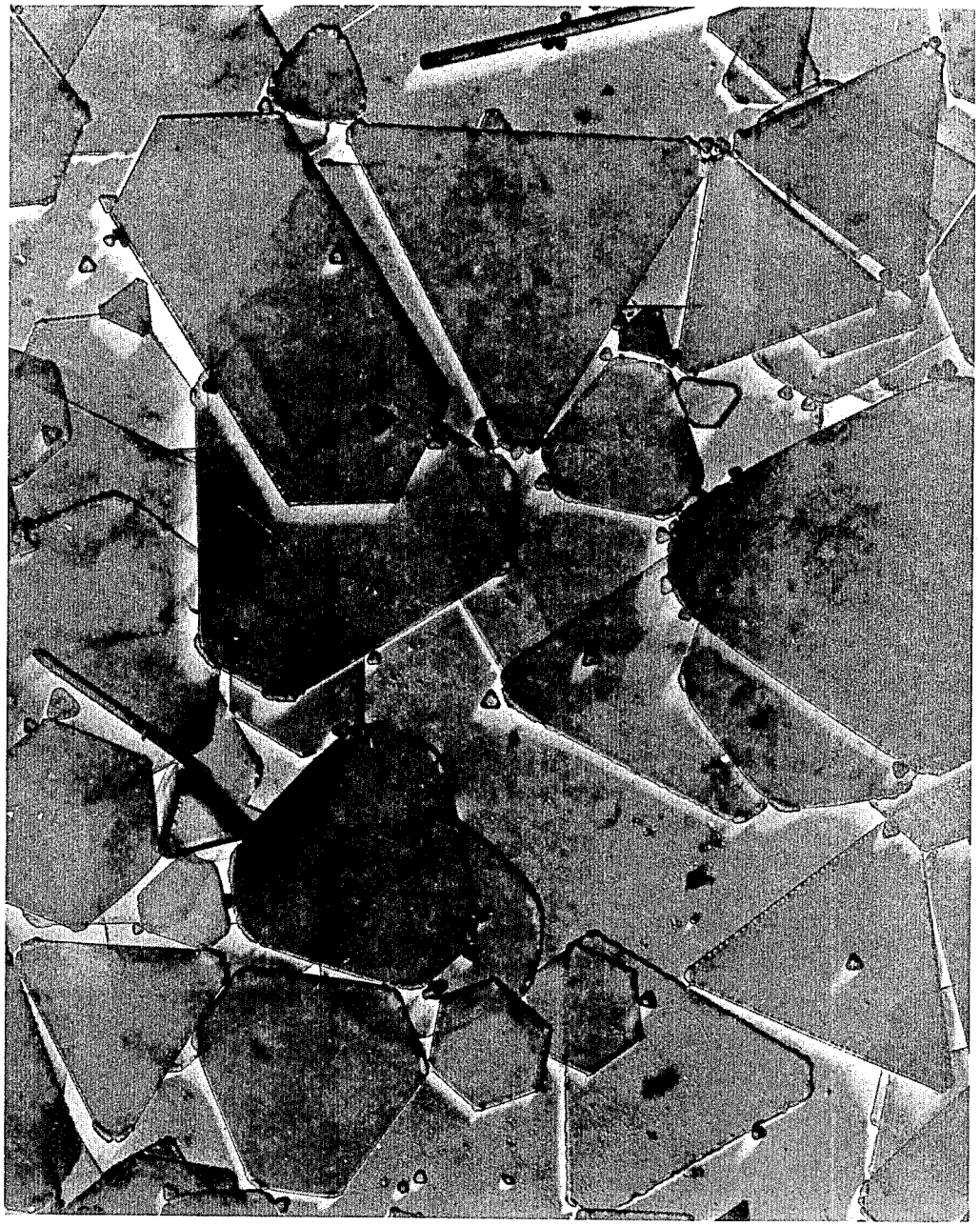

Emulsion 2B, which was spectrally sensitized following the addition of AgCl, had the AgCl deposited randomly over the crystal surface, see FIG. 6. Emulsion 2C, which was spectrally sensitized prior to the addition of AgCl, had AgCl deposited almost exclusively along the edges of the grain, see FIG. 7. In general the few small grains present that are shown overlying tabular grain major crystal faces are not epitaxially attached to the tabular grains, but are separate grains.

Emulsions 2B and 2C were coated on a polyester support at 1.61 g/m$^2$ silver and 3.58 g/m$^2$ gelatin. A 0.54 g/m$^2$ gelatin layer was coated over the emulsion layer. Emulsion coatings were exposed for 1/10 second to a 600 W 2850° K tungsten light source through a 0 to 6.0 density step tablet (0.30 steps) and processed from 1 to 20 minutes in a time of development series with a Metol®(N-methyl-p-aminophenol sulfate)-hydroquinone developer at 20° C. Sensitometric results are listed in Table II below.

TABLE II

| Emulsion | Epitaxy Pattern | Log Speed | $D_{min}$ |
|---|---|---|---|
| Control 2B | random | 235 | 0.10 |
| Example 2C | edge | 315 | 0.10 |

EXAMPLE 3

This example demonstrates that the addition of low levels of iodide to a tabular grain AgBr emulsion allows the epitaxial deposition of AgCl at the corners of non-spectrally sensitized host tabular crystals.

Control Emulsion 3A Random Major Crystal Face AgCl Epitaxial Growth

The tabular grain AgBr host Emulsion 2A described in paragraph A, Example 2, was centrifuged and resuspended in a $1.85\times10^{-2}$ molar NaCl solution. Then 2.5 mole % AgCl was precipitated into 40 g the host emulsion (0.04 mole) by double-jet addition for 4.1 minutes of 0.55 molar NaCl and 0.5 molar $AgNO_3$ solutions while maintaining the pAg at 7.5 at 40° C. The emulsion was then spectrally sensitized with 1.0 millimole Dye A/Ag mole.

Emulsion 3B Corner Selective AgCl Epitaxial Growth

To 400 g of the AgBr host Emulsion 2A (0.4 mole) was added 0.5 mole percent iodide by the introduction of a $4.0\times10^{-2}$ molar KI solution over 10 minutes at 5.0 ml/minute. The emulsion was centrifuged and resuspended in a $1.85\times10^{-2}$ molar NaCl solution. Then 2.5 mole % AgCl was precipitated into 40 g of the host emulsion (0.04 mole) by double-jet addition for 4 minutes of 0.55 molar NaCl and 0.50 molar $AgNO_3$ solutions while maintaining the pAg at 7.5 at 40° C. The emulsion was then spectrally sensitized with 1.0 millimole Dye A/Ag mole.

Control Emulsion 3C AgCl Free I Ion Added Control

Emulsion 3C was prepared and spectrally sensitized the same as Emulsion 3B above, except the epitaxial deposition of AgCl was omitted.

Figure 8:
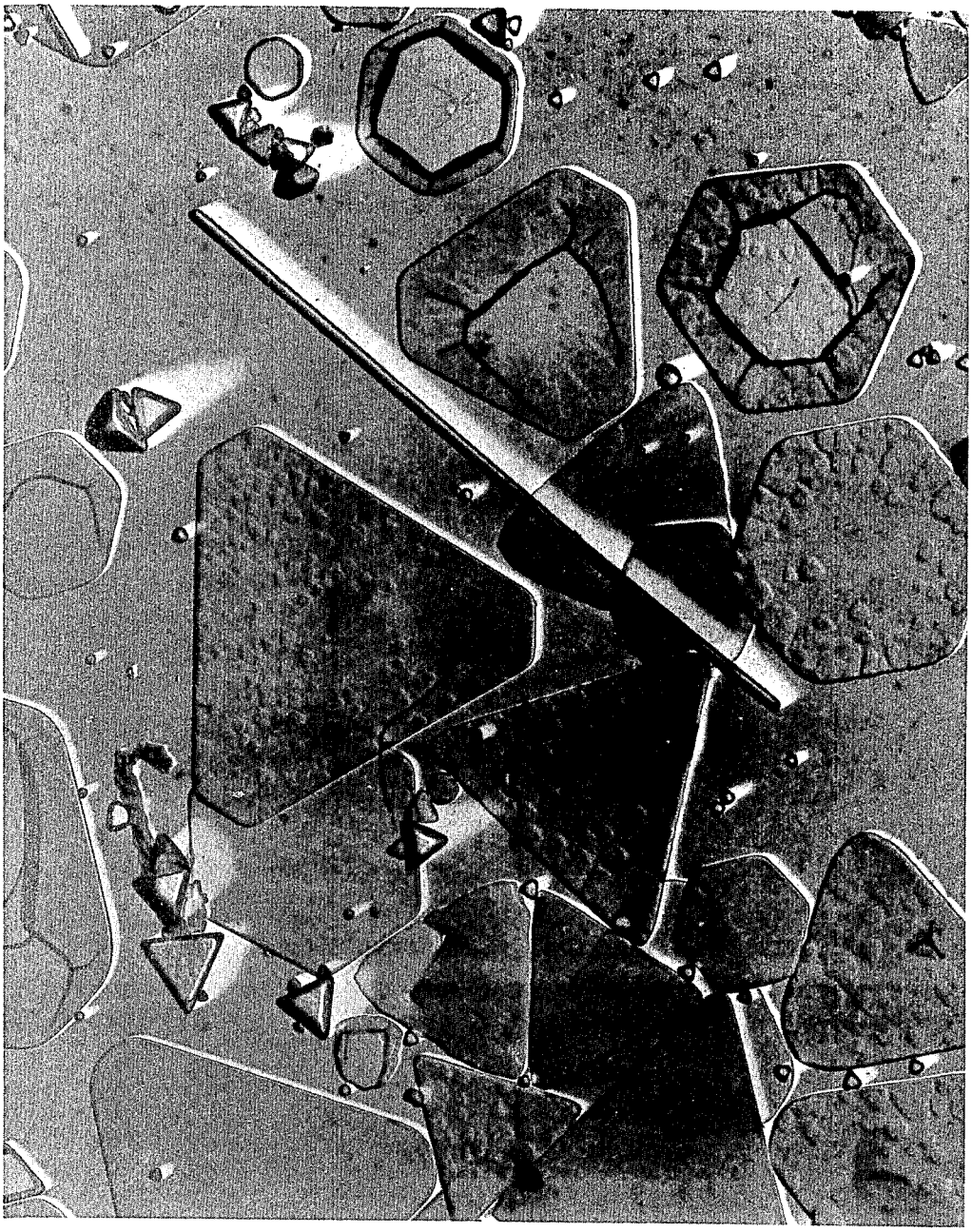
Figure 9:
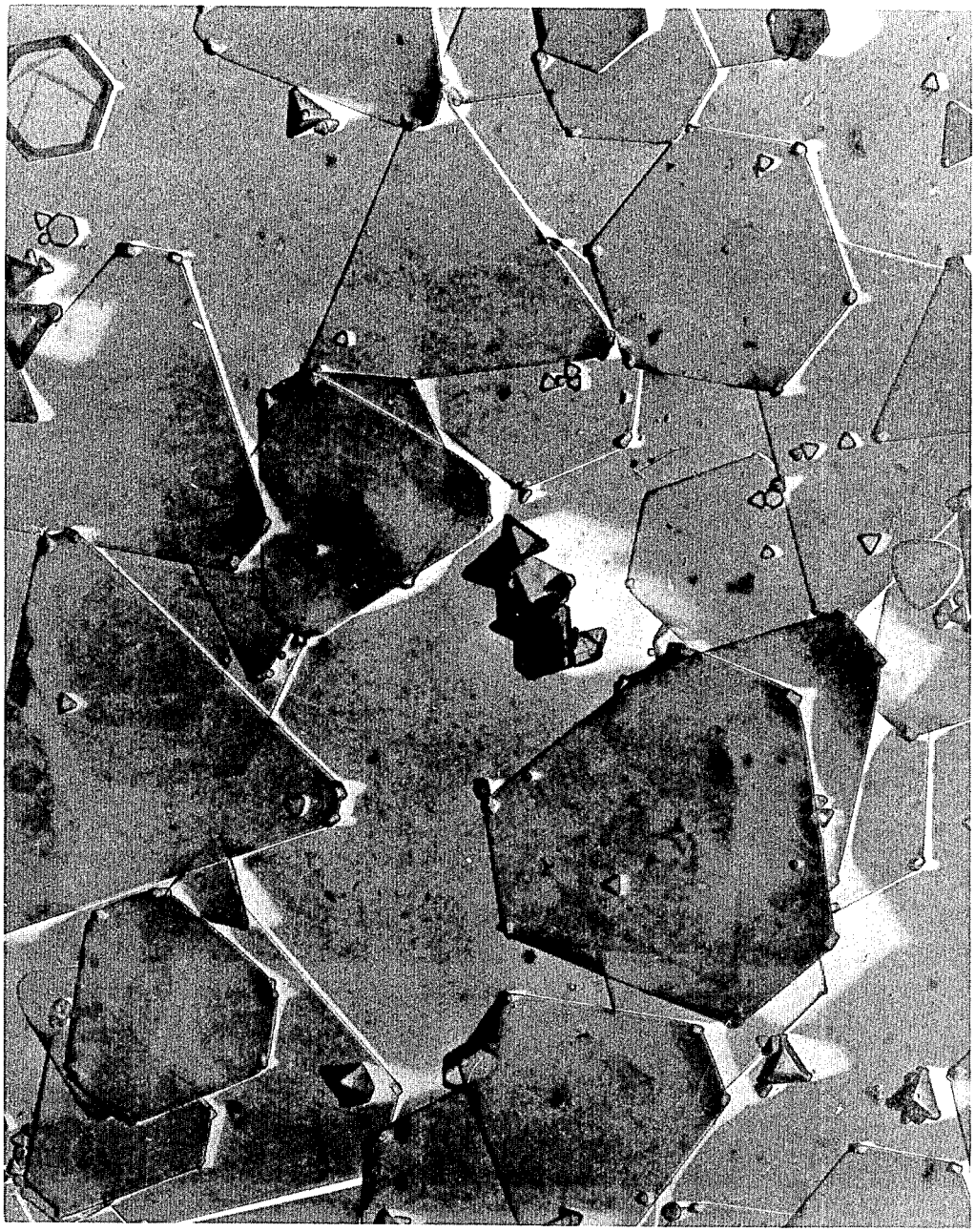

Emulsion 3A, which was spectrally sensitized following the addition of AgCl, had the AgCl deposited randomly over the entire major crystal faces; see FIG. 8. Emulsion 3B, to which 0.5 mole percent KI was added prior to the addition of AgCl, had the AgCl deposited almost exclusively at the corners of the grain; see FIG. 9. The small grains overlying major crystal faces were separate and not epitaxially grown on the major crystal faces.

Emulsions 3A, 3B and 3C were coated, exposed, and processed in a time of development series as described in Example 2. Sensitometric results are listed in Table III below.

TABLE III

| Emulsion | Epitaxy | Log Speed | $D_{min}$ |
|---|---|---|---|
| 3A AgCl/AgBr | Random | 240 | 0.15 |
| 3B AgCl/(AgBr + $I^-$) | Corner | 326 | 0.15 |
| 3C AgBr + $I^-$ | None | 245 | 0.15 |

EXAMPLE 4

This example illustrates the epitaxial deposition of AgCl almost exclusively at the corners of a spectrally sensitized tabular grain AgBr emulsion.

Emulsion 4A Tabular Grain AgBr Host

To 3.0 liters of a 1.5% gelatin solution containing 0.067 M sodium bromide at 80° C. were added with stirring and by double-jet, a 0.1 molar NaBr solution and a 0.1 molar $AgNO_3$ solution over 3.75 minutes while maintaining the pBr 1.17 (consuming 0.22% of the total silver used). Then a 3.0 molar NaBr solution and a 3.0 molar $AgNO_3$ solution were run concurrently maintaining pBr 1.17 in an accelerated flow (24.8X from start to finish) over 31 minutes (consuming 91.0% of the total silver used). The NaBr solution was stopped and the $AgNO_3$ solution was continued until pAg of 7.75 was reached (consuming 6.8% of the total silver used). A total of approximately 6.85 moles of silver was used. The emulsion was cooled to 40° C., washed by the coagulation method of U.S. Pat. No. 2,614,929 of Yutzy and Russell, and stored at pAg 8.5 measured at 40° C. The resultant tabular grain AgBr emulsion had an average grain size of 2.9 μm, an average thickness of 0.11 μm, an average aspect ratio of 26:1, and 96% of the grains were tabular based on projected area.

Emulsion 4B Corner Selective AgCl Epitaxial Growth 40.0 g of the tabular grain AgBr host Emulsion 4A (0.04 mole) prepared above was adjusted to pAg 7.2 at 40° C. with a 0.1 molar $AgNO_3$ solution. The emulsion was spectrally sensitized with 1.6 millimole Dye B, 1,1'-diethyl-2,2'-cyanine p-toluene sulfonate/Ag mole and stirred for 5 minutes at 40° C. Then 1.0 ml of a 0.5 molar NaCl solution was added. Then 5.0 mole % AgCl was precipitated into the host grain emulsion by double-jet addition for 8 minutes of 0.52 molar NaCl and 0.5 molar $AgNO_3$ solutions while maintaining the pAg at 7.2 at 40° C.

Figure 10:
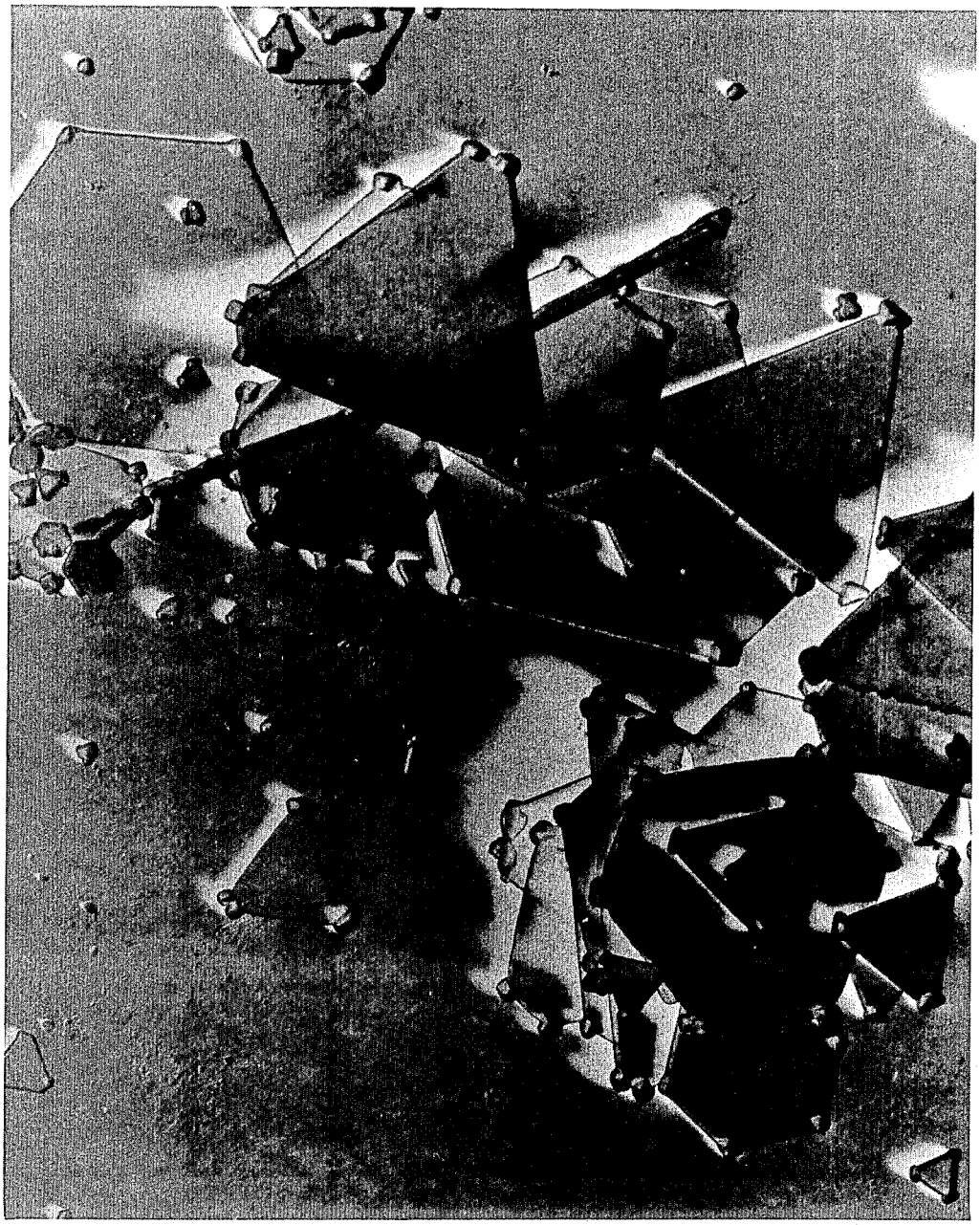

FIG. 10 represents a carbon replica electron micrograph of the AgCl/AgBr epitaxial emulsion.

EXAMPLE 5

This example illustrates the selective corner epitaxial growth of AgCl on a tabular grain AgBrI emulsion.

Emulsion 5A Tabular Grain AgBrI (6 mole % iodide) Host

To 6.0 liters of a 1.5% gelatin solution at 55° C. containing 0.12 M potassium bromide were added with stirring and by double-jet, a 1.12 molar KBr solution which contained 0.06 molar KI and a 1.0 molar $AgNO_3$ solution over a period of 8 minutes (consuming 5.0% of the total silver used). At the same time the temperature was increased over 7 minutes to 70° C. Then a 2.0 molar KBr solution which contained 0.12 molar KI and a 2.0 molar $AgNO_3$ solution were run concurrently maintaining pBr of 0.92 at 70° C. in an accelerated flow (4.0X from start to finish) over 30 minutes (consuming 95.0% of the total silver used). A total of approximately 3.16 moles of silver was used. The emulsion was cooled to 35° C., washed by the coagulation method of Yutzy and Russell U.S. Pat. No. 2,614,929 and stored at pAg 8.2 measured at 35° C. The resultant tabular grain AgBrI (6 mole % iodide) emulsion had an average grain size of 2.7 μm, an average grain thickness of 0.08 μm, an average aspect ratio of 34:1, and 85% of the grains were tabular based on total projected area.

Emulsion 5B Corner Selective AgCl Epitaxial Growth 40 g of the tabular grain AgBrI host Emulsion 5A (0.04 mole) prepared above was adjusted to pAg 7.2 at 40° C. with a 0.1 molar $AgNO_3$ solution. 1.0 ml of a 0.54 molar NaCl solution was added. The emulsion was spectrally sensitized with a 1.0 millimole of Dye A/Ag mole. Then 5.0 mole % AgCl was precipitated into the host tabular grain emulsion by double-jet addition for 7.8 minutes of 0.54 molar NaCl and 0.50 molar $AgNO_3$ solutions while maintaining the pAg at 7.5 at 40° C.

Figure 11A:
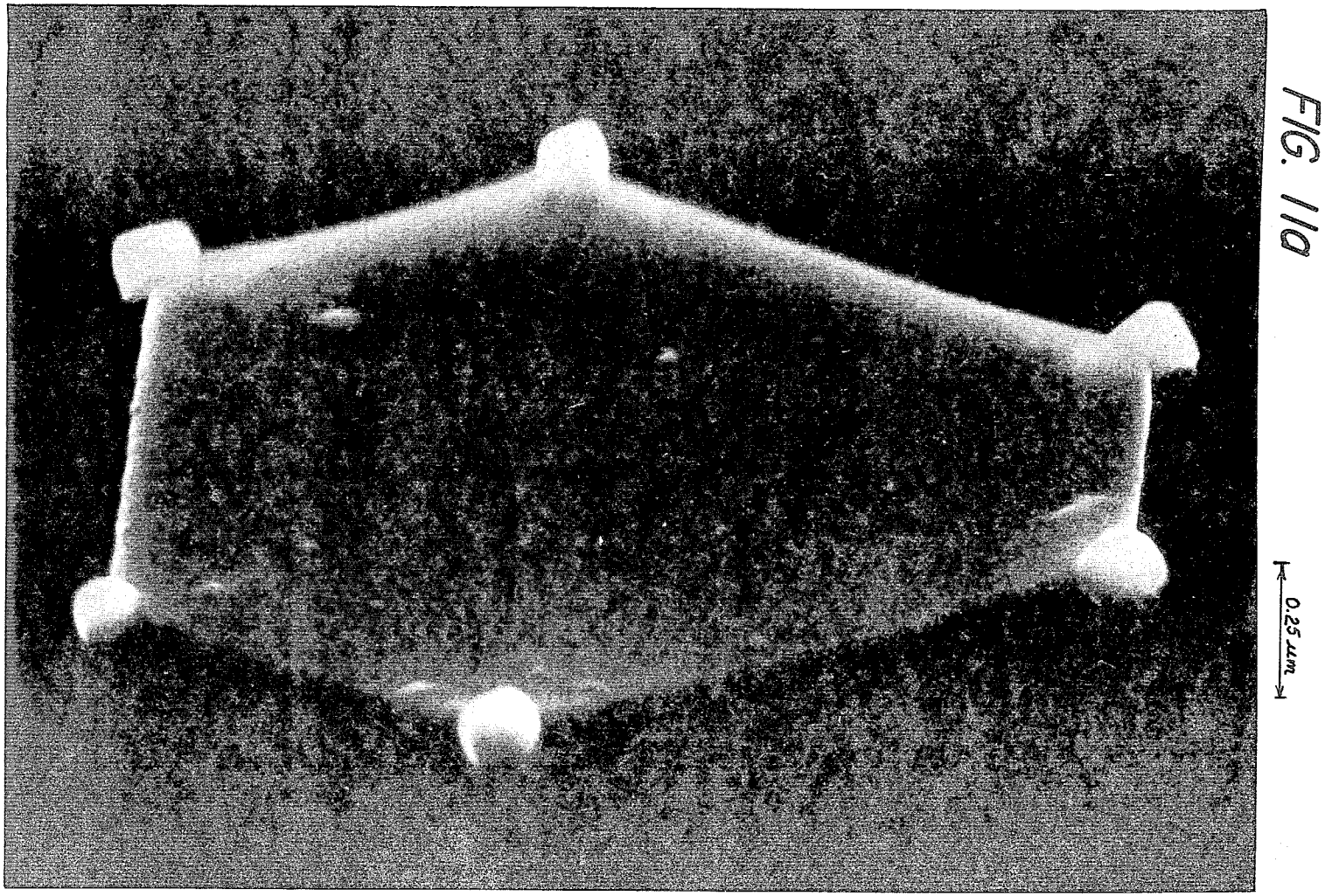
Figure 11B:
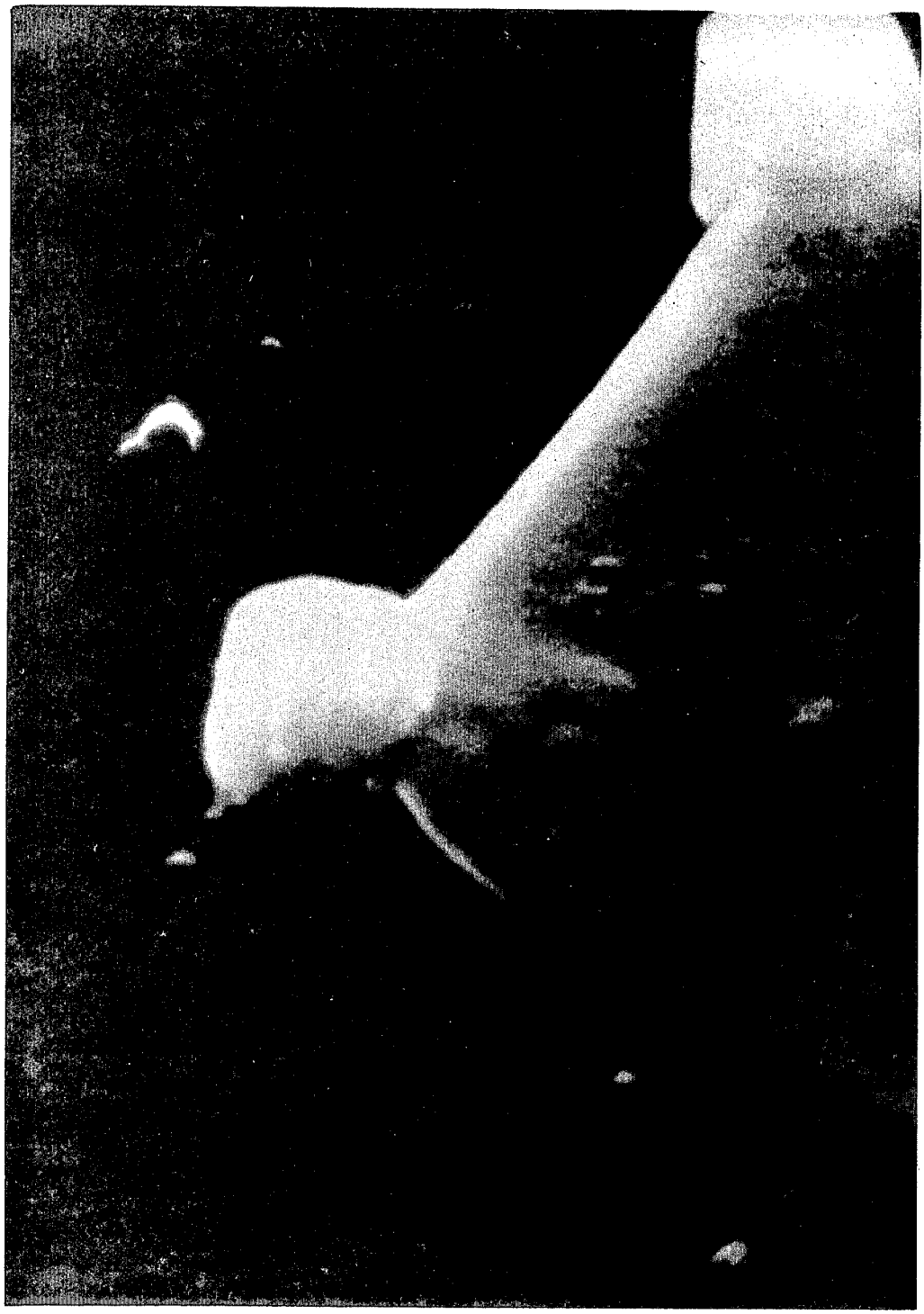

FIG. 11A and FIG. 11B represent secondary electron micrographs of the Emulsion 5B illustrating the epitaxial deposition of 5.0 mole % AgCl at the corners of the AgBrI (6 mole % iodide) tabular crystal.

EXAMPLE 6

This example demonstrates the selective corner epitaxial deposition of AgBr on a spectrally sensitized tabular grain AgBrI emulsion. The AgBr was selectively deposited on the corners of the tabular AgBrI crystals.

Emulsion 6A Tabular Grain AgBrI (12 mole % iodide) Host

To 9.0 liters of a 1.5% gelatin solution containing 0.14 M potassium bromide at 55° C. was added with stirring a 2.0 molar $AgNO_3$ solution for 15 seconds (consuming 0.4% of the total silver used). Then a 2.05 molar KBr solution containing 0.24 molar KI and a 2.0 molar $AgNO_3$ solution were added for 15 seconds by double-jet addition (consuming 0.4% of the total silver used). The halide and silver solutions were then run concurrently maintaining pBr of 0.92 for 7.5 minutes (consuming 2.3% of the total silver used). Then the halide and silver solutions were run concurrently maintaining pBr of 0.92 in an accelerated flow (6.6 X from start to finish) over 41 minutes (consuming 96.9% of the total silver used). A total of approximately 5.16 moles of silver was used. The emulsion was cooled to 35° C., washed by the coagulation method of Yutzy and Russell U.S. Pat. No. 2,614,929 and stored at pAg 8.2 measured at 40° C. The resultant tabular grain AgBrI (12 mole % iodide) emulsion had an average grain size of 2.1 μm, an average thickness of 0.10 μm, an average aspect ratio of 21:1, and 75% of the grains were tabular based on total projected area.

Emulsion 6B Corner Selective Epitaxial Growth 56.8 g of the tabular grain AgBrI (12 mole % iodide) host Emulsion 6A (0.06 mole) prepared above was adjusted to pAg 7.6 at 40° C. with a 0.2 molar $AgNO_3$ solution. The emulsion was spectrally sensitized with 1.5 millimole Dye A/Ag mole and held for 5 minutes at 40° C. Then 4.2 mole % AgBr was precipitated into the host tabular grain emulsion by double-jet addition for 12.8 minutes of a 0.2 molar NaBr solution which contained $Na_2S_2O_3.5H_2O$ (20.8 mg/l) plus $KAuCl_4$ (20.8 mg/l) and a 0.2 molar $AgNO_3$ solution while maintaining the pAg at 7.2 at 40° C. The emulsion was heated to 60° C. and held for 10 minutes.

Arrested Development Study

The chemically sensitized tabular grain AgBr/AgBrI Emulsion 6B prepared above was then coated on cellulose ester support at 1.07 g/m² silver and 2.15 g/m² gelatin.

The coating was given a $D_{max}$ exposure for 1/100 second to a 600 W 3000° K. tungsten light source and then processed for 75 seconds at 20° C. in Developer A described below.

| Developer A | |
|---|---|
| Hydroquinone | 10.0 g |
| $Na_2SO_3$ | 10.0 g |
| Sodium metaborate | 10.0 g |
| Distilled water to | 1.0 l |
| pH measured at 9.4 | |

Following development the coating was placed for 1 minute in a 1% acetic acid stop bath and then washed with distilled water.

Figure 12:
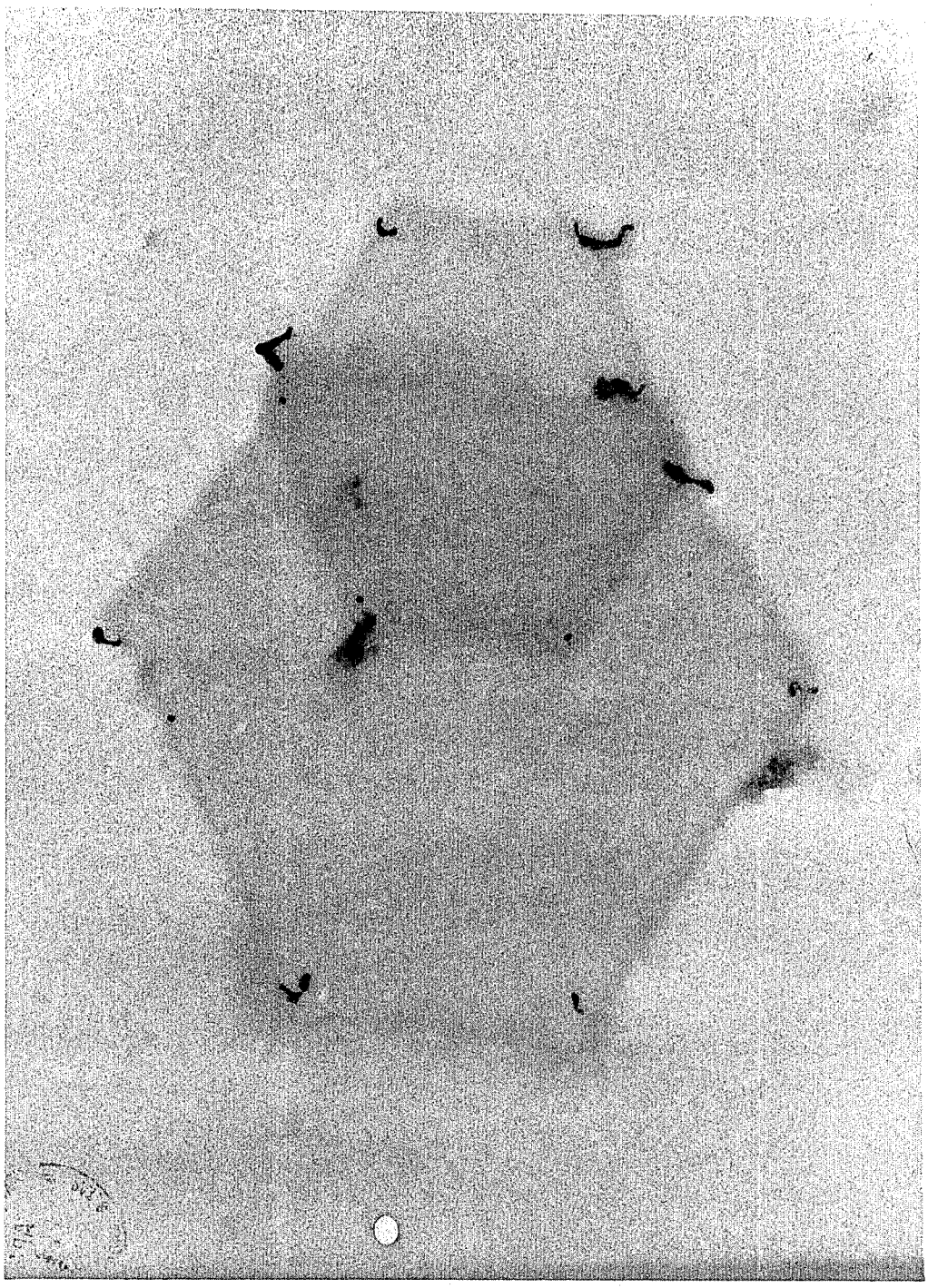

FIG. 12 represents a gelatin capsule electron micrograph of partially developed grains. The darkest areas represent developed silver. The location of the developed silver shows that latent image formation occurs almost exclusively at or near the corners of the tabular grains.

EXAMPLE 7

This example illustrates sensitivity and minimum density, both fresh and upon keeping, as a function of epitaxy. This example further illustrates the location of latent image formation by examination of partially developed grains.

Emulsion 7A Chemically and Spectrally Sensitized Tabular Grain AgBrI (6 Mole % Iodide) Host Emulsion 1A The tabular grain AgBrI (6 mole % iodide) host Emulsion 1A was chemically sensitized with 5 mg $Na_2S_2O_3.5H_2O$/Ag mole plus 5 mg $KAuCl_4$/Ag mole for 10 minutes at 60° C. and then spectrally sensitized with 1.5 millimole Dye A/Ag mole. The emulsion was coated on a polyester support at 1.61 g/m² silver and 3.58 g/m² gelatin. The emulsion layer was overcoated with a 0.54 g/m² gelatin layer.

Emulsion 7B Spectrally Sensitized AgCl/AgBrI Epitaxial Emulsion

The tabular grain AgBrI (6 mole % iodide) host Emulsion 1A (0.04 mole) was adjusted to pAg 7.2 at 40° C. by the simultaneous addition of 0.1 molar $AgNO_3$ and 0.006 molar KI. Then 1.0 ml of a 0.80 molar NaCl solution was added. The emulsion was spectrally sensitized with 1.5 millimole Dye A/Ag mole. Then 1.25 mole % AgCl was precipitated into the host tabular grain emulsion by double-jet addition for two minutes of 0.54 molar NaCl and 0.50 molar $AgNO_3$ solutions while maintaining the pAg at 7.5 at 40° C.

Emulsion 7C Chemically and Spectrally Sensitized AgCl/AgBrI Epitaxial Emulsion

Figure 13:
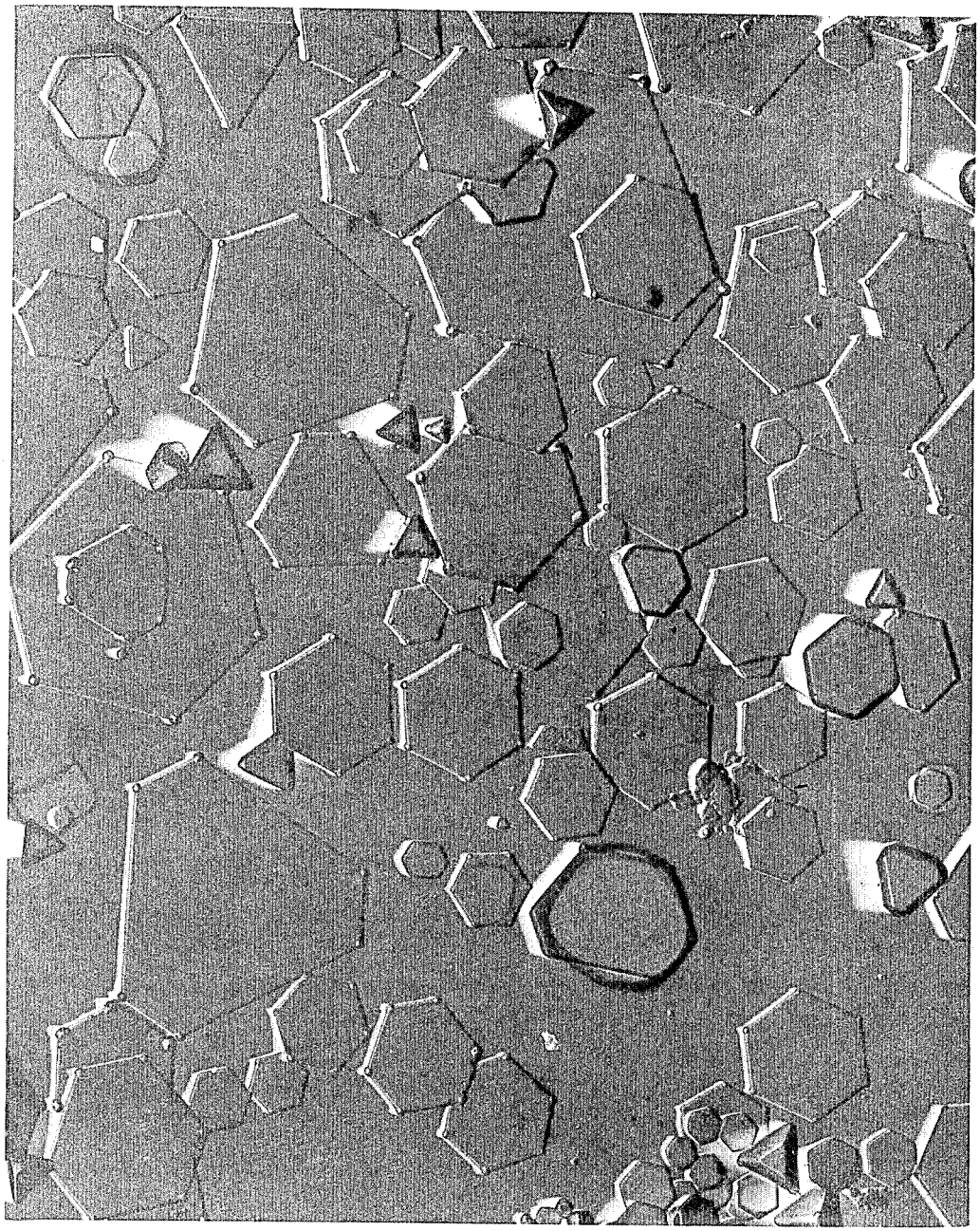

The tabular grain AgBrI (6 mole % iodide) host emulsion 1A was adjusted to pAg 7.2 at 40° C. by the simultaneous addition of 0.1 molar $AgNO_3$ and 0.006 molar KI. Then 1.0 ml of a 0.74 molar NaCl solution was added. The emulsion was spectrally sensitized with 1.5 millimole Dye A/Ag mole and held for 30 minutes at 40° C. The emulsion was centrifuged and resuspended in a $1.85\times10^{-2}$ molar NaCl solution two times. When 1.25 mole % AgCl was precipitated into 40 g of the host tabular grain emulsion (0.04 mole) by double-jet addition for 2.1 minutes of 0.54 molar NaCl and 0.50 molar $AgNO_3$ solutions while maintaining the pAg at 7.5 at 40° C. The emulsion was also chemically sensitized with 0.5 mg $Na_2S_2O_3.5H_2O$/Ag mole and 0.5 mg $KAuCl_4$/Ag mole added 15 seconds after the NaCl and $AgNO_3$ reagents were started. FIG. 13 is an electron micrograph of this emulsion, showing corner selective epitaxy.

Emulsion 7D Chemically and Spectrally Sensitized AgCl/AgBrI Epitaxial Emulsion Emulsion 7D was prepared similarly as Emulsion 7C above, except that during epitaxial deposition of AgCl on the spectrally sensitized host AgBrI crystal, the emulsion was chemically sensitized with 1.0 mg $KAuCl_4$/Ag mole and 1.0 mg $Na_2S_2O_3.5H_2O$/Ag mole.

The emulsions above were coated, exposed, and processed in a time of development series as described in Example 2. Sensitometric results are reported in Table IV below.

TABLE IV

| Emulsion | Log Speed* | $D_{min}$ |
|---|---|---|
| 7A | 193 | 0.10 |
| 7B | 311 | 0.10 |
| 7C | 343 | 0.10 |
| 7D | 346 | 0.10 |

*30 = 0.3 log E, where is exposure in meter-candle-seconds

As revealed in Table IV, the spectrally sensitized epitaxial AgCl/AgBrI tabular grain Emulsions 7B, 7C, and 7D with and without chemical sensitization were significantly faster in speed (≈1.2 log E) than the chemically and spectrally sensitized host AgBrI emulsion 7A. Also, significantly less chemical sensitizer was used for Emulsions 7C and 7D than for Emulsion 7A.

Coatings of Emulsions 7A and 7C were also held for 1 week at 49° C. and 50% relative humidity and then exposed for 1/10 second to a 600W 2850°K. tungsten light source through a 0 to 6.0 density step tablet (0.30 steps) and processed for 6 minutes with a Metol® (N-methyl-p-aminophenol sulfate)-hydroquinone developer at 20° C. Sensitometric results reveal that the epitaxial AgCl/AgBrI Emulsion 7C was faster in speed and displayed less fog than host AgBrI Emulsion 7A. See Table V.

TABLE V

| | 1 week at 49° C., 50% Relative Humidity | |
|---|---|---|
| Emulsion | Log Speed | $D_{min}$ |
| 7A | 225 | 0.22 |
| 7C | 336 | 0.09 |

Arrested Development Studies

The tabular grain AgBrI (6 mole % iodide) Emulsion 7A and the AgCl/AgBrI epitaxial Emulsion 7C were coated on cellulose ester support at 1.61 g/m² silver and 3.58 g/m² gelatin. The emulsion layer was overcoated with a 0.54 g/m² gelatin layer.

The Emulsion 7A coating was given a $D_{max}$ exposure for 1/10 second to a 600W 2850°K. tungsten light source and then processed for 50 seconds at 20° C. in Developer B described below. The Emulsion 7C coating was also given a $D_{max}$ exposure for 1/10 second to a 600W 2850° K. tungsten light source through a 2.0 neutral density filter and then processed for 60 seconds at 20° C. in Developer B.

| Developer B | |
|---|---|
| Hydroquinone | 0.4 g |
| Elon ® (N—methyl-p-aminophenol sulfate) | 0.2 g |
| $Na_2SO_3$ | 2.0 g |
| KBr | 0.5 g |
| Sodium metaborate | 5.0 g |
| Distilled water to pH measured at 10.0 | 1.0 l |

Following development the coatings were placed for thirty seconds in a 0.5% acetic acid stop bath and then distilled water washed for two minutes.

FIG. 3 represents a gelatin capsule electron micrograph of the partially developed grains of Emulsion 7A. The location of developed silver (darkest areas) shows that latent image formation occurred randomly primarily along the edges of the tabular grains. FIG. 2 represents the partially developed grains of Emulsion 7C. FIG. 2 shows that latent image formation occurred almost exclusively in the vicinity of the corners of the tabular grains.

EXAMPLE 8

This example demonstrates the photographic response of a tabular grain AgCl/AgBrI epitaxial emulsion with spectral sensitization prior to AgCl deposition vs. spectral sensitization after AgCl deposition.

Emulsion 8A Corner Selective AgCl Epitaxial Growth (spectrally sensitized prior to precipitation of silver chloride)

The tabular grain AgBrI (6 mole % iodide) host Emulsion 1A was adjusted to pAg 7.2 at 40° C. by the simultaneous addition of 0.10 molar $AgNO_3$ and 0.006 molar KI solutions. 1.0 ml of a 0.74 molar NaCl solution was added. The emulsion was spectrally sensitized with 1.5 millimole Dye A/Ag mole and held for 30 minutes at b 40° C. The emulsion was then centrifuged and resuspended in $1.85\times10^{-2}$ molar NaCl solution two times. Then 1.25 mole % AgCl was precipitated into the host tabular grain emulsion by double-jet addition for two minutes of 0.54 molar NaCl and 0.50 molar $AgNO_3$ solutions while maintaining the pAg at 7.5 at 40° C. At 15 seconds after the start of the NaCl and $AgNO_3$ reagents 0.5 mg $Na_2S_2O_3.5H_2O$/Ag mole and 0.5 mg $KAuCl_4$/Ag mole were added.

Emulsion 8B Random Major Face AgCl Epitaxial Growth (spectrally sensitized after the precipitation of silver choride)

Emulsion 8B was prepared the same as Emulsion 8A above, except that the spectral sensitization with 1.5 millimole Dye A/Ag mole occurred following the AgCl deposition.

Electron micrographs of Emulsion 8A, which was spectrally sensitized prior to the addition of AgCl, revealed the AgCl deposited exclusively near the corners of the AgBrI tabular crystal. However, Emulsion 8B, which was spectrally sensitized following the precipitation of AgCl, showed the AgCl deposited randomly over the major crystal faces.

Emulsions 8A and 8B were coated on cellulose triacetate support at 1.61 g/m$^2$ silver and 3.58 g/m$^2$ gelatin and exposed and processed in a time of development series similar to that described in Example 2. Sensitometric results reveal that at equal Dmin (0.10) Emulsion 8A was 0.70 log E faster is speed than Emulsion 8B.

EXAMPLE 9

This example demonstrates the photographic response of an AgCl/AgBrI epitaxial emulsion spectrally sensitized prior to the addition of the silver chloride.

Emulsion 9A Corner Selection AgCl Epitaxial Growth 40 g of the tabular grain AgBrI (6 mole % iodide) host Emulsion 1A (0.04 mole) was adjusted to pAg 7.2 at 40° C. by the simultaneous addition of 0.1 molar $AgNO_3$ and 0.006 molar KI. Then 1.0 ml of a 0.8 molar NaCl solution was added. The emulsion was spectrally sensitized with 1.87 millimole Dye C, anhydro-9-ethyl-5,5'-diphenyl-3,3'-bis(3-sulfobutyl)oxacarbocyanine hydroxide, triethylamine salt/Ag mole and held for 30 minutes at 40° C. Then 1.25 mole % AgCl was precipitated into the host tabular grain emulsion by double-jet addition for 2 minutes of 0.54 molar NaCl and 0.50 molar $AgNO_3$ solutions while maintaining the pAg at 7.5 at 40° C.

Emulsion 9B Au Sensitized Corner Selective AgCl Epitaxial Growth

Emulsion 9B was prepared the same as Emulsion 9A above, except that 15 seconds after the start of the NaCl and $AgNO_3$ reagents 1.0 mg $KAuCl_4$/Ag mole was added.

Emulsion 9C Sulfur Sensitized Corner Selective AgCl Epitaxial Growth

Emulsion 9C was prepared the same as Emulsion 9A above, except that 15 seconds after the start of the NaCl and $AgNO_3$ reagents 1.0 mg $Na_2S_2O_3.5H_2O$/Ag mole was added. Also after the precipitation was complete, the emulsion was heated for 10 minutes at 60° C.

Emulsion 9D Se Sensitized Corner Selective AgCl Epitaxial Growth

Emulsion 9D was prepared the same as Emulsion 9A above, except that 15 seconds after the start of the NaCl and $AgNO_3$ reagents 0.17 mg sodium selenite ($Na_2SeO_3$)/Ag mole was added.

Emulsions 9A through 9D were coated on cellulose triacetate film support at 1.15 g/m$^2$ silver and 3.5 g/m$^2$ gelatin. In addition, the tabular grain AgBrI host Emulsion 1A was spectrally sensitized with 1.87 mg Dye C/Ag mole and coated as above. Also, the tabular grain AgBrI host emulsion was first chemically sensitized with 5 mg $KAuCl_4$/Ag mole plus 5 mg $Na_2S_2O_3.5H_2O$/Ag mole for 10 minutes at 60° C. and then spectrally sensitized with 1.87 mg Dye C/Ag mole and coated as described. The coatings were exposed for 1/10 second to a 600W 5500° K. tungsten light source through a 0–4.0 density continuous wedge tablet and processed for 6 minutes in a Metol® (N-methyl-p-aminophenol sulfate)-hydroquinone developer at 20° C. Sensitometric results reveal that the AgCl/AgBrI epitaxial emulsions 9A through 9D are significantly faster in speed (>2.0 lod E) with higher $D_{max}$ than the spectrally sensitized tabular grain AgBrI host emulsion with and without chemical sensitization. See Table VI below.

TABLE VI

| Emulsion | Sensitization: Spectral (mM Dye C/mole) | Sensitization: Chemical (mg/mole) | Log Speed | Contrast | $D_{min}$ | $D_{max}$ |
|---|---|---|---|---|---|---|
| 1A Host AgBrI | (1.87) | — | — | 0.05 | 0.12 | 0.32 |
| 1A Host AgBrI | (1.87) | $KAuCl_4$ (5) + $NA_2S_2O_3.5H_2O$ (5) | 64 | 0.68 | 0.10 | 0.77 |
| 9A AgCl/AgBrI | (1.87) | — | 270 | 0.67 | 0.10 | 0.88 |
| 9B AgCl/AgBrI | (1.87) | $KAuCl_4$ (1) | 283 | 0.68 | 0.11 | 0.97 |
| 9C AgCl/AgBrI | (1.87) | $Na_2S_2O_3.5H_2O$ (1) | 298 | 0.71 | 0.12 | 1.03 |
| 9D AgCl/AgBrI | (1.87) | $Na_2SeO_3$ (.17) | 283 | 0.82 | 0.10 | 0.99 |

EXAMPLE 10

This example demonstrates the epitaxial deposition of AgBr at the corners of the spectrally sensitized AgBrI tabular crystals.

Emulsion 10A Corner Selective AgBr Epitaxial Growth

Figure 14:
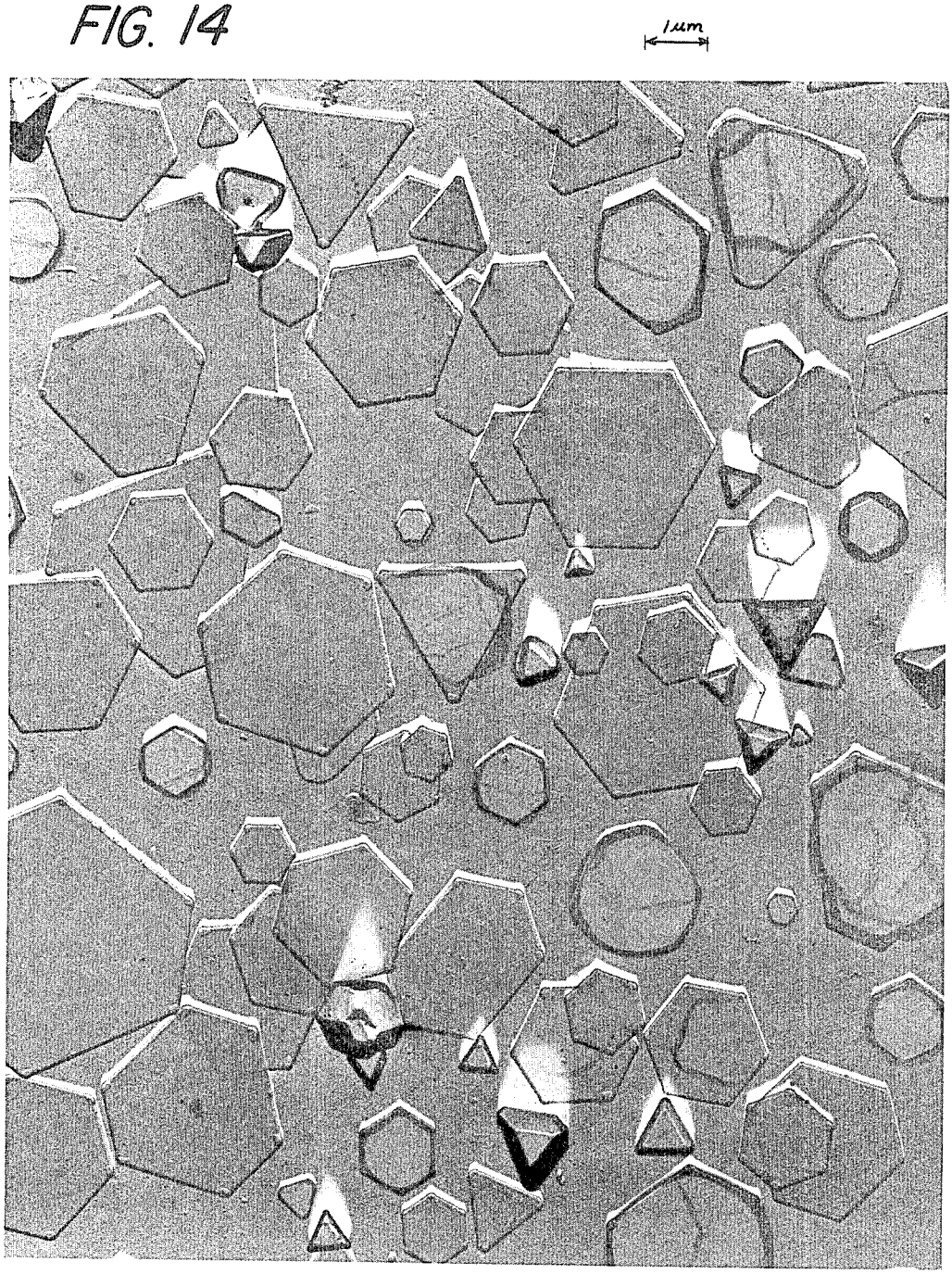

Tabular grain AgBrI (6 mole % iodide) host Emulsion 1A was spectrally sensitized with 1.5 millimole Dye A/Ag mole. Following spectral sensitization the emulsion was centrifuged and resuspended in distilled water two times. Then 0.6 mole % AgBr was precipitated into 40 g of the spectrally sensitized AgBrI host emulsion (0.04 mole) by double-jet addition for 1.5 minutes of 0.2 molar NaBr and 0.2 molar $AgNO_3$ solutions while maintaining the pAg at 7.5 at 40° C. At 15 seconds after the start of the NaBr and $AgNO_3$ reagents 1.0 mg $Na_2S_2O_3.5H_2O$/Ag mole and 1.0 mg $KAuCl_4$/Ag mole were added. See FIG. 14 for a carbon replica electron micrograph of the AgBr/AgBrI epitaxial emulsion.

The tabular grain AgBrI host Emulsion 1A was chemically sensitized with 5.0 mg $KAuCl_4$/Ag mole and 5.0 mg $Na_2S_2O_3.5H_2O$/Ag mole for 10 minutes at 60° C., and then spectrally sensitized with 1.5 millimole Dye A/Ag mole. The host Emulsion 1A and the AgBr/AgBrI epitaxial emulsion were coated, exposed and processed as described in Example 2. Sensitometric results reveal that the epitaxial Emulsion 10A, which was sensitized with significantly less chemical sensitizer and at a lower temperature, was approximately 0.80 log E faster in speed at equal $D_{min}$ (0.10) than the sensitized AgBrI host Emulsion 1A.

EXAMPLE 11

This example demonstrates the epitaxial deposition of AgCl on a tabular grain AgBr emulsion that was spectrally sensitized with a supersensitizing dye combination.

Emulsion 11A Tabular Grain AgBr Host

This emulsion was prepared similarly as tabular grain AgBr host Emulsion 2A of Example 2. The average grain diameter was 3.9 μm, and average grain thickness was 0.09 μm. The grains having a thickness of less than 0.3 micron and a diameter of at least 0.6 micron exhibited an average aspect ratio of 43:1 and accounted for 90% of the total projected area of the silver bromide grains.

Emulsion 11B AgCl/AgBr Selective Corner Growth Emulsion Spectrally Sensitized with Dye Combination 40 g of the tabular grain AgBr host Emulsion 11A (0.04 mole) was adjusted to pAg 7.2 at 40° C. with a 0.1 molar $AgNO_3$ solution. Then 1.0 ml of a 0.61 molar NaCl solution was added. The emulsion was spectrally sensitized with 1.5 millimole Dye B/Ag mole.

1.25 mole % AgCl was precipitated within the host tabular grain emulsion by double-jet addition for 2 minutes of 0.54 molar NaCl and 0.50 molar $AgNO_3$ solutions while maintaining the pAg at 7.5 at 40° C.

Sensitometric Results

Coating 1

The tabular grain AgBr host Emulsion 11A was spectrally sensitized with 1.5 millimoles Dye B/Ag mole and 0.15 millimole Dye D 2-(p-diethylaminostyryl)benzothiazole/Ag mole and then coated on a polyester support at 1.73 g/m$^2$ silver and 3.58 g/m$^2$ gelatin. The emulsion layer was overcoated with 0.54 g/m$^2$ gelatin.

Coating 2

The tabular grain AgBr host Emulsion 11A was chemically sensitized with 1.5 mg $KAuCl_4$/Ag mole plus 1.5 mg $Na_2S_2O_3.5H_2O$/Ag mole for 10 minutes at 65° C. The emulsion was then spectrally sensitized and coated as described for Coating 1.

Coating 3

The tabular grain AgCl/AgBr epitaxial Emulsion 11B spectrally sensitized with Dye B was additionally sensitized with 0.15 millimole of Dye D per silver mole following the silver chloride deposition and then was coated as described for Coating 1.

The coatings were exposed and processed in a time of development series as described in Example 2. Sensitometric results are given in Table VII below.

EXAMPLE 12

This example illustrates a AgCl/AgBrI epitaxial emulsion prepared by the addition of a fine grain AgCl emulsion to a tabular grain AgBrI emulsion.

Emulsion 12A AgCl Fine Grain Emulsion

To 3.0 liters of a 3.3% gelatin solution containing $3.4\times10^{-3}$ molar NaCl at 35° C. were added with stirring and by double-jet, a 4.0 molar sodium chloride solution and a 4.0 molar silver nitrate solution for 0.4 minute at pAg 6.9 preparing 0.24 mole of AgCl emulsion.

Emulsion 12B AgCl/AgBrI Epitaxial Emulsion Containing 2.5 Mole % AgCl 30 g of the tabular grain AgBrI (6 mole % iodide) Emulsion 1A was spectrally sensitized with 1.1 millimole of Dye A/Ag mole and held for 15 minutes at 40° C. Then 10 g of the AgCl Emulsion 12A ($1\times10^{-3}$ mole) prepared above was added to the tabular grain AgBrI Emulsion 1A (0.04 mole) and stirred for 30 minutes at 40° C.

Figure 15:
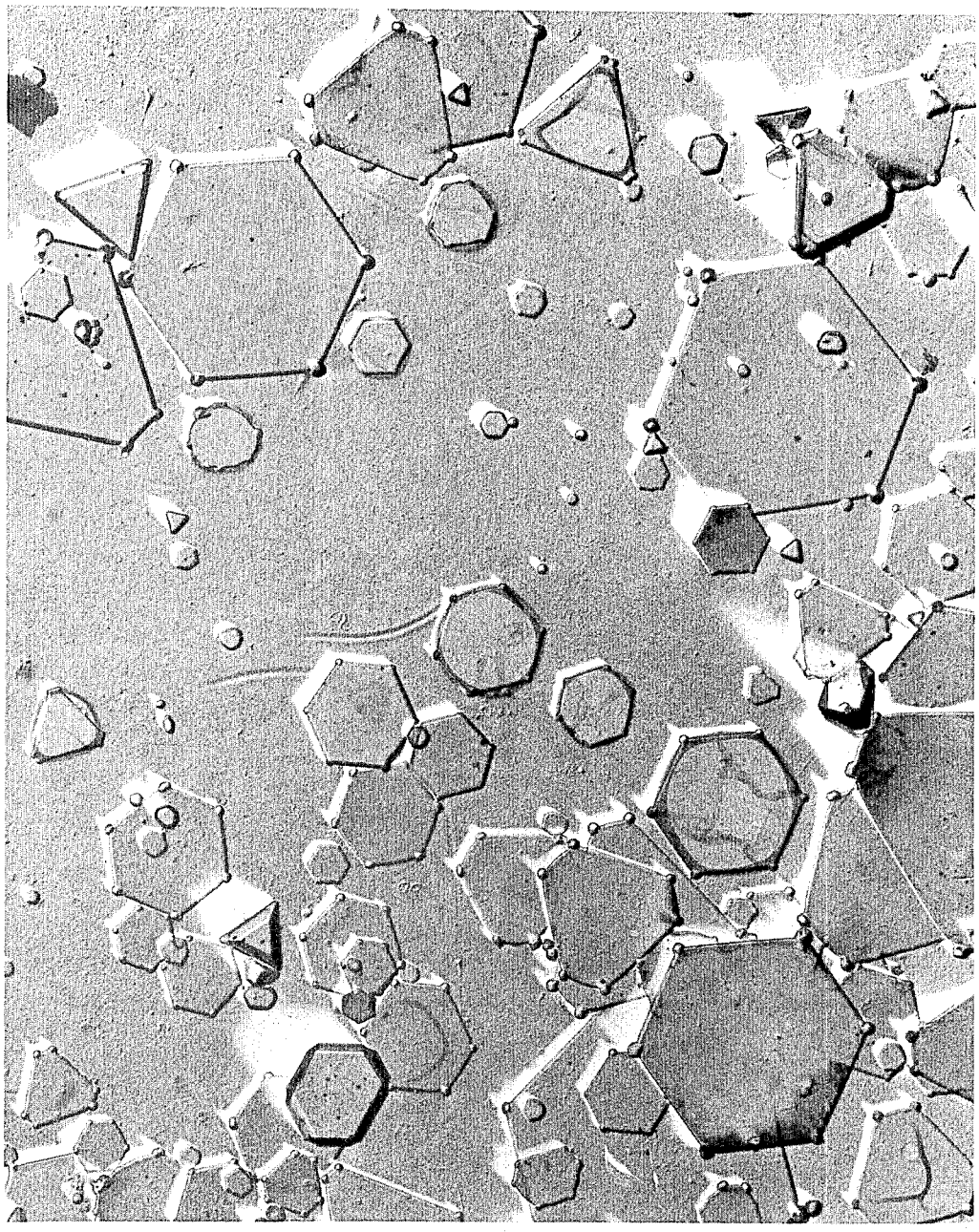

Electron micrographs reveal that the AgCl was selectively epitaxially deposited at the corners of the AgBrI tabular crystals. See FIG. 15 for a photomicrograph.

EXAMPLE 13

This example demonstrates that AgCl can be selectively epitaxially grown on the corners of host tabular silver bromoiodide grains in the absence of an adsorbed site director when sufficient iodide is present in the host grains.

Emulsion 13A Tabular Grain AgBrI (12 mole % iodide) Host

This emulsion, prepared by a double-jet precipitation technique, had an average grain diameter of 3.6 μm and an average grain thickness of 0.09 μm. The grains having a thickness of less than 0.3 micron and a diameter of at least 0.6 micron had an average aspect ratio of 40:1 and accounted for greater than 85% of the total projected area of the total grains present. The grains contained 12 mole % iodide, the iodide being uniformly introduced during double-jet precipitation. The emulsion was spectrally sensitized with 0.6 millimole of Dye A/Ag mole.

TABLE VII

| Coating | Emulsion | Spectral Sensitization (millimole/Ag mole) | Chemical Sensitization (mg/Ag mole) | Log Speed | $D_{min}$ |
|---|---|---|---|---|---|
| 1 | Host AgBr | Dye B (1.5) + D (0.15) | — | 255 | 0.20 |
| 2 | Host AgBr | Dye B (1.5) + D (0.15) | $KAuCl_4$ (1.5) + $Na_2S_2O_3.5H_2O$ (1.5) | 323 | 0.20 |
| 3 | AgCl/AgBr | Dye B (1.5) + D (0.15) | — | 386 | 0.20 |

As illustrated above, the epitaxial AgCl/AgBr Emulsion 11B, which was spectrally sensitized prior to the deposition of AgCl, was 131 log speed units faster than the spectrally sensitized host Emulsion 11A. Also, Emulsion 11B was even 63 log speed units faster than the chemically and then spectrally sensitized host Emulsion 11A.

Emulsion 13B

Emulsion 13B was prepared the same as Emulsion 13A above, except that prior to spectral sensitization the emulsion was chemically sensitized with 3.4 mg $Na_2S_2O_3.5H_2O$/Ag mole and 1.7 mg $KAuCl_4$/Ag mole for 10 minutes at 65° C.

Emulsion 13C Spectral Sensitization after Selective Corner Epitaxial Deposition

The tabular grain AgBrI (12 mole % iodide) emulsion 13A was adjusted to pAg 7.2 at 40° C. by the simultaneous addition of 0.1 molar $AgNO_3$ and 0.012 molar KI solutions. The emulsion was centrifuged and resuspended in a $1.85\times10^{-2}$ molar NaCl solution. Then 2.5 mole % AgCl was precipitated into 40 g of the host tabular grain emulsion (0.04 mole) by double-jet addition for 4 minutes of 0.55 molar NaCl and 0.5 molar $AgNO_3$ solutions while maintaining the pAg at 7.5 at 40° C. Then the emulsion was spectrally sensitized with 0.6 millimole of Dye A/Ag mole.

Figure 16:
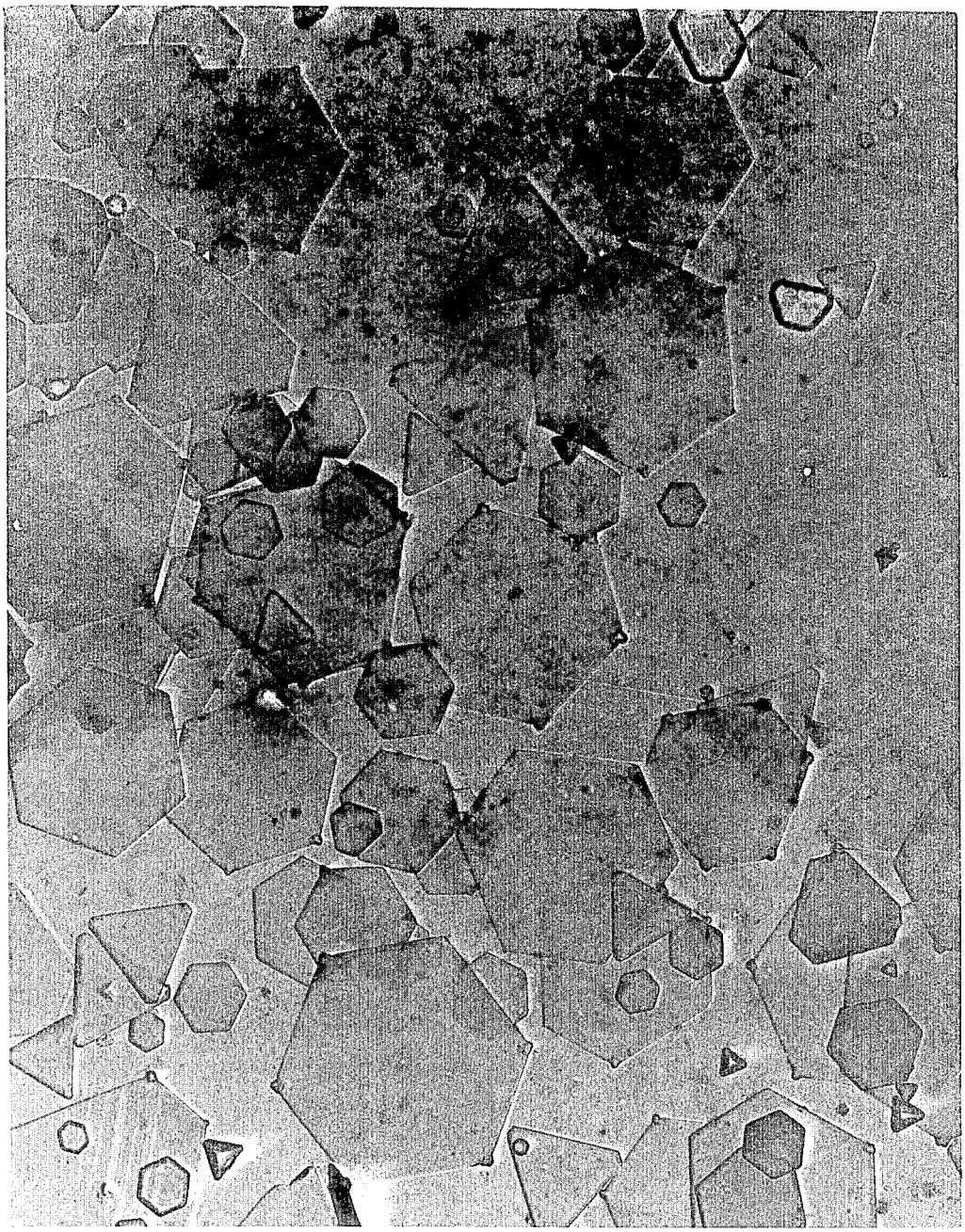

Emulsion 13C, which was spectrally sensitized after the addition of AgCl, had the AgCl deposited almost exclusively at the corners of the AgBrI tabular crystals. FIG. 16 represents a carbon replica electron micrograph of Emulsion 13C.

Emulsions 13A, 13B, and 13C were coated, exposed and processed in a time of development series as described in Example 2. Sensitometric results are listed in Table VIII below.

TABLE VIII

| Emulsion | Chemical Sensitization | Spectral Sensitization | Log Speed | $D_{min}$ |
|---|---|---|---|---|
| A. AgBrI host emulsion | none | Dye A | 198 | 0.10 |
| B. AgBrI host emulsion | S + Au | Dye A | 214 | 0.10 |
| C. AgCl/AgBrI (12 mole % iodide) | none | Dye A | 275 | 0.10 |

Example 14

This example demonstrates that the AgCl epitaxial growth on a spectrally sensitized tubular grain AgBrI emulsion can be limited to less than all of the corner sites.

Emulsion 14A Selective Corner AgCl Epitaxial Growth

Emulsion 14A was prepared similarly to the host AgBrI Emulsion 1A of Example 1. Following precipitation, the emulsion was adjusted to pAg 7.2 at 40° C. by the simultaneous addition of 2.0 molar $AgNO_3$ and 0.12 molar KI. Then sodium chloride was added to make the emulsion $1.8\times10^{-2}$ mole/liter in chloride ion. The emulsion was spectrally sensitized with 1.5 millimole Dye A/Ag mole and held for 30 minutes at 40° C. Then 1.2 mole % AgCl was precipitated into 9.5 liters of host emulsion (3.9 moles) by double-jet addition for 4 minutes of 2.19 molar NaCl and 2.0 molar $AgNO_3$ solutions while maintaining the pAg at 7.2 at 40° C.

Figure 17:
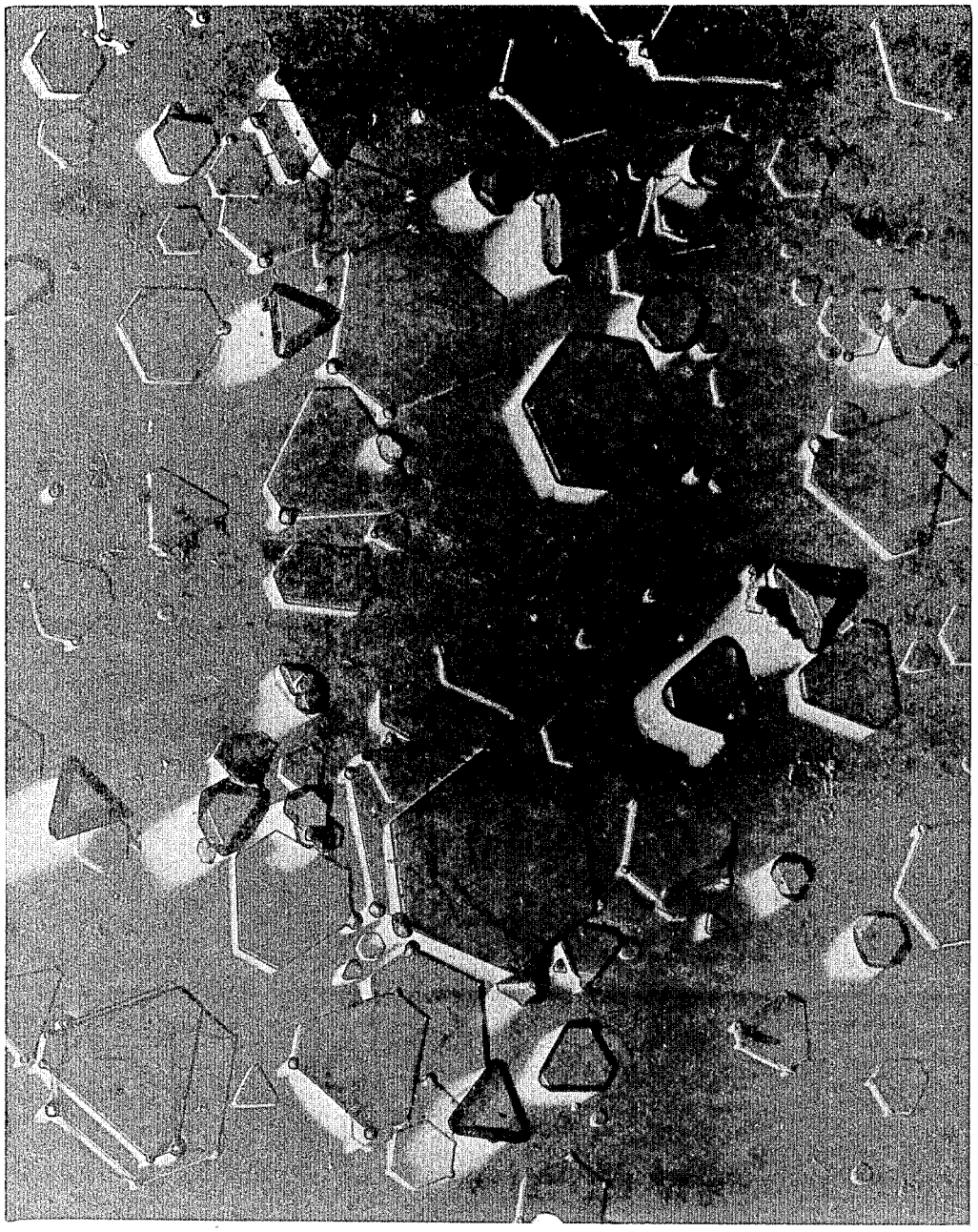

Electron micrographs of Emulsion 14A revealed that the growth of AgCl on the spectrally sensitized tabular grains AgBrI (6 mole % iodide) emulsion was generally limited to fewer than six corner sites of each hexagonal tubular crystal. FIG. 17 is a representative electron micrograph.

EXAMPLE 15

This example demonstrates the selective epitaxial deposition of AgCl at central, annular sites of reduced iodide content of tubular silver bromoiodide host grains.

Emulsion 15A Tabular Grain AgBrI (12 mole % iodide) Host with Central Band of AgBr To 6.0 liters of a 1.5% gelatin solution containing 0.12 M potassium bromide at 55° C. were added with stirring and by double-jet, a 1.12 molar KBr solution containing 0.12 molar KI and a 1.0 molar $AgNO_3$ solution for 1 minute at pBr 0.92 (consuming 0.6% of the total silver used). Then the temperature was increased to 70° C. over a period of 7 minutes. A 2.0 molar KBr solution containing 0.24 molar KI and a 2.0 molar $AgNO_3$ solution were run concurrently maintaining a constant pBr in an accelerated flow (2.75X from start to finish) for 17.6 minutes (consuming 29.2% of the silver used). The temperature was reduced to 55° C. A 2.0 molar KBr solution and 2.0 molar $AgNO_3$ solution were added for 2.5 minutes while maintaining the pBr of 0.92 (consuming 11.7% of the total silver used). Then a 2.0 molar KBr solution containing 0.24 molar KI and a 2.0 molar $AgNO_3$ solution were run concurrently for 12.5 minutes while maintaining pBr 0.92 at 55° C. (consuming 58.5% of the total silver used). A total of approximately 3.4 moles of silver was used. The emulsion was cooled to 35° C., washed by the coagulation method of Yutzy and Russell U.S. Pat. No. 2,614,929 and stored at pAg 8.4 measured at 35° C. The resultant tabular grain AgBrI (12 mole % iodide) emulsion had an average grain diameter of 1.8 μm and an average grain thickness of 0.13 μm. The grains having a thickness of less than 0.3 micron and a diameter of at least 0.6 micron exhibited an average aspect ratio of 13.8:1 and accounted for 80% of the total projected area of the grains.

Emulsion 15B Selective Annular Site AgCl Epitaxial Growth 40 g of the tabular grain AgBrI (12 mole % iodide) host Emulsion 15A (0.04 mole) prepared above was adjusted to pAg 7.2 at 40° C. with a 0.1 molar $AgNO_3$ solution. Then 1.0 ml of a 0.74 molar NaCl solution was added. Then 5 mole % AgCl was precipitated into the host tabular grain emulsion by double-jet addition for 1 minutes of 1.04 molar NaCl and 1.0 molar $AgNO_3$ solutions while maintaining the pAg at 7.5 at 40° C.

Emulsion 15C Selective AgCl Epitaxial Growth at Fewer Sites in Annular Region

Emulsion 15C was prepared similar to Emulsion 15B above, except that 0.55 molar NaCl and 0.5 molar $AgNO_3$ reagents were added for 7.8 minutes while maintaining the pAg at 7.5 at 40° C.

Figure 18:
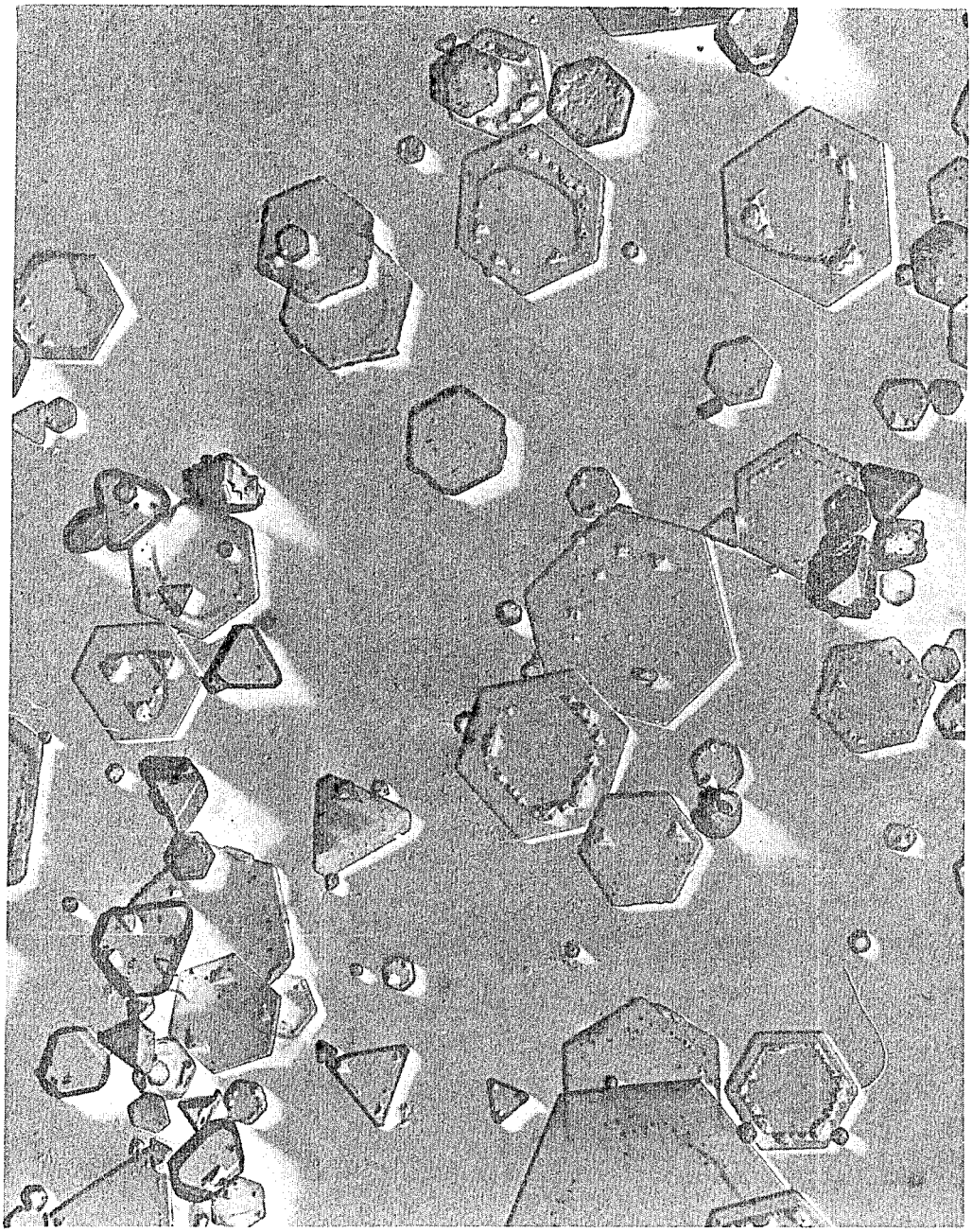

FIG. 18 represents a carbon replica electron micrograph of AgCl/AgBrI epitaxial Emulsion 15B. A concentric inner hexagonal (or triangular) ring of AgBr was formed during precipitation of the tabular AgBrI crystals onto which the AgCl was selectively deposited. Note that the epitaxial deposition of AgCl can occur on the AgBr ring as discreet crystallites and that the 12 mole % iodide tabular crystals were not spectrally sensitized. Similar results were observed for Emulsion 15C, except that the slower rate of silver chloride epitaxial deposition resulted in fewer epitaxial growth grains, with individual growths being therefore larger.

EXAMPLE 16

This example demonstrates the epitaxial deposition of AgCl on an AgBr circumferential region of a tabular AgBrI grain. The host emulsion was not spectrally sensitized prior to the AgCl addition.

sensitized with 1.10 millimoles Dye A/Ag mole, and then coated and tested as described for Emulsion A. Sensitometric results reveal that the AgSCN/AgBrI epitaxial emulsion was 0.34 log E speed units faster than the tabular grain AgBrI host emulsion at an equal $D_{min}$ level (0.10).

EXAMPLE 20

This example illustrates the epitaxial deposition of AgSCN on a tabular grain AgCl emulsion.

Control Emulsion 20A Tabular Grain AgCl Host

To 2.0 liters of a 0.625% synthetic polymer, poly(3-thiapentylmethacrylate)-co-acrylic acid-co-2-methacryloyloxyethyl-1-sulfonic acid, sodium salt, (1:2:7) solution containing 0.35% ($2.6\times10^{-2}$ molar) adenine, 0.5 molar $CaCl_2$, and $1.25\times10^{-2}$ molar NaBr at pH 2.6 at 55° C. were added with stirring and by double-jet a 2.0 molar $CaCl_2$ solution and 2.0 molar $AgNO_3$ solution for 1 minute (consuming 0.08% of the total silver used). The chloride and silver solutions were then run concurrently at controlled pCl in an accelerated flow (2.3X from start to finish) over 15 minutes (consuming 28.8% of the total silver used). Then the chloride and silver solutions were run for an additional 26.4 minutes (consuming 71.1% of the total silver used). A 0.2 molar NaOH solution (30.0 ml) was added slowly during approximately the first one-third of the precipitation to maintain the pH at 2.6 at 55° C. A total of approximately 2.6 moles of silver was used. The emulsion was cooled to room temperature, dispersed in $1\times10^{-3}$ molar $HNO_3$, settled, and decanted. The solid phase was resuspended in a 3% gelatin solution and adjusted to pAg 7.5 at 40° C. with a NaCl solution. The resultant tabular grain AgCl emulsion had an average grain diameter of 4.3 μm, an average thickness of 0.28 μm, and an average aspect ratio of 15:1 and 80% of the grains were tabular based on total projected area.

Emulsion 20B Edge Selective AgSNC Epitaxial Growth

Then 5 mole % AgSCN was precipitated into 40 g of the tabular grain AgCl host Emulsion 20A (0.04 mole) prepared above the double-jet addition for 7.8 minutes of 0.5 molar NaSCN and 0.5 molar $AgNO_3$ solutions.

Figure 24:
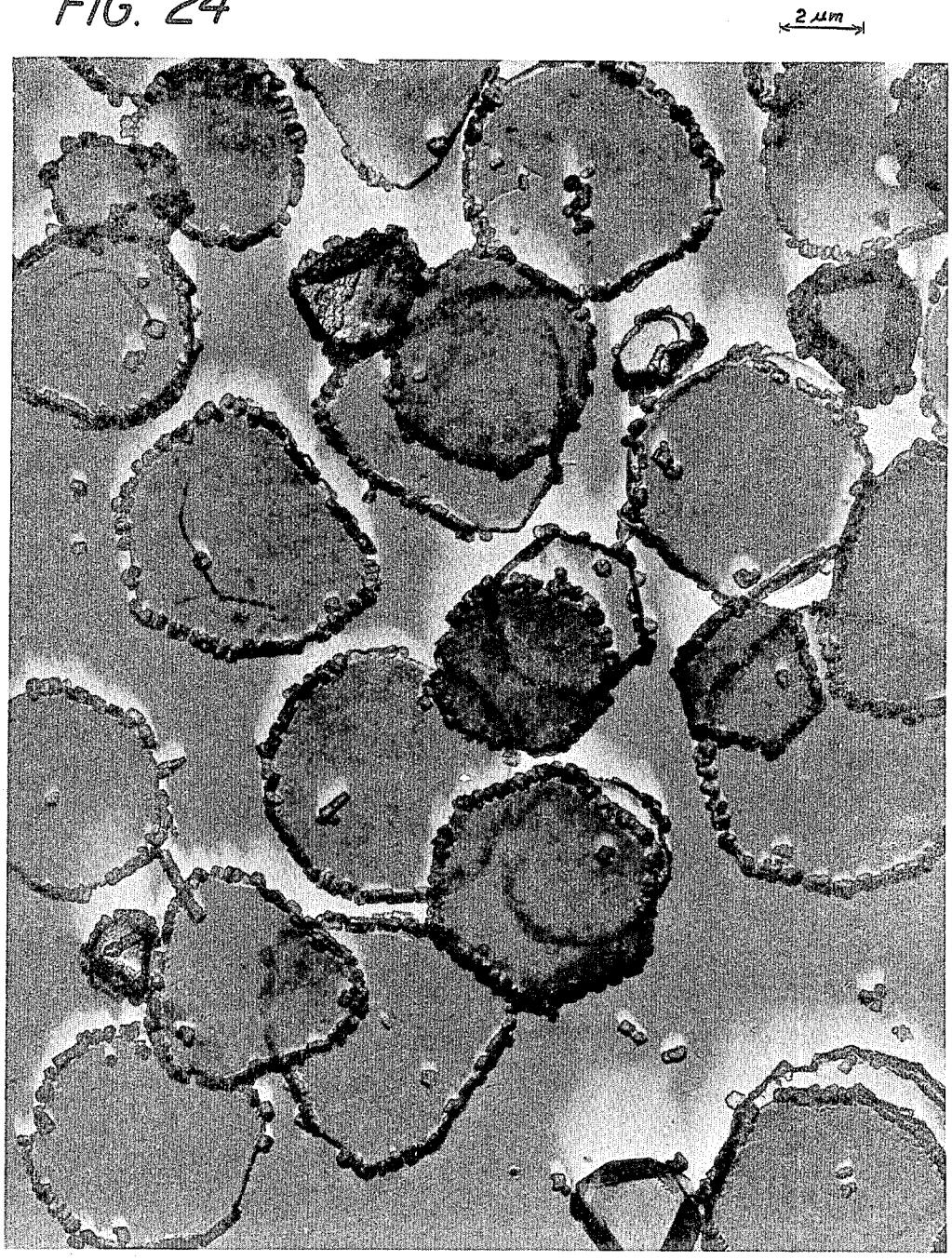

Electron micrographs of Emulsion 20B revealed that AgSCN was deposited almost exclusively at the edges of the AgCl tabular crystals. FIG. 24 is a representative electron micrograph of the emulsion. The AgCl tabular crystals contained both {110} and {111} edges, but AgSCN was deposited without preference at both types of edge sites.

EXAMPLE 21

This example demonstrates the controlled site deposition of AgBr on a spectrally sensitized tabular grain AgBr emulsion. The additional AgBr is deposited predominantly on the corners with some growth along the edges.

Emulsion 21A Controlled Site Growth of AgBr on AgBr 40 g of the tabular grain AgBr host Emulsion 4A (0.04 mole) described in Example 4 was adjusted to pAg 7.2 at 40° C. with a 0.1 molar $AgNO_3$ solution. The emulsion was spectrally sensitized with 2.4 millimoles of Dye E, anhydro-5,5',6,6'-tetrachloro-1,1'-diethyl-3,3'-bis(3-sulfobutyl)benzimidazolocarbocyanine hydroxide triethylamine salt/Ag mole and held for 5 minutes at 40° C. Then 6.25 mole % AgBr was precipitated into the host tabular grain emulsion by double-jet addition for 15.7 minutes of 0.2 molar NaBr and 0.2 molar $AgNO_3$ solutions while maintaining the pAg at 7.2 at 40° C.

Figure 25:
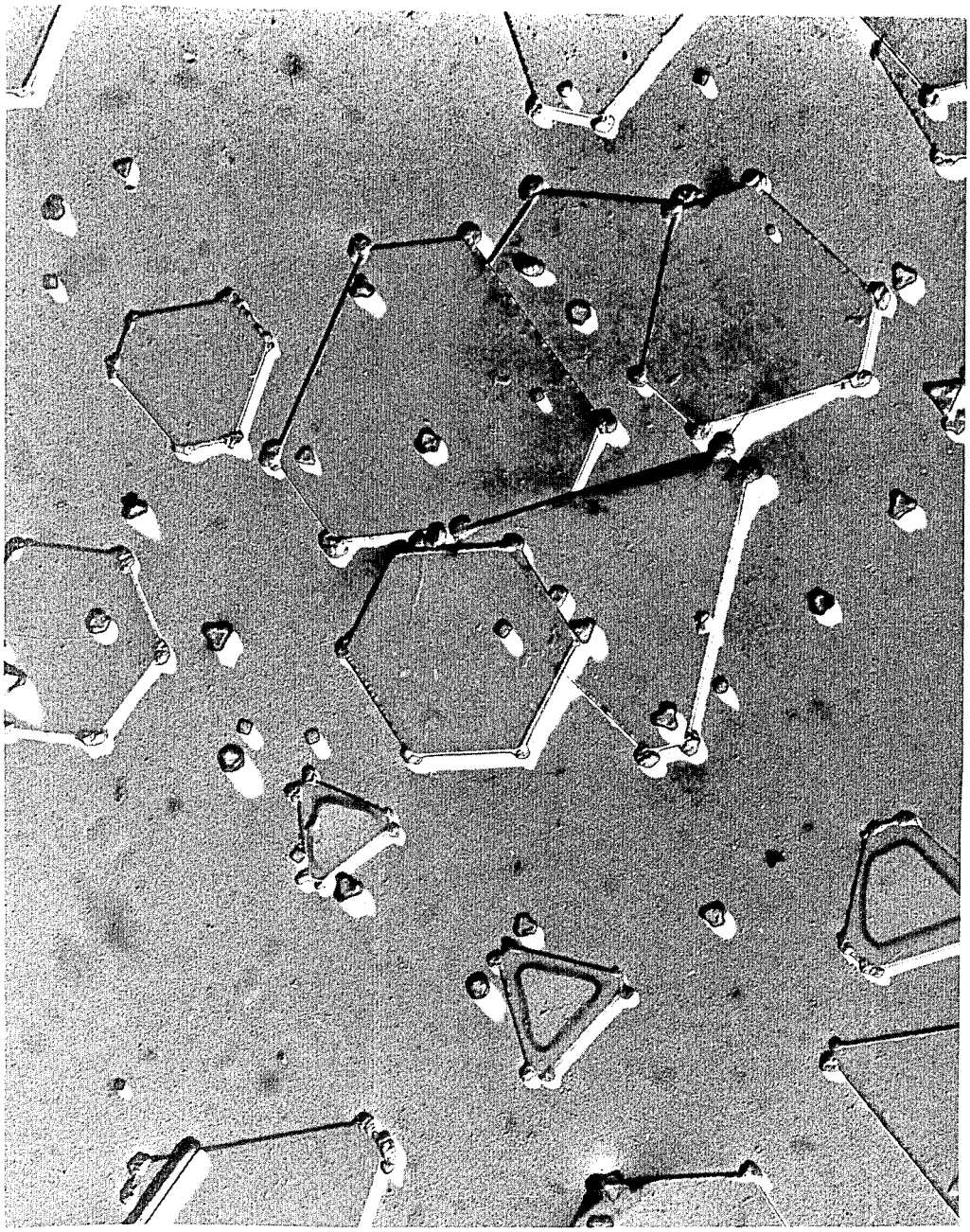

FIG. 25 represents a carbon replica electron micrograph of the emulsion. Some deposition of silver bromide along the edges of the tabular grains is apparent, but the additional silver bromide deposited appears to be confined primarily at the corners of the tabular grains. The small grains overlying the major faces of the tabular grains in the electron micrograph are separate from the underlying grains.

EXAMPLE 22

This example demonstrates the controlled site deposition of AgBrI on a spectrally sensitized tabular grain AgBrI emulsion. The additional AgBrI was chemically sensitized as deposited and was deposited selectively at the corners of the host grains.

Emulsion 22A Tabular Grain AgBrI (6 mole % iodide) Host

The tabular grain AgBrI (6 mole % iodide) host Emulsion 1A was chemically sensitized with 4 mg $Na_2S_2O_3.5H_2O$/Ag mole plus 4 mg $KAuCl_4$/Ag mole for 10 minutes at 60° C. and then spectrally sensitized with 1.2 millimoles Dye A/Ag mole.

Emulsion 22B Corner Selective AgBrI Growth

The AgBrI (6 mole % iodide) host Emulsion 1A was spectrally sensitized with 1.2 millimole Dye A/Ag mole, centrifuged and resuspended in distilled water. Then 2.5 mole % AgBrI containing 6 mole % iodide was precipitated onto 40 g of the emulsion (0.04 mole) by double-jet addition for 9.9 minutes using a solution containing 0.188 molar KBr and 0.012 molar KI and a solution of 0.2 molar $AgNO_3$ while maintaining the pAg at 7.5 at 40° C. At 15 seconds after the start of the precipitation 1.0 mg $Na_2S_2O_3.5H_2O$/Ag mole and 1.0 mg $KAuCl_4$/Ag mole were added. After the precipitation was complete, the resulting emulsion was heated for 10 minutes at 60° C.

Figure 26:
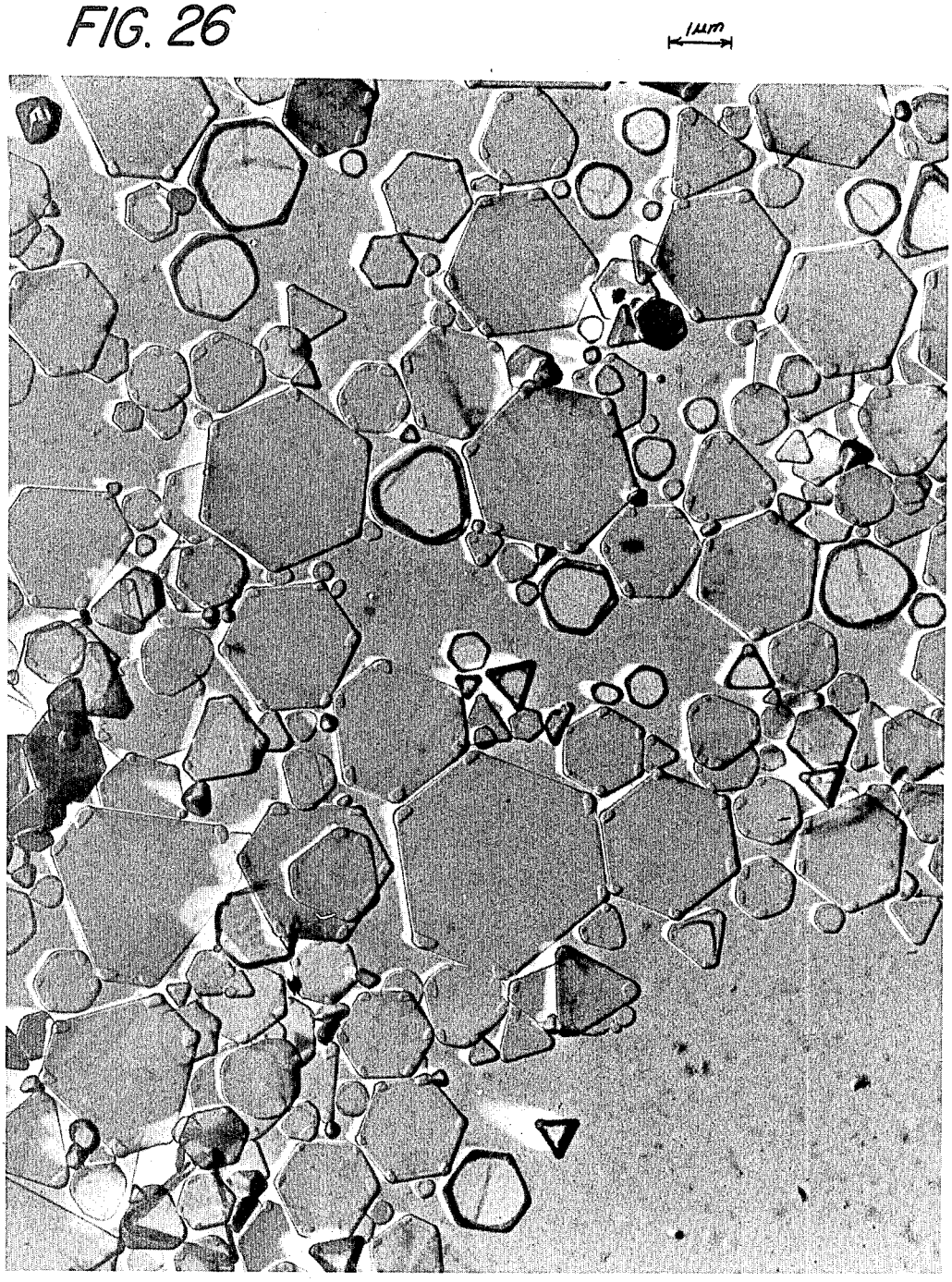

Electron micrographs of Emulsion 22B revealed that AgBrI had deposited at the corners of the AgBrI host emulsion. FIG. 26 is a representative electron micrograph.

Emulsions 22A and 22B were coated on cellulose triacetate support at 1.61 g/m² silver and 3.58 g/m² gelatin and exposed and processed in a time of development series similar to that described in Example 2. Sensitometric results revealed that at equal $D_{min}$ (0.2) Emulsion 22B was 0.62 log E faster in speed than Emulsion 22A.

EXAMPLE 23

This example illustrates a silver halide emulsion with tabular grains of slightly greater than 8:1 average aspect ratio which have 2.44 mole percent silver chloride preferentially deposited at the corners and edges of the tabular grains.

Emulsion 23A Tabular Grain AgBrI Host with 8.1:1 Average Aspect Ratio

A. Preparation of Tabular Grain AgBr Core Emulsion

To 6.0 liters of a well stirred aqueous bone gelatin (1.5 percent by weight) solution which contained 0.142 molar potassium bromide were added a 1.15 molar potassium bromide solution and a 1.0 molar silver nitrate solution by double-jet addition at constant flow for two minutes at controlled pBr 0.85 consuming 1.75 percent of the total silver used. Following a 30 second hold the emulsion was adjusted to pBr 1.22 at 65° C. by the addition of a 2.0 molar silver nitrate solution by constant flow over a 7.33 minute period consuming 6.42 percent of the total silver used. Then a 2.29 molar potassium bromide solution and a 2.0 molar silver nitrate solution were added by double-jet addition by accelerated flow (5.6x from start to finish) over 26 minutes at controlled pBr 1.22 at 65° C. consuming 37.6 percent of the total silver used. Then the emulsion was adjusted to pBr ~2.32 at 65° C. by the addition of a 2.0 molar silver nitrate solution by constant flow over a 6.25 minute period consuiming 6.85 percent of the total silver used. A 2.29 molar potassium bromide solution and a 2.0 molar silver nitrate solution were added by double-jet addition using constant flow rate for 54.1 minutes at controlled pBr 2.32 at 65° C. consuming 47.4 percent of the total silver added. A total of approximately 9.13 moles of silver were used to prepare this emulsion. Following precipitation the emulsion was cooled to 40° C., 1.65 liters of a phthalated gelatin (15.3 percent by weight) solution was added, and the emulsion was washed two times by the coagulation process of Yutzy and Russell U.S. Pat. No. 2,614,929. Then 1.55 liters of a bone gelatin (13.3 percent by weight) solution was added and the emulsion was adjusted to pH 5.5 and pAg 8.3 at 40° C.

The resultant tabular grain AgBr emulsion had an average grain diameter of 1.34 μm, an average thickness of 0.12 μm, and an average aspect ratio of 11.2:1.

Addition of AgBr Shell

To 2.5 liters of a well-stirred aqueous 0.4 molar potassium nitrate solution containing 1479 g (1.5 moles) of the core emulsion were added a 1.7 molar potassium bromide solution and a 1.5 molar silver nitrate solution by double-jet addition at constant flow for 135 minutes at controlled pAg 8.2 at 65° C. consuming 5.06 moles of silver. Following precipitation the emulsion was cooled to 40° C., 1.0 liter of a phthalated gelatin (19.0 percent by weight) solution was added, and the emulsion was washed three times by the coagulation process of Yutzy and Russell U.S. Pat. No. 2,614,929. Then 1.0 liter of a bone gelatin (14.5 percent by weight) solution was added and the emulsion was adjusted to pH 5.5 and pAg 8.3 at 40° C.

The resultant tabular grain AgBr emulsion had an average grain diameter of 2.19 μm, an average thickness of 0.27 μm, and an average aspect ratio of 8.1:1, and greater than 80 percent of the projected area was provided by tabular grains.

Emulsion 23B Soluble Iodide (0.5 Mole Percent) Site Director

To 40.0 g (0.04 mole) of the host Emulsion 23A at 40° C. were added 0.5 mole percent iodide by introduction of a 0.04 molar potassium iodide solution at constant flow over a ten minute period. The emulsion was centrifuged and represented in a $1.8\times10^{-2}$ molar sodium chloride solution to a total weight of 40.0 g. Then 2.44 mole percent AgCl was precipitated into the host grain emulsion by the double-jet addition of 0.55 molar NaCl and 0.50 molar $AgNO_3$ solutions at constant flow for 3.9 minutes while maintaining the pAg of 7.5 at 40° C. The epitaxial AgCl was located almost exclusively at the corners of the tabular grains.

Emulsion 23C Spectral Sensitizer Site Director 40.0 g (0.04 mole) of Emulsion 23A was adjusted to pAg 7.2 at 40° C. using a 0.10 molar $AgNO_3$ solution. Then 1.0 ml of a 0.61 molar NaCl solution was added. The emulsion was spectrally sensitized with 0.84 millimole of anhydro-5,5'-6,6'-tetrachloro-1,1'-diethyl-3,3'-di(3-sulfobutyl)-benzimidazolocarbocyanine hydroxide/Ag mole and held for 16 minutes at 40° C. Then 2.44 mole percent AgCl was precipitated into the host grain emulsion by the double-jet addition of 0.55 molar NaCl and 0.50 molar $AgNO_3$ solutions at constant flow for 3.9 minutes while maintaining the pAg of 7.5 at 40° C. The epitaxial AgCl was located at the corners and along the edges of the AgBr tabular grains.

Emulsion 23D Control—No Site Director

When epitaxial deposition was repeated, but with iodide and spectral sensitizing dye both absent, AgCl was deposited randomly over the surfaces of the host tabular grains.

EXAMPLE 24

This example illustrates that it is possible to use host high aspect ratio tubular grains of the type disclosed by Maskasky, cited above, to orient silver salt epitaxy selectively at alternate edge sites. Such host tabular grains present dodecagonal projected areas formed by six edges lying in one set of crystal planes, believed to be (111) planes, alternated with six edges lying in a second set of crystal planes, believed to be (110) crystal planes.

Emulsion 24A Dodecagonal Projected Area Tabular Host Grains

A 3.0 liter aqueous solution containing poly(3-thiopentylmethacrylate-co-acrylic acid-co-2-methacryloyloxyethyl-1-sulfonic acid, sodium salt) (0.625% polymer, 1:2:7 molar ratio), adenine (0.021 molar), sodium bromide (0.0126 molar), and calcium chloride (0.50 molar) was prepared at pH 2.6 at 55° C. Aqueous solutions of calcium chloride (2.0 molar) and silver nitrate (2.0 molar) were added by double-jet addition at a constant flow rate for two minutes consuming 3.98% of the total silver used. The halide and silver salt solutions were added for an additional 15 minutes utilizing accelerated flow (2.3X from start to finish) consuming 49.7% of the total silver used. Then the halide and silver salt solutions were run for 10 minutes at a constant flow rate consuming 46.4% of the total silver used. The pH was maintained throughout at ~2.6. Approximately 2.26 moles of silver were used to prepare this emulsion. The resultant AgClBr (99.6:0.4) emulsion contained tabular grains which were dodecagonal in their projected area, had an average grain size of 3 μm, an average thickness of 0.25 μm, and an aspect ratio of 12:1, and greater than 85% of the projected area was provided by tabular grains.

Emulsion 16A Tabular Grain AgBrI (12 mole % iodide) Host with Circumferential AgBr Region (16.6 Mole Percent of Total)

To 6.0 liters of a 1.5% gelatin solution containing 0.12 M potassium bromide at 55° C. were added with stirring and by double-jet, a 1.12 molar KBr solution containing 0.12 molar KI and a 1.0 molar $AgNO_3$ solution for 1 minute at pBr 0.92 (consuming 0.5% of the total silver used). Then the temperature was increased to 70° C. over a period of 7 minutes. A 2.0 molar KBr solution containing 0.24 molar KI and a 2.0 molar $AgNO_3$ solution were run concurrently maintaining a constant pBr in an accelerated flow (4.0X from start to finish) for 30 minutes (consuming 82.9% of the total silver used). The temperature was reduced to 55° C. A 2.0 molar KBr solution and a 2.0 molar $AgNO_3$ solution were added for 3.75 minutes while maintaining the pBr of 0.92 (consuming 16.6% of the total silver used). A total of approximately 3.6 moles of silver was used. The emulsion was cooled to 35° C., washed by the coagulation method of Yutzy and Russell U.S. Pat. No. 2,614,929 and stored at pAg 8.4 measured at 35° C. The resultant tabular grain AgBrI (12 mole % iodide) emulsion had an average grain diameter of 2.2 μm and an average thickness of 0.09 μm. The grains having a thickness of less than 0.3 micron and a diameter of at least 0.6 micron exhibited an average aspect ratio of 24:1 and accounted for 80% of the total projected area of the grains.

Emulsion 16B Peripheral AgCl Epitaxial Growth

The tabular grain AgBrI (12 mole % iodide) host Emulsion 16A was dispersed in 2.5 times its volume in distilled water, centrifuged and then resuspended in distilled water to a final silver content of 1 Kg/Ag mole. Then 2.5 mole % AgCl was precipitated onto 0.04 mole of the host Emulsion 16A by double-jet addition for 0.8 minute of 0.25 molar NaCl and 0.25 molar $AgNO_3$ solutions while maintaining the pAg at 6.75 at 40° C. The emulsion was then spectrally sensitized with 1.0 millimole Dye A/Ag mole.

Figure 19:
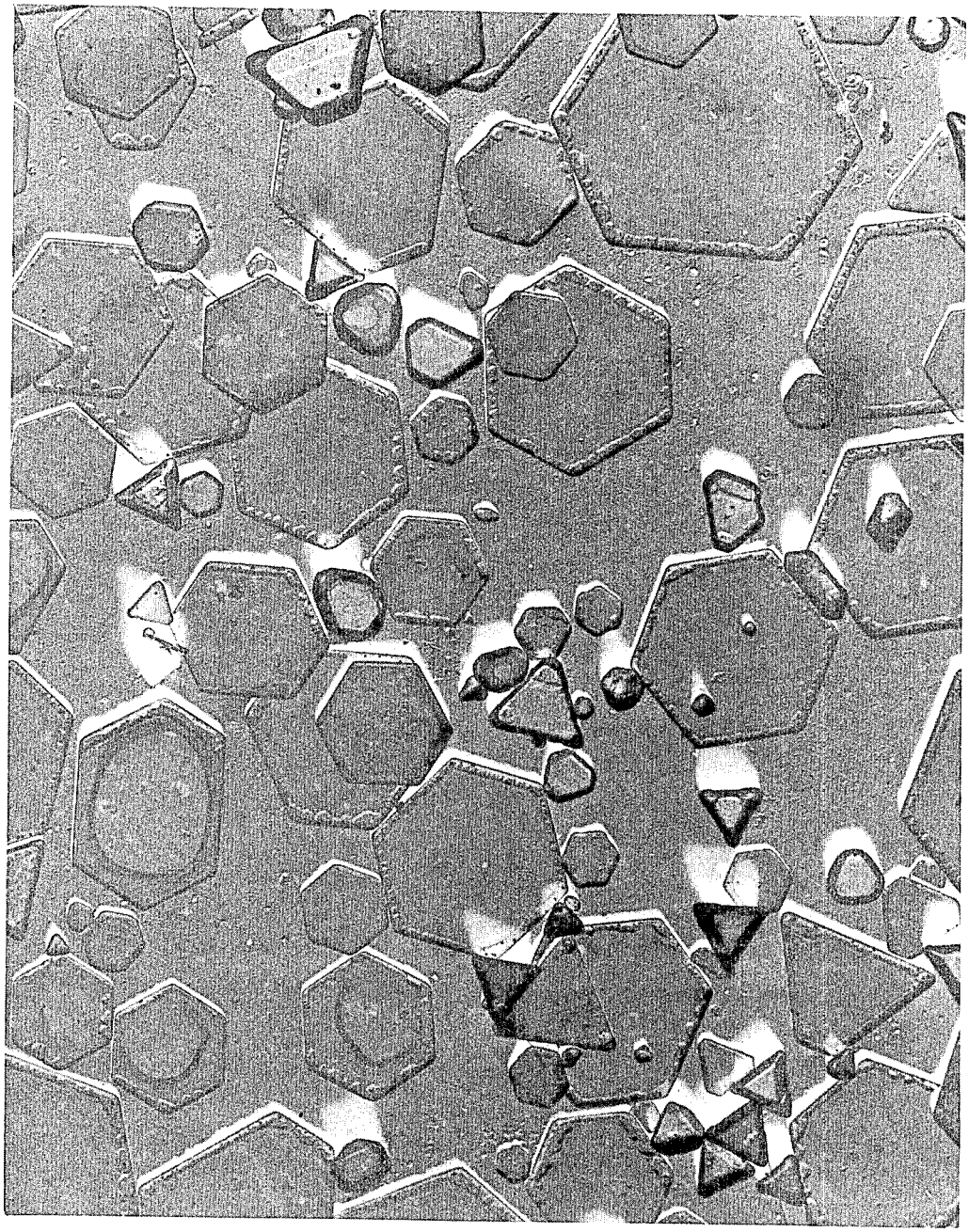

Electron micrographs of Emulsion 16B revealed that the AgCl was epitaxially deposited along the edges of the nonspectrally sensitized tabular grain AgBrI (12 mole % iodide) host emulsion. The AgCl growth occurred selectively at the peripheral regions of the host AgBrI crystal. FIG. 19 is a representative electron micrograph.

Emulsion 16C Sensitization of Emulsion 16A

To a portion of Emulsion 16A was added 3.0 mg $Na_2S_2O_3.5H_2O$/Ag mole and 1.5 mg $KAuCl_4$/Ag mole. The mixture was heated to 65° C. for 10 min, cooled to 40° C. and finally 1.0 millimole Dye A/Ag mole was added.

Emulsions 16B and 16C were coated on cellulose triacetate support at 1.61 g/m$^2$ silver and 3.58 g/m$^2$ gelatin and exposed and processed in a time of development series similar to that described in Example 2. Sensitometric results reveal that at equal $D_{min}$ (0.15) Emulsion 16B was 0.16 log E faster in speed than Emulsion 16 C. Note that Emulsion 16B was not treated with either of the chemical sensitizers, $Na_2S_2O_3$ or $KAuCl_4$.

EXAMPLE 17

This example demonstrates the selective deposition of AgCl on a AgBr central region of a tabular grain AgBrI emulsion. The AgCl growths were internally sensitized with iridium. The emulsion was not spectrally sensitized prior to the AgCl addition.

Emulsion 17A Tabular AgBrI Grains with Central AgBr Region

This emulsion was prepared by a double-jet precipitation technique. The emulsion consisted of an AgBr central region (6.7 mole % of entire grain) laterally surrounded by a AgBrI (12 mole % iodide) annular region. The emulsion had an average grain diameter of 1.9 μm and an average grain thickness of 0.08 μm. The grains having a thickness of less than 0.3 micron and a diameter of at least 0.6 micron exhibited an average aspect ratio of 24:1 and accounted for 80% of the total projected area of the grains.

Emulsion 17B

This emulsion was prepared by spectrally sensitizing a portion of Emulsion 17A with 0.6 millimole Dye A/Ag mole.

Emulsion 17C Selective Central Region AgCl Epitaxial Growth

A portion of Emulsion 17A was dispersed in distilled water, centrifuged, and then resuspended in a $1.85\times10^{-2}$ molar NaCl solution. Then 10 mole % AgCl was precipitated into 40 g of the host tabular grain emulsion (0.04 mole) by the double-jet addition for 17.6 minutes of 0.55 molar NaCl and 0.5 molar $AgNO_3$ solutions while maintaining the pAg at 7.5 at 40° C. Then the emulsion was spectrally sensitized with 0.6 millimole of Dye A/Ag mole.

Emulsion 17D

Emulsion 17D was prepared like Emulsion 17C above, except that 15 seconds after the start of the NaCl and $AgNO_3$ reagents an iridium sensitizer was added to the emulsion.

Emulsions 17B, 17C and 17D were coated on a polyester support at 1.61 g/m$^2$ silver and 3.58 g/m$^2$ gelatin. A 0.54 g/m$^2$ gelatin layer was coated over the emulsion layer. The coatings were exposed for 1/10 second to a 600W 2850° K. tungsten light source through a 0–6.0 density step tablet. The coatings were processed for 6 minutes at 20° C. in an Elon® (N-methyl-p-aminophenol sulfate)-ascorbic acid developer (A) or an Elon® (N-methyl-p-aminophenol sulfate)-ascorbic acid developer containing 10 g/liter sodium sulfite (B). The addition of sodium sulfite allowed both surface and internal development to occur; hence, Developer B was an "internal" developer as this term is used in the art (also referred to as a "total" developer). Developer A was a surface developer. Percentage silver developed was determined by X-ray fluorescence. Percent silver developed vs. exposure curves were than generated and the results are reported in Table IX below.

TABLE IX

| Emulsion | Developer A (Surface) Relative Threshold Speed | Gamma % Ag Developed Exposure | % Ag Developed Ag-max | % Ag Developed Ag-min | Developer B (Internal) Relative Threshold Speed | Gamma % Ag Developed Exposure | % Ag Developed Ag-max | % Ag Developed Ag-min |
|---|---|---|---|---|---|---|---|---|
| 17B | 0 (control) | 37 | 38% | 1% | +0.15 log E | 43 | 51% | 1% |
| 17C | +0.15 log E | 43 | 60% | 27% | +0.42 log E | 47 | 65% | 19% |
| 17D | −0.24 log E | 20 | 36% | 2% | +1.38 log E | 18 | 51% | 7% |

The highest relative speed was obtained with (surface plus) internal development of Emulsion 17D, which was doped with iridium during AgCl deposition. Emulsion 17D was low in speed when processed in the surface only developer. Neither Emulsions 17B nor 17C, which did not contain iridium, gave comparable results. These data illustrate the incorporation of iridium as an internal chemical sensitizer within the epitaxial AgCl phase.

Coatings of Emulsions 17B and 17D were also exposed for ½ second to a 600W 2850° K. tungsten light source through a 0–0.6 density step tablet and processed for 1 minute at 20° C. in a total (surface+internal) developer of the type described in Weiss et al U.S. Pat. No. 3,826,654. Another set of coatings were exposed and then bathed for 10 minutes at 20° C. in a potassium dichromate bleach ($1.3\times10^{-2}$ M $K_2Cr_2O_7$, $4.7\times10^{-2}$ M $H_2SO_4$) prior to processing in the total developer. Results are reported in Table X below.

TABLE X

| Emulsion | | Total Developer Relative Threshold Speed | Total Developer % Ag Developed* | Bleach-Total Developer Relative Threshold Speed | Bleach-Total Developer % Ag Developed* |
|---|---|---|---|---|---|
| 17B | AgBr—AgBrI | 0 (control) | 100% | 0 | 10% |
| 17D | AgCl—Ir/(AgBr—AgBrI) | +1.05 log E | 53% | +0.66 log E | 45% |

*Total Ag developed minus Ag-min divided by coated Ag, determined at 3.0 log E above threshold speed value As illustrated in Table X, Emulsion 17D was 1.05 log E faster in speed than the control Emulsion 17B. When the coating of control Emulsion 17B was bleached, most of the latent image was removed. However, when the coating of Emulsion 17D was bleached, a large loss of latent image did not occur. This indicated that the latent image was much less bleachable due to its subsurface location in the epitaxial AgCl phase.

Figure 20:
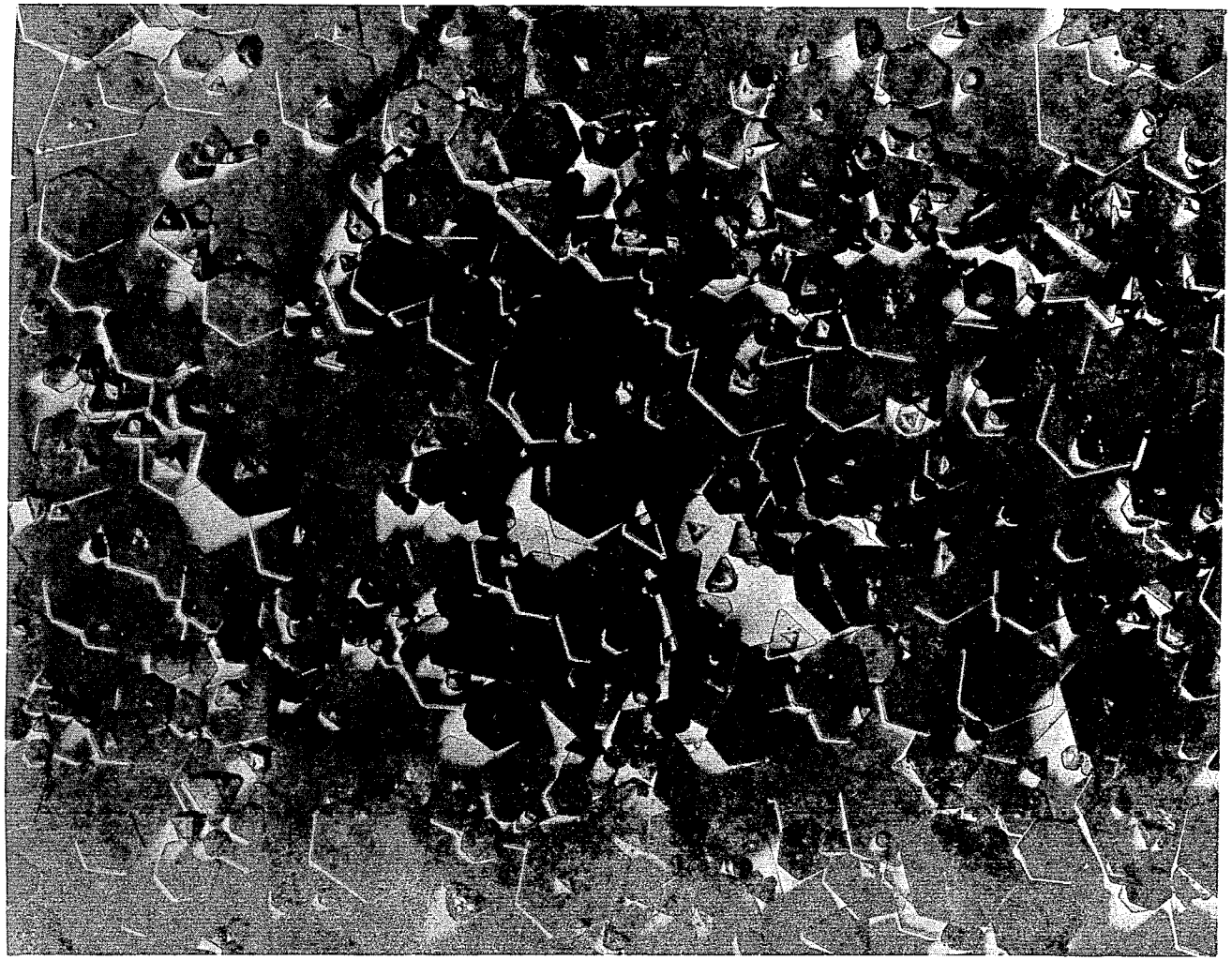
Figure 21:
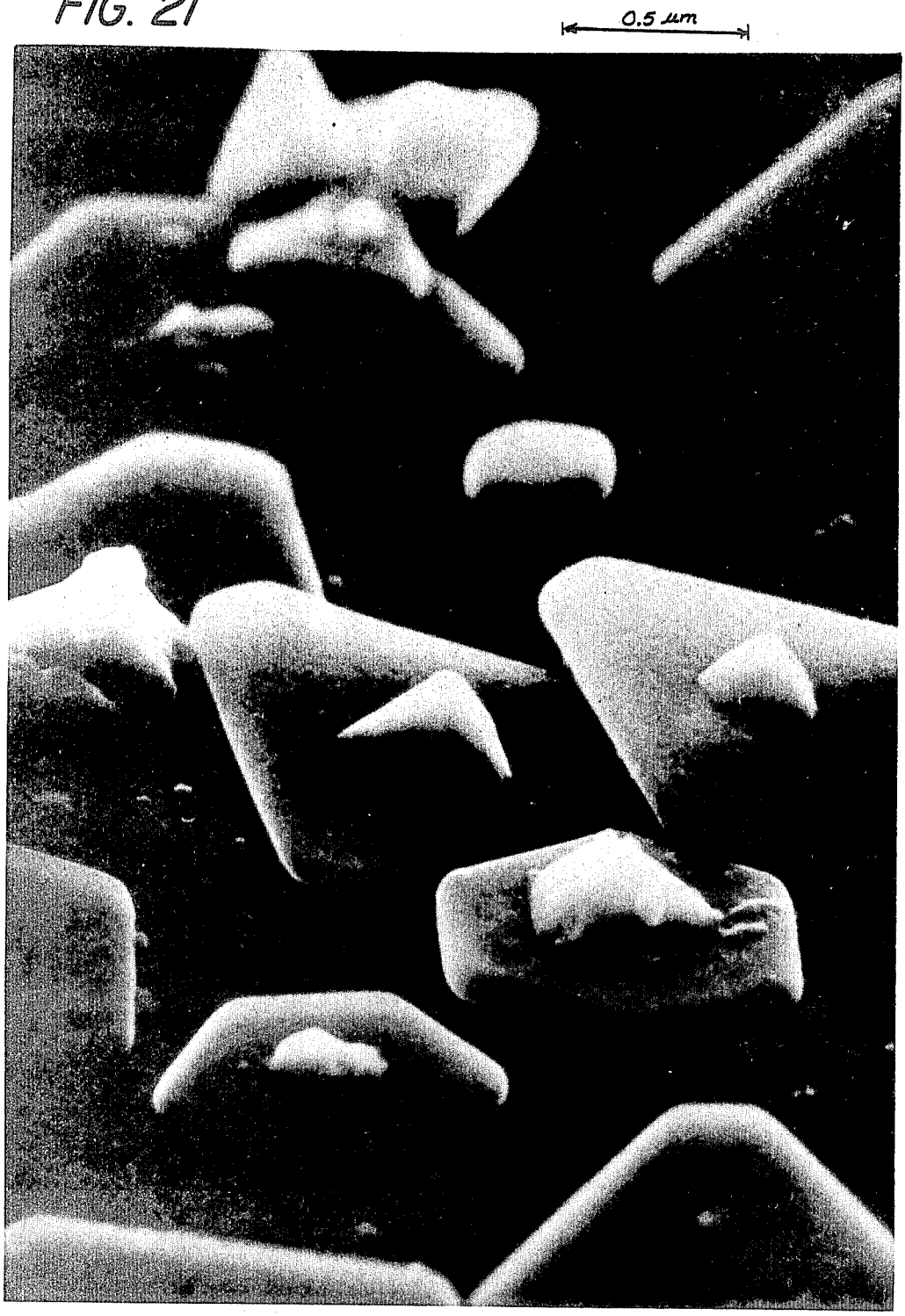

FIG. 20 is an electron micrograph of Emulsion 17C illustrating the epitaxial deposition of AgCl on the central AgBr region of the tabular AgBrI grains. FIG. 21 represents a secondary electron micrograph of Emulsion 17C, further illustrating the central location of the AgCl epitaxy.

EXAMPLE 18

This example illustrates the controlled site epitaxially deposition of AgSCN onto the tabular grains of a silver bromoiodide emulsion.

Emulsion 18A Edge Selective AgSCN Epitaxial Growth 40 g of the tabular grain AgBrI (6 mole % iodide) host Emulsion 1A (0.04 mole) described in Example 1 was adjusted to pAg 7.2 at 40° C. by the simultaneous addition of 0.1 molar $AgNO_3$ and 0.006 molar KI. Then 1.0 ml of a 0.13 molar NaSCN solution was added. Then 5 mole % AgSCN was precipitated into the host emulsion by double-jet addition for 16 minutes of 0.25 molar NaSCN and 0.25 molar $AgNO_3$ solutions while maintaining the pAg at 7.5 at 40° C.

Emulsion 18B Corner Selective AgSCN Epitaxial Growth

Emulsion 18B was prepared like Emulsion 18A above, except that prior to the double-jet addition of the NaSCN and $AgNO_3$ reagents the emulsion was spectrally sensitized with 1.1 millimoles Dye A/Ag mole.

Figure 22:
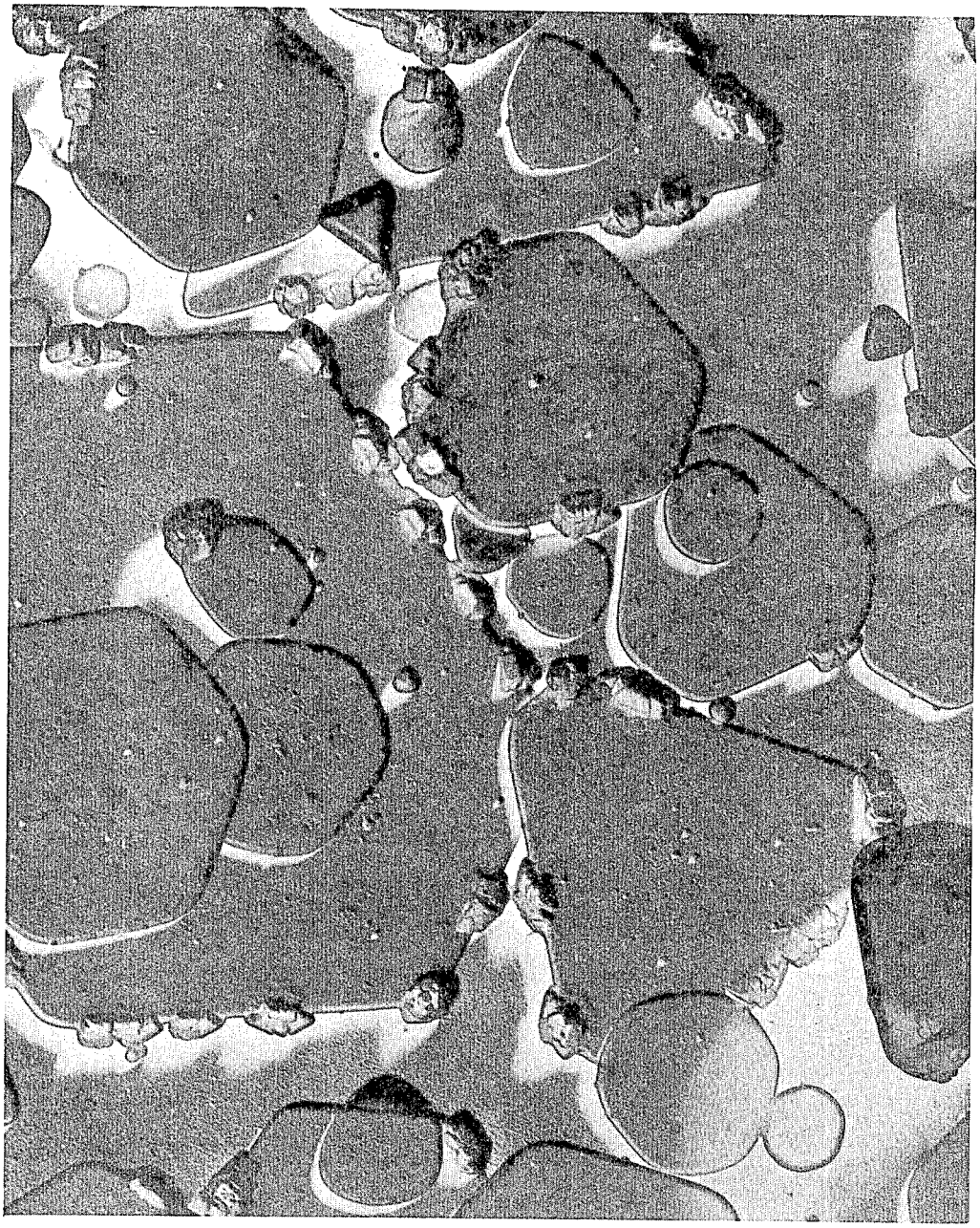
Figure 23:
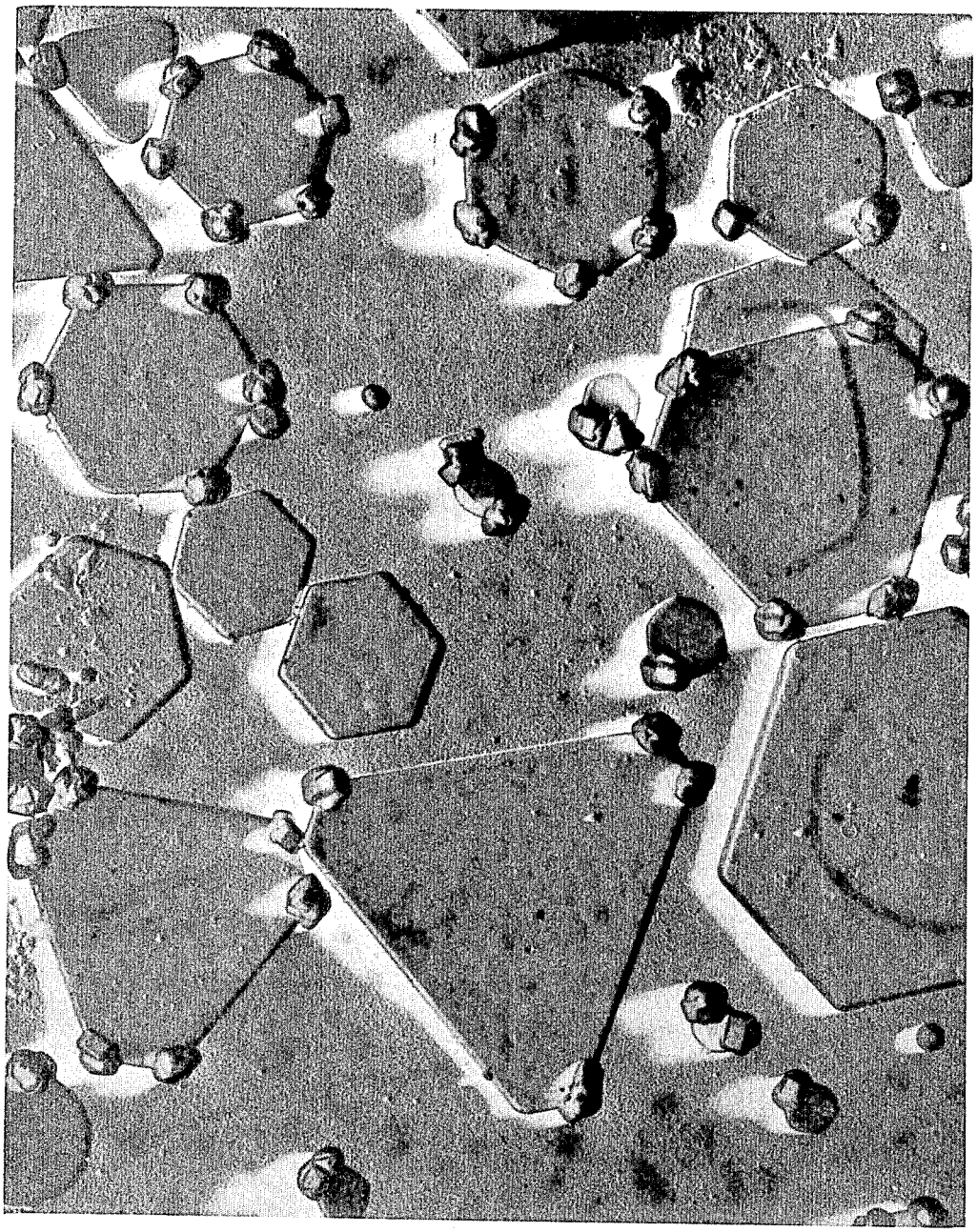

Electron micrographs of Emulsions 18A and 18B above show that Emulsion 18A, which was not spectrally sensitized prior to the addition of the soluble silver and thiocyanate salts, resulted in epitaxial deposition of silver thiocyanate selectively at the edges of the tabular AgBrI grains. FIG. 22 is a representative electron micrograph of Emulsion 18A. Emulsion 18B, which was spectrally sensitized prior to epitaxy, resulted in silver thiocyanate deposition almost exclusively at the corners of the tabular host grains. FIG. 23 is a representative electron micrograph.

EXAMPLE 19

This example illustrates the further chemical sensitization of a tabular grain AgBrI emulsion having corner selective AgSCN epitaxy.

Emulsion 19A Chemically Sensitized Corner Selective AgSCN Epitaxial Growth

The tabular grain AgBrI (6 mole % iodide) host Emulsion 1A was adjusted to pAg 7.2 at 40° C. by the simultaneous addition of 0.1 molar $AgNO_3$ and 0.006 molar KI solutions. The emulsion was centrifuged and resuspended in distilled water. To 40 g of emulsion (0.04 mole) was added 1.0 ml of a 0.13 molar NaSCN solution. Then the emulsion was spectrally sensitized with 1.1 millimoles of Dye A/Ag mole. Then 2.5 mole % AgSCN was precipitated into the host emulsion by double-jet addition for 8.1 minutes of 0.25 molar NaSCN and 0.25 molar $AgNO_3$ solutions while maintaining the pAg at 7.5 at 40° C. The emulsion was also chemically sensitized with 1.0 mg $Na_2S_2O_3.5H_2O$/Ag mole and 1.0 mg $KAuCl_4$/Ag mole added 1 minute after the NaSCN and $AgNO_3$ reagents were started.

Emulsion 19A prepared as described above was coated, exposed and processed in a time of development series as described in Example 2. The tabular grain AgBrI host Emulsion 1A was chemically sensitized with 7.5 mg $Na_2S_2O_3.5H_2O$/Ag mole and 2.5 mg $KAuCl_4$/Ag mole for 10 minutes at 65° C., spectrally Emulsion 24B Preferential Deposition of AgBr on Tabular Grains of AgClBr Emulsion To 2615 g of the the unwashed tabular grain AgClBr Emulsion 24A (1.13 moles) was added for 5 minutes at 55° C. by single-jet addition at a constant flow rate an aqueous sodium bromide solution (0.128 molar). Approximately 3.0 mole% bromide was added. The silver bromide was preferentially deposited at (111) edges of the tabular silver halide grains.

Emulsion 24B was cooled to 20° C., diluted in approximately 14.0 liters of distilled water, stirred, and allowed to settle. The supernatant was decanted, the emulsion redispersed in 330 g of a 10% bone gelatin aqueous solution, and adjusted to pH 5.5 and pAg 7.5 at 40° C.

Emulsion 24B was spectrally sensitized with 0.5 millimole anhydro-5-chloro-9-ethyl-5'-phenyl-3'-(3-sulfobutyl)-3-(3-sulfopropyl)oxacarbocyanine hydroxide, triethylamine salt/Ag mole. Then the emulsion was chemically sensitized with 10 mg sodium thiosulfate pentahydrate/Ag mole, 1600 mg sodium thiocyanate/Ag mole, and 5 mg potassium tetrachloroaurate/Ag mole and held for 5 minutes at 55° C.

Emulsion 24C AgBr Randomly Deposited on Tabular Grains of AgClBr Emulsion.

A portion of Emulsion 24A was washed in a manner similar to that described for Emulsion 24B. The washed emulsion was then spectrally sensitized with 0.5 millimole anhydro-5-chloro-9-ethyl-5'-phenyl-3'-(3-sulfobutyl)-3-(3-sulfopropyl)oxacarbocyanine hydroxide, triethylamine salt/Ag mole. Then a sodium bromide solution was rapidly added to the emulsion in an amount sufficient to add 3 mole % bromide, based on the moles of halide present in Emulsion 24A. The emulsion was then chemically sensitized in a manner described for Emulsion 24B.

Electron micrographs of this emulsion showed that silver bromide had randomly deposited over the grains surfaces.

Emulsions 24B and 24C were coated on cellulose triacetate support at 2.15 g silver/$m^2$ and 5.38 gelatin/$m^2$. The coatings were exposed for 1/50 second to a 600W 5500° K. tungsten light source through a 0–4.0 continuous density wedge. The coatings were processed for 10 minutes in an N-methyl-p-aminophenol sulfate (Elon®) ascorbic acid surface developer at 20° C. Sensitometric results revealed that Emulsion 25B, which had silver bromide epitaxially deposited on the {111} silver halide edges, was approximately 0.25 log E faster in speed than the control, Emulsion 24C, which has silver bromide randomly deposited on the silver halide host tabular grains.

Additional photographic speed for Emulsion 24B was obtained when the chemical and spectral sensitization was conducted in the presence of a relatively low (0.1 mole %) concentration of soluble iodide. Two additional emulsions were prepared similar to that of Emulsion 24B except 0.6 millimole of spectral sensitizer/Ag mole, 7.5 mg of sodium thiosulfate pentahydrate/Ag mole, 1600 mg sodium thiocyanate/Ag mole, and 3.5 mg potassium tetrachloraurate/Ag mole and a hold of 5 minutes at 65° C. were used. Additionally, to one of these two emulsions was added 0.1 mole percent sodium iodide prior to the spectral sensitization. These emulsions were evaluated for photographic speed as described above. The coating containing the iodide treated emulsion was 0.38 Log E faster in speed than that of the emulsion not treated with iodide.

EXAMPLE 25

This example illustrates that emulsions according to the present invention exhibit higher covering power and faster fixing rates than comparable emulsions having nontabular host grains.

Emulsion 25A Nontabular Silver Bromoiodide Host Emulsion

This emulsion was prepared by conventional double-jet precipitation techniques at a pH of 4.5 and a pAg of 5.1 at 79° C. Precipitation was conducted similarly as disclosed in European Patent Application 0019917, published Dec. 10, 1980. The molar ratio of bromide to iodide was 77:23, determined by X-ray diffraction, which also determined that the iodide was uniformly distributed. The grains were octahedral with an average diameter of 1.75 microns and an average grain volume of 2.5 cubic microns.

Emulsion 25B Epitaxial AgCl Deposition on Nontabular Emulsion 25A

Silver chloride in the amount of 2.5 mole percent, based on total halide, was epitaxially deposited on the host octahedral grains of Emulsion 25A in the following manner: Emulsion 25A in the amount of 0.075 mole was placed in a reaction vessel and brought to a final weight of 50.0 g with distilled water. 1.25 ml of a 0.735 molar NaCl solution was added. Then the emulsion was precipitated with 2.5 mole percent AgCl by the double-jet addition of a 0.55 molar NaCl solution and a 0.5 molar $AgNO_3$ solution at a constant flow rate for 5.5 minutes at controlled pAg 7.5 at 40° C. Epitaxial deposition occurred primarily at the corners of the host grains.

Emulsion 25C Tabular Grain Silver Bromoiodide Host Emulsion

A high aspect ratio tabular grain silver bromoiodide emulsion was chosen based on its average grain volume of 2.6 cubic microns, which substantially matched that of Emulsion 25A. By X-ray diffraction the molar ratio of bromide to iodide was determined to be 80:20 with the iodide uniformly distributed. The emulsion had an average tabular grain diameter of 4.0 microns, an average tabular grain thickness of 0.21 micron, an average aspect ratio of 19:1, and an average grain volume of 2.6 cubic microns. Greater than 90 percent of the total projected area of the silver halide grains was provided by the tabular grains.

Emulsion 25D Epitaxial AgCl Deposition on Tabular Grains of Emulsion 25C

The same silver chloride deposition procedure was employed as described above in the preparation of Emulsion 25B, except that Emulsion 25C was initially placed in the reaction vessel instead of Emulsion 25A. Epitaxial deposition occurred primarily at the corners and edges of the host tabular grains.

Control Emulsion 25B was coated on polyester film support at 2.83 g silver/$m^2$ and 10 g gelatin/$m^2$. The coating was exposed for ½ second to a 600W 3000° K. tungsten light source through a 0–6.0 density step tablet (0.30 density steps) and processed for 20 minutes in an N-methyl-p-aminophenol sulfate (Elon®)-hydroquinone developer at 20° C. Emulsion 25D was coated at 2.89 g silver/m$^2$ and 10 g gelatin/m$^2$ and exposed and processed the same as Emulsion 25B.

Emulsion 25D demonstrated superior covering power as compared to control nontabular Emulsion 25B at similar emulsion grain volumes and similar coated silver coverages. Emulsion 25D exhibited a minimum density of 0.16 and a maximum density of 1.25 as compared to a minimum density of 0.10 and a maximum density of 0.54 for control Emulsion 25B. Analysis by X-ray fluorescence showed that 97.2 percent of the silver was developed at $D_{max}$ for the control emulsion coating and 100 percent of the silver was developed for the tabular grain emulsion coating.

Separate, unprocessed portions of the Emulsion 25B and Emulsion 25D coatings were fixed for various times in a sodium thiosulfate fixing bath. (Kodak F-5) at 20° C. and then washed for thirty minutes. The silver remaining in the coatings was analyzed by X-ray fluorescence. As illustrated in Table XI below the tabular grain epitaxial emulsion coatings fixed-out at a faster rate than the octahedral grain epitaxial emulsion coatings.

TABLE XI

| | Control Emulsion 25B | | Tabular Grain Emulsion 25D | |
|---|---|---|---|---|
| Fix Time | Silver in Coating (g/m$^2$) | Silver Fixed-Out | Silver in Coating (g/m$^2$) | Silver Fixed-Out |
| 30" | 2.12 | 25% | 1.51 | 48% |
| 60" | 1.29 | 54% | 0.54 | 81% |
| 90" | 0.60 | 79% | 0.03 | 99% |
| 120" | 0.05 | 98% | 0 | 100% |
| 150" | 0 | 100% | 0 | 100% |

The invention has been described in detail with particular reference to preferred embodiments thereof, but it will be understood that variations and modifications can be effected within the spirit and scope of the invention.

What is claimed is:

1. A tabular grain silver halide emulsion comprised of a dispersing medium and silver halide grains, wherein at least 50 percent of the total projected area of said silver halide grains is provided by tabular silver halide grains having a thickness of less than 0.3 micron, a diameter of a least 0.6 micron, and an average aspect ratio of greater than 8:1, said tabular silver halide grains being bounded by opposed, substantially parallel {111} major crystal faces, and silver salt epitaxially located on and substantially confined to selected surface sites of said tabular grains.

2. A silver halide emulsion according to claim 1 wherein the average aspect ratio is at least 12:1.

3. A silver halide emulsion according to claim 1 wherein the average aspect ratio is at least 20:1.

4. A silver halide emulsion according to claim 1 wherein the dispersing medium is a peptizer.

5. A silver halide emulsion according to claim 2 wherein the peptizer is gelatin or a gelatin derivative.

6. A silver halide emulsion according to claim 2 wherein the tabular silver halide grains account for at least 70 percent of the total projected area of said silver halide grains.

7. A silver halide emulsion according to claim 6 wherein the tabular silver halide grains account for at least 90 percent of the total projected area of said silver halide grains.

8. A silver halide emulsion according to claim 1 wherein the tabular silver halide grains are comprised of bromide.

9. A silver halide emulsion according to claim 8 wherein the tabular silver halide grains are additionally comprised of iodide.

10. A silver halide emulsion according to claim 1 wherein the tabular silver halide grains are comprised of chloride.

11. A silver halide emulsion according to claim 1 wherein the silver salt is silver halide.

12. A silver halide emulsion according to claim 11 wherein the silver salt is comprised of bromide.

13. A silver halide emulsion according to claim 11 wherein the silver salt is comprised of chloride.

14. A silver halide emulsion according to claim 1 wherein the silver salt is silver thiocyanate.

15. A silver halide emulsion according to claim 1 wherein a site director is adsorbed to the tabular silver halide grains.

16. A silver halide emulsion according to claim 15 wherein the site director is a spectral sensitizing dye.

17. A silver halide emulsion according to claim 16 wherein the spectral sensitizing dye is adsorbed to the tabular silver halide grains in an aggregated form.

18. A silver halide emulsion according to claim 1 wherein at least one of the silver salt and the tabular silver halide grains contains a sensitivity modifier incorporated therein.

19. A silver halide emulsion according to claim 1 wherein the silver salt is epitaxially located on less than half of the surface area provided by the major crystal faces.

20. A silver halide emulsion according to claim 19 wherein the silver salt is epitaxially located on less than 25 percent of the surface area provided by the major crystal faces.

21. A silver halide emulsion according to claim 20 wherein the silver salt is epitaxially located on less than 10 percent of the surface area provided by the major crystal faces.

22. A silver halide emulsion according to claim 1 wherein the silver salt is substantially confined to edge sites on the tabular silver halide grains.

23. A silver halide emulsion according to claim 1 wherein the silver salt is substantially confined to one or more corner sites on the tabular silver halide grains:

24. A tabular grain silver halide emulsion comprised of gelatin or a gelatin derivative, silver halide grains, wherein at least 70 percent of the total projected area of said silver halide grains is provided by tabular silver halide grains having a thickness of less than 0.3 micron, a diameter of at least 0.6 micron, and an average aspect ratio of at least 12:1, said tabular silver halide grains being bounded by opposed, substantially parallel hexagonal or triangular major crystal faces, at least one of silver halide and silver thiocyanate epitaxially located on and substantially confined to selected surface sites of said tabular grains, and an aggregating spectral sensitizing dye adsorbed to at least those portions of the major crystal faces free of epitaxially located silver halide or silver thiocyanate.

25. A tabular grain silver halide emulsion according to claim 24 wherein the spectral sensitizing dye is present in a concentration sufficient to provide monomolecular coverage of at least 15 percent of the surface area of said tabular silver halide grains.

26. A tabular grain silver halide emulsion according to claim 25 wherein the spectral sensitizing dye is present in a concentration sufficient to provide monomolecular coverage of at least 70 percent of the surface area of said tabular silver halide grains.

27. A tabular grain silver halide emulsion according to claim 24 wherein the spectral sensitizing dye is an aggregating cyanine or merocyanine dye.

28. A tabular grain silver halide emulsion according to claim 27 wherein the spectral sensitizing dye is an aggregating cyanine dye containing at least one nucleus chosen from the group consisting of quinolinium, benzoxazolium, benzothiazolium, benzoselenazolium, benzimidazolium, naphthoxazolium, naphthothiazolium and naphthoselenazolium nuclei.

29. A tabular grain silver halide emulsion according to claim 28 wherein the spectral sensitizing dye is chosen from the group consisting of anhydro-9-ethyl-3,3'-bis(3-sulfopropyl)-4,5,4',5'-dibenzothiacarbocyanine hydroxide, anhydro-5,5'-dichloro-9-ethyl-3,3'-bis(3-sulfobutyl)-thiacarbocyanine hydroxide, anhydro-5,5',6,6'-tetrachloro-1,1'-diethyl-3,3'-bis(3-sulfobutyl)benzimidazolocarbocyanine hydroxide, anhydro-5,5',6,6'-tetrachloro-1,1',3-triethyl-3'-(3-sulfobutyl)benzimidazolocarbocyanine hydroxide, anhydro-5-chloro-3,9-diethyl-5'-phenyl-3'-(3-sulfopropyl)oxacarbocyanine hydroxide, anhydro-5-chloro-3',9-diethyl-5'-phenyl-3-(3-sulfopropyl)oxacarbocyanine hydroxide, anhydro-5-chloro-9-ethyl-5'-phenyl-3,3'-bis(3-sulfopropyl)oxacarbocyanine hydroxide, anhydro-9-ethyl-5,5'-diphenyl-3,3'-bis(3-sulfobutyl-)oxacarbocyanine hydroxide, anhydro-5,5'-dichloro-3,3'-bis(3-sulfopropyl)thiacyanine hydroxide, and 1,1'-diethyl-2,2'-cyanine p-toluenesulfonate.

30. A tabular grain silver halide emulsion comprised of gelatin or a gelatin derivative, silver halide grains, wherein at least 70 percent of the total projected area of said silver halide grains is provided by tabular silver bromoiodide grains having a thickness of less than 0.3 micron, a diameter of at least 0.6 micron, and an average aspect ratio of at least 12:1, said tabular silver bromoiodide grains being bounded by opposed, substantially parallel {111} major crystal faces, and at least one of silver halide and silver thiocyanate epitaxially located on and substantially confined to selected surface sites on said tabular silver bromoiodide grains.

31. A tabular grain silver halide emulsion according to claim 30 wherein at least one silver halide containing a sensitivity modifier incorporated therein is epitaxially located on and substantially confined to selected surface sites on said tabular silver bromoiodide grains.

32. A tabular grain silver halide emulsion according to claim 31 wherein said sensitivity modifier provides electron trapping sites in the epitaxially located silver halide.

33. A tabular grain silver halide emulsion according to claim 30 wherein the sensitivity modifier is a Group VIII noble metal.

34. A tabular grain silver halide emulsion according to claim 31 wherein said tabular grain silver halide emulsion is chemically sensitized with at least one of sulfur, selenium and gold.

35. A tabular grain silver halide emulsion comprised of a dispersing medium, silver halide grains, wherein at least 50 percent of the total projected area of said silver halide grains is provided by tabular silver bromoiodide grains having a thickness of less than 0.3 micron, a diameter of at least 0.6 micron, and an average aspect ratio greater than 8:1, said tabular silver bromoiodide grains being bounded by opposed, substantially parallel {111} major crystal faces, and silver thiocyanate epitaxially located on and substantially confined to edge or corner sites of the tabular silver bromoiodide grains.

36. A tabular grain silver halide emulsion according to claim 35 wherein the average aspect ratio is at least 12:1.

37. A tabular grain silver halide emulsion according to claim 35 wherein the average aspect ratio is at least 20:1.

38. A tabular grain silver halide emulsion according to claim 35 wherein the dispersing medium is comprised of gelatin or a gelatin derivative peptizer.

39. A tabular grain silver halide emulsion according to claim 35 wherein the tabular silver halide grains account for at least 70 percent of the total projected area of said silver halide grains.

40. A tabular grain silver halide emulsion comprised of a dispersing medium, silver halide grains, wherein at least 50 percent of the total projected area of said silver halide grains is provided by tabular silver bromoiodide grains having a thickness of less than 0.3 micron, a diameter of at least 0.6 micron, and an average aspect ratio greater than 8:1, said tabular silver bromoiodide grains being bounded by opposed, substantially parallel {111} major crystal faces, and silver chloride epitaxially located on and substantially confined to edge or corner sites of the tabular silver bromoiodide grains.

41. A tabular grain silver halide emulsion according to claim 40 wherein the average aspect ratio is at least 12:1.

42. A tabular grain silver halide emulsion according to claim 40 wherein the average aspect ratio is at least 20:1.

43. A tabular grain silver halide emulsion according to claim 40 wherein the dispersing medium is comprised of gelatin or a gelatin derivative peptizer.

44. A tabular grain silver halide emulsion according to claim 40 wherein the tabular silver halide grains account for at least 70 percent of the total projected area of said silver halide grains.

45. A tabular grain silver halide emulsion comprised of a dispersing medium, silver halide grains, wherein at least 50 percent of the total projected area of said silver halide grains is provided by tabular silver bromoiodide grains having a thickness of less than 0.3 micron, a diameter of at least 0.6 micron, and an average aspect ratio greater than 8:1, said tabular silver bromoiodide grains being bounded by opposed, substantially parallel {111} major crystal faces, silver bromide epitaxially located on and substantially confined to edge or corner sites of the tabular silver bromoiodide grains, and an aggregating spectral sensitizing dye adsorbed to at least those portions of the major crystal faces free of epitaxially located silver bromide.

46. A tabular grain silver halide emulsion according to claim 45 wherein the average aspect ratio is at least 12:1.

47. A tabular grain silver halide emulsion according to claim 45 wherein the average aspect ratio is at least 20:1.

48. A tabular grain silver halide emulsion according to claim 45 wherein the dispersing medium is comprised of gelatin or a gelatin derivative peptizer.

49. A tabular grain silver halide emulsion according to claim 45 wherein the tabular silver halide grains account for at least 70 percent of the total projected area of said silver halide grains.

50. A tabular grain silver halide emulsion comprised of a dispersing medium, silver halide grains, wherein at least 50 percent of the total projected area of said silver halide grains is provided by tabular silver bromoiodide grains having a thickness of less than 0.3 micron, a diameter of at least 0.6 micron, and an average aspect ratio greater than 8:1, said tabular silver bromoiodide grains being bounded by opposed, substantially parallel {111} major crystal faces, said tabular silver bromoiodide grains containing less than 5 mole percent iodide in a central region and at least 8 mole percent iodide in a laterally surrounding annular region, said central region forming a preferred site for sensitization on each of said major crystal faces of said tabular silver bromoiodide grains, and silver chloride epitaxially located on and substantially confined to the preferred sensitization sites on said tabular silver bromoiodide grains.

51. A tabular grain silver halide emulsion according to claim 50 wherein the average aspect ratio is at least 12:1.

52. A tabular grain silver halide emulsion according to claim 50 wherein the average aspect ratio is at least 20:1.

53. A tabular grain silver halide emulsion according to claim 50 wherein the dispersing medium is comprised of gelatin or a gelatin derivative peptizer.

54. A tabular grain silver halide emulsion according to claim 50 wherein the tabular silver halide grains account for at least 70 percent of the total projected area of said silver halide grains.

55. A tabular grain silver halide emulsion according to claim 50 wherein the annular region is comprised of at least 12 mole percent iodide.

56. A tabular grain silver halide emulsion according to claim 50 wherein no more than one crystal of silver chloride is epitaxially located at each major crystal face.

57. A tabular grain silver halide emulsion according to claim 50 wherein the silver chloride contains at least one sensitivity modifier incorporated therein.

58. A tabular grain silver halide emulsion according to claim 57 wherein the sensitivity modifier is a Group VIII noble metal.

59. A tabular grain silver halide emulsion according to claim 57 wherein the sensitivity modifier is at least one of sulfur, selenium and gold.

60. A tabular grain silver halide emulsion comprised of a dispersing medium, silver halide grains, wherein at least 50 percent of the total projected area of said silver halide grains is provided by tabular silver bromide grains having a thickness of less than 0.3 micron, a diameter of at least 0.6 micron, and an average aspect ratio greater than 8:1, said tabular silver bromide grains being bounded by opposed, substantially parallel {111} major crystal faces, silver chloride epitaxially located on and substantially confined to edge or corner sites of the tabular silver bromide grains, and an aggregating spectral sensitizing dye adsorbed to at least those portions of the major crystal faces free of epitaxially located silver chloride.

61. A tabular grain silver halide emulsion according to claim 60 wherein the average aspect ratio is at least 12:1.

62. A tabular grain silver halide emulsion according to claim 60 wherein the average aspect ratio is at least 20:1.

63. A tabular grain silver halide emulsion according to claim 60 wherein the dispersing medium comprises gelatin or a gelatin derivative peptizer.

64. A tabular grain silver halide emulsion according to claim 60 wherein the tabular silver halide grains account for at least 70 percent of the total projected area of said silver halide grains.

65. A tabular grain silver halide emulsion according to claim 60 wherein the tabular silver halide grains account for at least 90 percent of the total projected area of said silver halide grains.

66. A tabular grain silver halide emulsion comprised of a disersing medium, silver halide grains, wherein at least 50 percent of the total projected area of said silver halide grains is provided by tabular silver bromide grains having a thickness of less than 0.3 micron, a diameter of at least 0.6 micron, and an average aspect ratio greater than 8:1, said tabular silver bromide grains being bounded by opposed, substantially parallel {111} major crystal faces, and silver thiocyanate epitaxially located on and substantially confined to edge sites of the tabular silver bromide grains.

67. A tabular grain silver halide emulsion according to claim 66 wherein the average aspect ratio is at least 12:1.

68. A tabular grain silver halide emulsion according to claim 66 wherein the average aspect ratio is at least 20:1.

69. A tabular grain silver halide emulsion according to claim 66 wherein the dispersing medium is comprised of gelatin or a gelatin derivative peptizer.

70. A tabular grain silver halide emulsion according to claim 66 wherein the tabular silver halide grains account for at least 70 percent of the total projected area of said silver halide grains.

71. A tabular grain silver halide emulsion comprised of a dispersing medium, silver halide grains, wherein at least 50 percent of the total projected area of said silver halide grains is provided by tabular silver bromide grains having a thickness of less than 0.3 micron, a diameter of at least 0.6 micron, and an average aspect ratio greater than 8:1, said tabular silver bromide grains being bounded by opposed, substantially parallel {111} major crystal faces, silver thiocyanate epitaxially located on and substantially confined to edge or corner sites of the tabular silver bromide grains, and an aggregating spectral sensitizing dye adsorbed to at least those portions of the major crystal faces free of epitaxially located silver thiocyanate.

72. A tabular grain silver halide emulsion according to claim 71 wherein the average aspect ratio is at least 12:1.

73. A tabular grain silver halide emulsion according to claim 71 wherein the average aspect ratio is at least 20:1.

74. A tabular grain silver halide emulsion according to claim 71 wherein the dispersing medium is comprised of gelatin or a gelatin derivative peptizer.

75. A tabular grain silver halide emulsion according to claim 71 wherein the tabular silver halide grains account for at least 70 percent of the total projected area of said silver halide grains.

76. A tabular grain silver halide emulsion comprised of a dispersing medium, silver halide grains, wherein at least 50 percent of the total projected area of said silver halide grains is provided by tabular silver chloride grains having a thickness of less than 0.3 micron, a diameter of at least 0.6 micron, and an average aspect ratio greater than 8:1, said tabular silver chloride grains being bounded by opposed, substantially parallel {111} major crystal faces, and silver thiocyanate epitaxially located on and substantially confined to edge sites of the tabular silver chloride grains.

77. A tabular grain silver halide emulsion according to claim 76 wherein the average aspect ratio is at least 12:1.

78. A tabular grain silver halide emulsion according to claim 76 wherein the average aspect ratio is at least 20:1.

79. A tabular grain silver halide emulsion according to claim 76 wherein the dispersing medium is comprised of gelatin or a gelatin derivative peptizer.

80. A tabular grain silver halide emulsion according to claim 76 wherein the tabular silver halide grains account for at least 70 percent of the total projected area of said silver halide grains.

81. A tabular grain silver halide emulsion comprised of a dispersing medium, silver halide grains, wherein at least 50 percent of the total projected area of said silver halide grains is provided by tabular silver halide grains having a thickness of less than 0.3 micron, a diameter of at least 0.6 micron, and an average aspect ratio greater than 8:1, said tabular silver grains being bounded by opposed, substantially parallel {111} major crystal faces, said silver halide forming said tabular grains additionally forming nontabular extensions of said tabular grains at one or more of their corners, and an aggregating spectral sensitizing dye adsorbed to the major crystal faces of the tabular silver halide grains.

82. A tabular grain silver halide emulsion according to claim 81 wherein the average aspect ratio is at least 12:1.

83. A tabular grain silver halide emulsion according to claim 81 wherein the average aspect ratio is at least 20:1.

84. A tabular grain silver halide emulsion according to claim 81 wherein the dispersing medium is comprised of gelatin or a gelatin derivative peptizer.

85. A tabular grain silver halide emulsion according to claim 81 wherein the tabular silver halide grains account for at least 70 percent of the total projected area of said silver halide grains.

86. A tabular grain silver halide emulsion according to claim 81 wherein at least one of said tabular grains and said nontabular extensions thereof contain a sensitivity modifier incorporated therein.

87. In a photographic element comprised of a support and at least one radiation-sensitive emulsion layer, the improvement wherein said emulsion layer is comprised of an emulsion according to claims 1, 24, 30, 35, 40, 45, 50, 60, 66, 71, 76 or 81.

88. A process of producing a visible photographic image comprising processing in an aqueous alkaline solution in the presence of a developing agent an imagewise-exposed photographic element according to claim 87.

89. A tabular grain silver halide emulsion comprised of a dispersing medium and silver halide grains, wherein at least 50 percent of the total projected area of said silver halide grains is provided by tabular silver halide grains having a thickness of less than 0.5 micron, a diameter of at least 0.6 micron, and an average aspect ratio of greater than 8:1, said tabular silver halide grains being bounded by opposed, substantially parallel {111} major crystal faces, and silver salt epitaxially located on and substantially confined to selected surface sites of said tabular grains.

90. A silver halide emulsion according to claim 89 wherein the average aspect ratio is at least 12:1.

91. A silver halide emulsion according to claim 89 wherein the average aspect ratio is at least 20:1.

92. A silver halide emulsion according to claim 89 wherein the dispersing medium is a peptizer.

93. A silver halide emulsion according to claim 92 wherein the peptizer is gelatin or a gelatin derivative.

94. A silver halide emulsion according to claim 90 wherein the tabular silver halide grains account for at least 70 percent of the total projected area of said silver halide grains.

95. A silver halide emulsion according to claim 94 wherein the tabular silver halide grains account for at least 90 percent of the total projected area of said silver halide grains.

96. A silver halide emulsion according to claim 89 wherein the tabular silver halide grains are comprised of bromide.

97. A silver halide emulsion according to claim 96 wherein the tabular silver halide grains are additionally comprised of iodide.

98. A silver halide emulsion according to claim 89 wherein the tabular silver halide grains are comprised of chloride.

99. A silver halide emulsion according to claim 90 wherein the silver salt is silver halide.

100. A silver halide emulsion acording to claim 89 wherein the silver salt is comprised of bromide.

101. A silver halide emulsion according to claim 99 wherein the silver salt is comprised of chloride.

102. A silver halide emulsion according to claim 89 wherein the silver salt is silver thiocyanate.

103. A silver halide emulsion according to claim 89 wherein a site director is adsorbed to the tabular silver halide grains.

104. A silver halide emulsion according to claim 103 wherein the site director is a spectral sensitizing dye.

105. A silver halide emulsion according to claim 104 wherein the spectral sensitizing dye is adsorbed to the tabular silver halide grains in an aggregated form.

106. A silver halide emulsion according to claim 89 wherein at least one of the silver salt and the tabular silver halide grains contains a sensitivity modifier incorporated therein.

107. A silver halide emulsion according to claim 89 wherein the silver salt is epitaxially located on less than half of the surface area provided by the major crystal faces.

108. A silver halide emulsion according to claim 107 wherein the silver salt is epitaxially located on less than 25 percent of the surface area provided by the major crystal faces.

109. A silver halide emulsion according to claim 108 wherein the silver salt is epitaxially located on less than 10 percent of the surface area provided by the major crystal faces.

110. A silver halide emulsion according to claim 89 wherein the silver salt is substantially confined to edge sites on the tabular silver halide grains.

111. A silver halide emulsion according to claim 89 wherein the silver salt is substantially confined to one or more corner sites on the tabular silver halide grains.

* * * * *